US012600590B2

(12) United States Patent
Techlin

(10) Patent No.: US 12,600,590 B2
(45) **Date of Patent: *Apr. 14, 2026**

(54) SURFACE REWINDER WITH CENTER ASSIST AND BELT AND WINDING DRUM FORMING A WINDING NEST

(71) Applicant: BW Converting, Inc., Green Bay, WI (US)

(72) Inventor: Michael E. Techlin, DePere, WI (US)

(73) Assignee: BW Converting, Inc., Green Bay, WI (US)

( * ) Notice: Subject to any disclaimer, the term of this patent is extended or adjusted under 35 U.S.C. 154(b) by 230 days.

This patent is subject to a terminal disclaimer.

(21) Appl. No.: 18/405,169

(22) Filed: Jan. 5, 2024

(65) Prior Publication Data

US 2024/0150145 A1 May 9, 2024

Related U.S. Application Data

(62) Division of application No. 17/210,869, filed on Mar. 24, 2021, now Pat. No. 11,912,519, which is a (Continued)

(51) Int. Cl.
*B65H 18/20* (2006.01)
*B65H 18/10* (2006.01)
(Continued)

(52) U.S. Cl.
CPC ..... *B65H 18/10* (2013.01); *B65H 18/20* (2013.01); *B65H 18/26* (2013.01);
(Continued)

(58) Field of Classification Search
CPC ..... B65H 18/10; B65H 18/20; B65H 18/22; B65H 19/2269; B65H 2408/235; B65H 2404/43
See application file for complete search history.

(56) References Cited

U.S. PATENT DOCUMENTS 1,437,398 A 12/1922 Cameron
2,090,130 A 8/1937 Kittel
(Continued)

FOREIGN PATENT DOCUMENTS

EP 0854834 A1 7/1998
EP 2550218 B1 1/2016
(Continued)

OTHER PUBLICATIONS

Aarinen, "Optimisation of Customer Roll Quality in Winding", International Pulp and Paper Technology, 2006, pp. 1-34.
(Continued)

*Primary Examiner* — Sang K Kim
(74) *Attorney, Agent, or Firm* — Thompson Coburn LLP

(57) ABSTRACT

A rewinding machine winds a web material into a log about a core. The web material to be wound is directed about a rotating winding drum. A continuous loop is spaced from the winding drum and with the winding drum defines a nip through which the core is inserted and through which the web material is directed. A surface of the continuous loop opposite the winding drum across the nip is configured to move in a direction generally opposite of the winding drum for winding the web material about the core. A rider roll defines a winding space with the winding drum and the continuous loop. The rider roll is movable relative to the continuous loop and the winding drum to allow for an increase in a diameter of the log in the winding space during winding of the web material about the core.

19 Claims, 42 Drawing Sheets

Related U.S. Application Data division of application No. 16/201,034, filed on Nov. 27, 2018, now Pat. No. 11,046,540.

(60) Provisional application No. 62/592,103, filed on Nov. 29, 2017.

(51) Int. Cl.
*B65H 18/26* (2006.01)
*B65H 19/22* (2006.01)

(52) U.S. Cl.
CPC ..... *B65H 19/2269* (2013.01); *B65H 2301/41447* (2013.01); *B65H 2301/41822* (2013.01); *B65H 2408/235* (2013.01)

(56) References Cited

U.S. PATENT DOCUMENTS

| | | | |
|---|---|---|---|
| 2,385,692 | A | 9/1945 | Corbin |
| 2,749,133 | A | 6/1956 | Rich |
| 2,883,121 | A | 4/1959 | Barlament et al. |
| 3,097,808 | A | 7/1963 | Williams |
| 3,148,843 | A | 9/1964 | Turner et al. |
| 3,592,403 | A | 7/1971 | Schmitt et al. |
| 3,610,545 | A | 10/1971 | Reifenhauser et al. |
| 3,704,835 | A | 12/1972 | Harley |
| 3,791,602 | A | 2/1974 | Isakson |
| 3,841,578 | A | 10/1974 | Dorfel |
| 3,844,501 | A | 10/1974 | Spencer |
| 4,327,877 | A | 5/1982 | Perini |
| 4,487,377 | A | 12/1984 | Perini |
| 4,520,704 | A | 6/1985 | Olshansky et al. |
| 4,583,698 | A | 4/1986 | Nistri et al. |
| 4,723,724 | A | 2/1988 | Bradley |
| 4,842,209 | A | 6/1989 | Saukkonen |
| 4,856,725 | A | 8/1989 | Bradley |
| 4,962,897 | A | 10/1990 | Bradley |
| 5,137,225 | A | 8/1992 | Biagiotti |
| 5,150,848 | A | 9/1992 | Consani |
| 5,150,850 | A | 9/1992 | Adams |
| 5,267,703 | A | 12/1993 | Biagiotti |
| 5,368,252 | A | 11/1994 | Biagiotti |
| 5,370,335 | A | 12/1994 | Vigneau |
| 5,372,331 | A | 12/1994 | Miller et al. |
| 5,505,405 | A | 4/1996 | Vigneau |
| 5,538,199 | A | 7/1996 | Biagiotti |
| 5,639,045 | A | 6/1997 | Dorfel |
| 5,639,046 | A | 6/1997 | Biagiotti |
| 5,690,296 | A | 11/1997 | Biagiotti |
| 5,725,176 | A | 3/1998 | Vigneau |
| 5,769,352 | A | 6/1998 | Biagiotti |
| 5,839,680 | A | 11/1998 | Biagiotti |
| 5,853,140 | A | 12/1998 | Biagiotti |
| 5,901,918 | A | 5/1999 | Klerelid et al. |
| 5,934,604 | A | 8/1999 | Klimek |
| 5,954,291 | A | 9/1999 | Meinecke et al. |
| 5,979,818 | A | 11/1999 | Perini et al. |
| 6,056,229 | A | 5/2000 | Blume et al. |
| 6,082,659 | A | 7/2000 | Sankaran et al. |
| 6,109,559 | A | 8/2000 | Dorfel et al. |
| 6,199,789 | B1 | 3/2001 | Marco |
| 6,283,402 | B1 | 9/2001 | Fordham |
| 6,422,501 | B1 | 7/2002 | Hertel et al. |
| 6,595,458 | B1 | 7/2003 | Biagiotti |
| 6,729,572 | B2 | 5/2004 | Baggot et al. |
| 6,866,220 | B2 | 3/2005 | Sosalla et al. |
| 6,877,689 | B2 | 4/2005 | Butterworth |
| 6,945,491 | B2 | 9/2005 | Gambini |
| 7,000,864 | B2 | 2/2006 | McNeil et al. |
| 7,104,494 | B2 | 9/2006 | Casella et al. |
| 7,175,126 | B2 | 2/2007 | Perini |
| 7,175,127 | B2 | 2/2007 | Butterworth et al. |
| 7,222,813 | B2 | 5/2007 | Tung-I |
| 7,293,736 | B2 | 11/2007 | Recami et al. |
| 7,344,104 | B2 | 3/2008 | Hada et al. |
| 7,392,961 | B2 | 7/2008 | McNeil et al. |
| 7,455,260 | B2 | 11/2008 | McNeil et al. |
| 7,614,328 | B2 | 11/2009 | Perini et al. |
| 7,641,142 | B2 | 1/2010 | Tsai |
| 7,775,476 | B2 | 8/2010 | Recami et al. |
| 7,896,284 | B2 | 3/2011 | Morelli et al. |
| 7,909,282 | B2 | 3/2011 | Wojcik et al. |
| 7,942,363 | B2 | 5/2011 | Gelli et al. |
| 8,162,251 | B2 | 4/2012 | Vaughn et al. |
| 8,181,897 | B2 | 5/2012 | Tsai |
| 9,284,147 | B2 | 3/2016 | Techlin |
| 9,352,920 | B2 | 5/2016 | Morelli et al. |
| 9,701,505 | B2 | 7/2017 | Morelli et al. |
| 9,896,293 | B2 | 2/2018 | Haapanen et al. |
| 9,919,888 | B2 | 3/2018 | Techlin |
| 9,975,720 | B2 | 5/2018 | Techlin |
| 9,988,228 | B2 | 6/2018 | Giannini et al. |
| 11,046,540 | B2 * | 6/2021 | Techlin ..... B65H 75/30 |
| 11,247,863 | B2 | 2/2022 | Techlin et al. |
| 11,383,946 | B2 | 7/2022 | Techlin |
| 11,643,294 | B2 | 5/2023 | Techlin et al. |
| 11,912,519 | B2 * | 2/2024 | Techlin ..... B65H 75/30 |
| 2003/0189123 | A1 | 10/2003 | Biagiotti et al. |
| 2004/0241094 | A1 | 12/2004 | Chung et al. |
| 2005/0279875 | A1 | 12/2005 | Biagiotti et al. |
| 2006/0284000 | A1 | 12/2006 | Dooley et al. |
| 2007/0176039 | A1 | 8/2007 | Gelli et al. |
| 2009/0173819 | A1 | 7/2009 | Maddaleni et al. |
| 2009/0272835 | A1 | 11/2009 | Benvenuti et al. |
| 2009/0302146 | A1 | 12/2009 | Morelli et al. |
| 2013/0020427 | A1 | 1/2013 | Gelli et al. |
| 2013/0026280 | A1 | 1/2013 | Li et al. |
| 2015/0307315 | A1 | 10/2015 | Techlin et al. |
| 2017/0210584 | A1 | 7/2017 | Morelli et al. |
| 2017/0233207 | A1 | 8/2017 | Dettori et al. |
| 2018/0179007 | A1 | 6/2018 | Seymour |
| 2021/0206592 | A1 | 7/2021 | Techlin |

FOREIGN PATENT DOCUMENTS

| | | | |
|---|---|---|---|
| EP | 3148906 | B1 | 8/2018 |
| IT | 1230585 | B | 10/1991 |
| IT | 1230935 | B | 11/1991 |
| JP | S54-125716 | A | 9/1979 |
| JP | H04-317946 | A | 11/1992 |
| JP | H08-053244 | A | 2/1996 |
| WO | 2015/181339 | A1 | 12/2015 |
| WO | 2019108480 | A1 | 6/2019 |

OTHER PUBLICATIONS

Good et al., "Winding: Machines, Mechanics and Measurements", 2008, pp. 4-9 and pp. 184-188, Tappi Press.
International Search Report and Written Opinion for PCT/US2018/062462 dated Nov. 26, 2018.
International Search Report and Written Opinion for PCT/US2019/033071 dated Jul. 19, 2019.
Roisum, "The Mechanics of Winding", 1994, pp. 1-15, Tappi Press.

* cited by examiner

SURFACE REWINDER WITH CENTER ASSIST AND BELT AND WINDING DRUM FORMING A WINDING NEST

RELATED APPLICATION DATA

This application is a divisional application of application Ser. No. 17/210,869, filed Mar. 24, 2021, which is a divisional application of application Ser. No. 16/201,034, filed Nov. 27, 2018, issued as U.S. Pat. No. 11,046,540 on Jun. 29, 2021, which claims the benefit of provisional application app. Ser. No. 62/592,103, filed Nov. 29, 2017, the disclosures of which is incorporated by reference herein.

INTRODUCTION

This disclosure relates to rewinding machines that wind a web material around central cores to form logs of wound web material. Specifically, the disclosure is directed to an improved apparatus and method for winding and for controlling the logs during the introduction, winding, and discharge phases. In particular, at least one belt is used in conjunction with a winding drum, which feeds the web, to form a winding nest. Between the drum and belt is a space through which the winding cores are inserted and through which the web material is fed. The surface speed of the belt, relative to the winding drum, is used to control the logs during the introduction, winding, and discharge phases.

BACKGROUND

A rewinder is used to convert large parent rolls of web into smaller sized rolls of bathroom tissue, kitchen towel, hardwound towel, industrial products, nonwovens products, and the like. A rewinder line consists of one or more unwind stations, modules for finishing—such as embossing, printing, perforating—and a rewind station at the end for winding. Typically the rewind station produces logs having a diameter of between 90 mm and 180 mm for bath tissue and kitchen towel and between 150 mm to 350 mm diameter for hardwound towel and industrial products. The width of the logs is usually 1.5 m to 5.4 m, depending on the parent roll width. Typically the logs are subsequently cut transversely to obtain small rolls having a width of between 90 mm and 115 mm for bath tissue and between 200 mm to 300 mm for kitchen towel and hardwound towel. In some cases the web from the parent roll is slit into ribbons and wound with the finished roll width at the rewind station, without the need for subsequent transverse cutting.

Two types of rewinding systems are commonly used: center winders and surface winders. The defining characteristic of center winders is that the web is wound on a core that is supported and rotationally driven by a mandrel within the core. The defining characteristic of surface winders is that the web is wound into a log that is supported and rotationally driven by machine elements at the log periphery. Most surface winders have tubular cores in the log. However, some operate with mandrels; and some use neither, instead producing solid rolls.

It has been known in the industry that center winders are effective at winding low firmness, high bulk logs, but have certain limitations. They cannot produce firm products at high speeds effectively because the only control is incoming web tension. Higher web tension will produce a firmer log, but higher web tension correlates with more frequent web blowouts due to bursting of perforations or tearing from defects along the edges of the web. Also, center winders cannot run high speeds at wide web widths due to the slender mandrel inside the log producing excessive log vibration at various natural frequency modes. Another limitation is the challenge in running high cycle rates due to the time in the cycle required to decelerate the log gradually, and the time in the cycle to remove the finished log from the mandrel.

It has been known in the industry that surface winders are effective at winding high firmness, low bulk logs, but have certain limitations. It is a challenge to produce low firmness, large diameter products at high speeds effectively because of the occurrence of excessive log vibration. The vibration can be severe enough to cause winding defects, such as wrinkles and eccentric cores; sheet defects, such as variation in the embossed pattern, damaged perforations, and tattered tail in the last web wrap; or operational problems, such as breakage of the web and failure to discharge a finished log.

Nonetheless, it is generally acknowledged in the industry that surface winders have more advantages overall. They have higher cycle rate potential because no time is required in the cycle for withdrawing full-length mandrels from the cores. They have greater width potential because the elements that support and drive the log can be as large in diameter as necessary, or utilize intermediate supports, to accommodate large widths, even for high converting speeds. They also have lower cost potential because they do not have complex mandrels inside the cores. They can wind high and moderate firmness products well. They can wind low firmness products too, though at lower speed to avoid onset of excessive log vibration.

In some cases the elements of the center winder and surface winder have been combined to partially offset the drawbacks of each. Rider rolls may be added to center winders, for instance, to assist in producing lower bulk, firmer logs. Chucks or plugs that engage and rotationally drive the ends of the cores may be added to surface winders, for instance, to assist in producing higher bulk, less firm logs. These are referred to as center-surface winders or rewinders, and sometimes as hybrid winders or rewinders.

Trends in the market for bathroom tissue and kitchen towel have been for larger diameter rolls that feel softer, due to lower wound firmness, and are produced with less material. The amount of material may be reduced by decreasing the product length, thus requiring higher cycle rates of the rewinder. It may also be reduced by decreasing the density of the substrate, such as by using structured web or specialized embossing, which tends to render the thickness of the web more fragile. A major challenge is that larger diameter logs composed of less material and wound with less firmness are more prone to excessive vibration at high, and sometimes even moderate, web speeds. Excessive vibration can cause winding defects, sheet defects, and operational problems, as described above. Having to reduce the winding speed to avoid excessive vibration reduces the production capacity of the converting line, which is not economical.

Therefore the market desires a rewinding system that can wind low firmness products at higher speeds without excessive log vibration. The need is most acute for a winding system that can wind low firmness products of large diameter at higher speeds without excessive log vibration.

The market further desires a rewinding system that is tolerant of variations in properties of the web material, so that the operator need not be extraordinarily vigilant, nor require specialized skills, to make compensatory adjustments during the course of production. This may be a system that is inherently tolerant, also known as robust. It may be a system that automatically makes its own compensatory adjustments. It may be a combination of both.

SUMMARY

The disclosure that follows describes an improved apparatus and method for winding web material around central cores to form logs of wound web material, and for controlling the logs during the introduction, winding, and discharge phases. At least one belt is used in conjunction with a winding drum, which feeds the web, to form a winding nest. Between the drum and belt is a space through which the winding cores are inserted and through which the web material is fed. The belt is a continuous flexible member arranged as an endless loop, operably mounted so it can be moved with a velocity tangent to its surface.

In one aspect of the disclosure, the belt is made to move with surface velocity in a direction generally opposite that of the inserted core and feeding web. This surface velocity of the belt, acting with the generally opposite surface velocity of the winding drum, causes the log to turn in rotation to wind the web material.

In another aspect of the disclosure, the surface velocity of the belt is varied cyclically relative to the velocity of the winding drum to control the advancement of a log through the space between the winding drum and the belt into the winding nest.

In another aspect of the disclosure, the surface velocity of the belt is varied cyclically relative to the velocity of the winding drum to control the winding of a log in the winding nest.

In another aspect of the disclosure, the surface velocity of the belt is varied cyclically relative to the velocity of the winding drum to control the discharge of a log from the winding nest.

In another aspect of the disclosure, the surface velocity of the belt is varied cyclically relative to the velocity of the winding drum and the distance between the belt and the winding drum is varied cyclically to control the advancement of a log through the space between the winding drum and the belt into the winding nest.

In another aspect of the disclosure, the surface velocity of the belt is varied cyclically relative to the velocity of the winding drum and the distance between the belt and the winding drum is varied cyclically to control the winding of a log in the winding nest.

In another aspect of the disclosure, the surface velocity of the belt is varied cyclically relative to the velocity of the winding drum and the distance between the belt and the winding drum is varied cyclically to control the discharge of a log from the winding nest.

In another aspect of the disclosure, the winding nest is provided with a rider roll, which is rotatably mounted, and is movable relative to the winding drum and the belt to allow an increase in diameter of each log in the winding nest.

In another aspect of the disclosure, the winding nest is provided with at least one rotationally driven core chuck that engages the end of the core inside the winding log to apply a torque to the core. In a further aspect of the disclosure, the winding nest is provided with two rotationally driven core chucks, one at each end of the core, that engage the ends of the core inside the winding log to apply a torque to the core.

In another aspect of the disclosure, the winding nest is provided with two rider rolls, which are each rotatably mounted, and are movable relative to the winding drum, the belt, and each other, to allow an increase in diameter of each log in the winding nest.

In another aspect of the disclosure, a stationary rolling surface is provided upstream from the belt, on the same side of the space between the winding drum and the belt as the belt, wherein the inserted core is driven in rotation by the winding drum along the stationary rolling surface and then into a space between the winding drum and the belt.

In another aspect of the disclosure, the belt is substantially under the winding log in the winding nest.

In another aspect of the disclosure, the core chuck or core chucks insert and engage the core ends after the log is in contact with the belt and the winding drum, and they disengage and withdraw before discharge of the log from the winding nest.

In another aspect of the disclosure, the winding log remains substantially in contact with the winding drum during a preponderance of the winding cycle, until it is nearly complete, when it separates from the winding drum at the start of log discharge from the winding nest.

In another aspect of the disclosure, the winding log remains substantially in contact with the belt during a preponderance of the winding cycle, from when it first contacts the belt, until it moves away from the belt during log discharge from the winding nest.

In another aspect of the disclosure, the winding log remains substantially in contact with a rider roll during a preponderance of the winding, from when it first contacts the rider roll, until it is nearly complete, when it separates from the rider roll during log discharge from the winding nest.

In another aspect of the disclosure, the winding log remains substantially in contact with the winding drum, the belt, and a rider roll during a preponderance of the winding.

In another aspect of the disclosure, the winding log remains substantially in contact with the winding drum, the belt, a rider roll, and a further rider roll during a preponderance of the winding.

In another aspect of the disclosure, the winding log is substantially in contact with the winding drum, the belt, and a rider roll during a portion of the winding cycle; then it is substantially in contact with the belt, the rider roll, and a further rider roll during a later portion of the wind cycle, the winding log having been moved out of contact with the winding drum.

DETAILED DESCRIPTION

Figure 1:
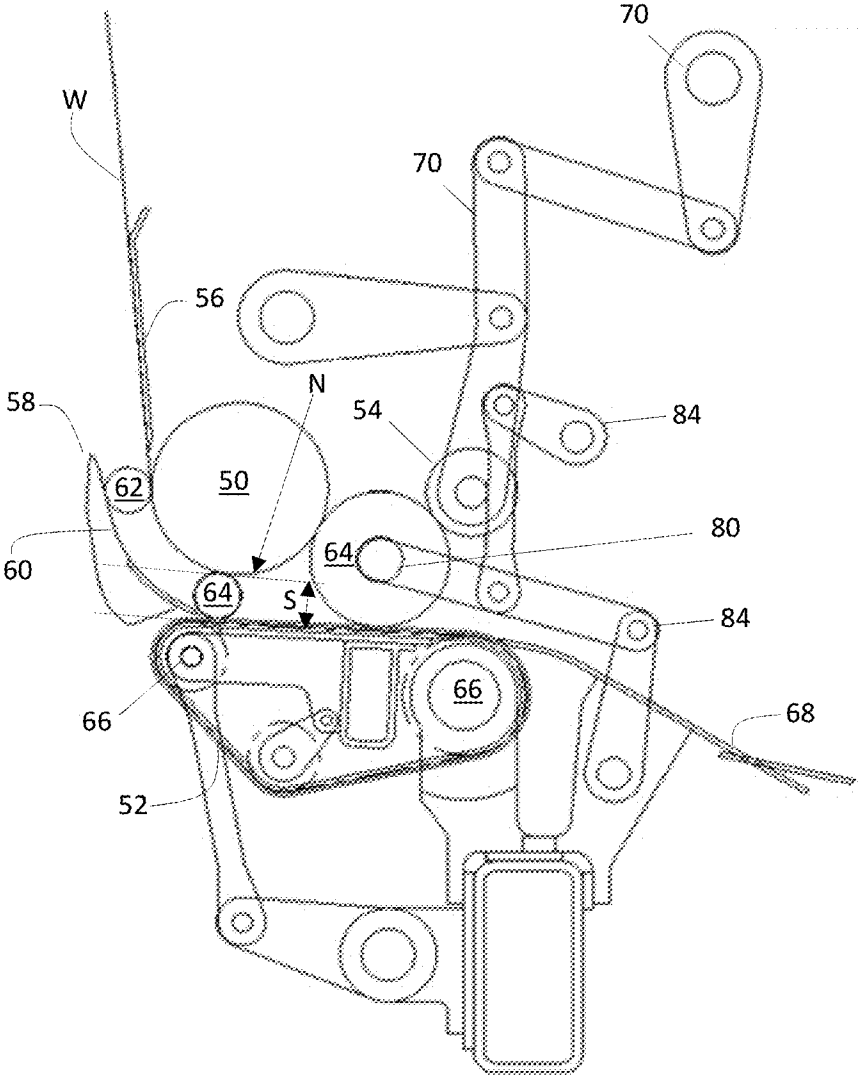
FIG. 1 shows an exemplary embodiment of a winding nest configuration comprising a winding drum, a belt, and a rider roll.
Figure 2:
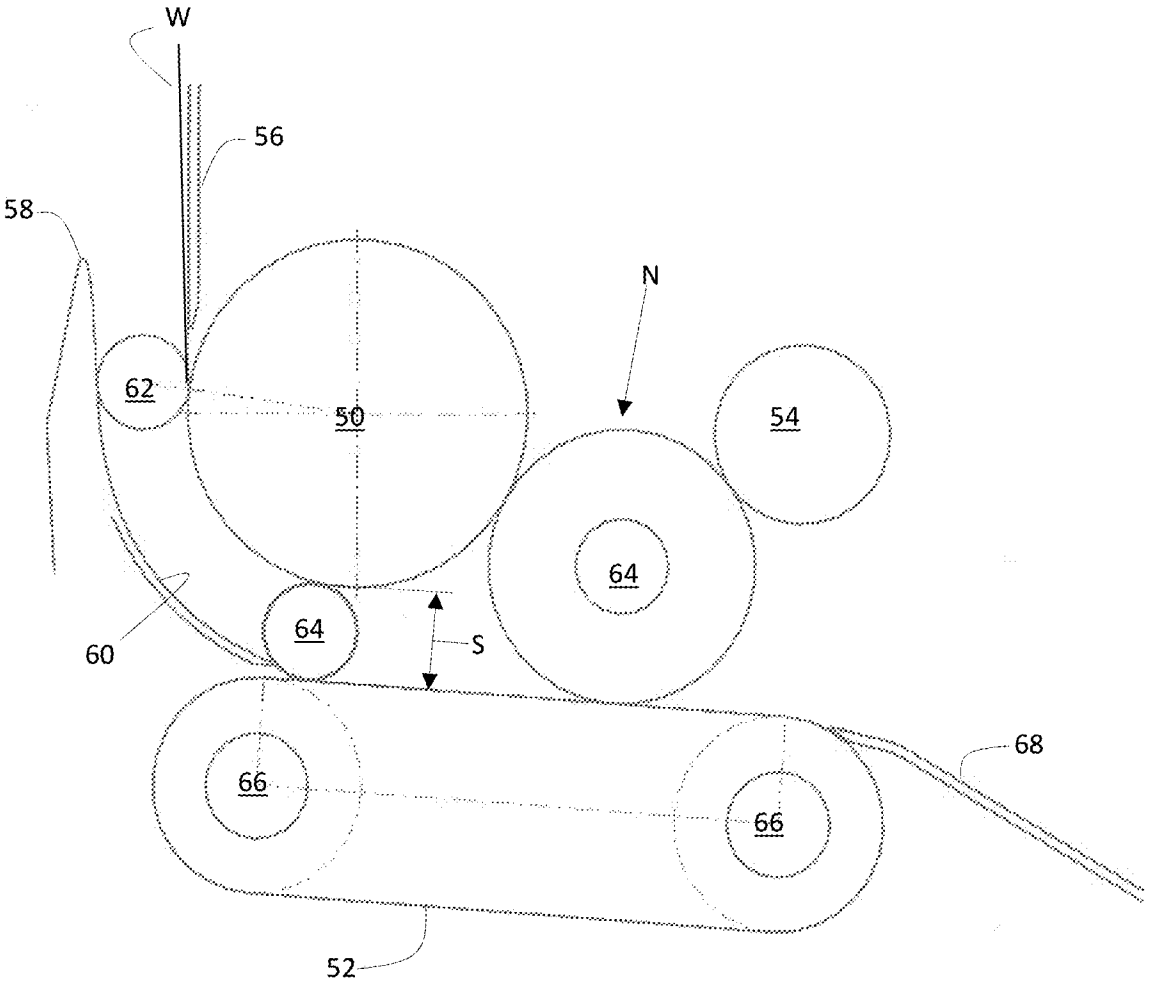
FIG. 2 illustrates the winding nest of FIG. 1.

FIGS. 1-6 show an exemplary embodiment of a winding nest N configuration comprising a winding drum 50, a belt 52, and a rider roll 54. The exemplary embodiment of FIGS. 1-6 may be used for product having a log diameter range of between 90 mm and 225 mm. The winding drum may have a diameter of 165 mm. The rider roll may have a diameter of 85 mm. The web W approaches the winding drum 50 from above and wraps around the drum to the web winding region. Thus, the winding drum 50 also directs and delivers the web to the log in the winding nest N. The winding drum 50 and the belt 52 form a space between through which a core 62 and web W (and core and web together winding log 64) pass into the winding nest configuration. The belt 52 is disposed around pulleys 66, at least one of which is driven, to cause the surface of the belt to move in the opposite direction as the surface of the upper winding drum 50 opposite of the belt across the space. The motion of the belt 52 in this direction causes the log 64, with the core 62, to rotate and wind the feeding web W around the log and thus increase its diameter. The web may be fed to the winding drum 50 with a flexible web feeding or conveying device.

Shown approximately vertical in the drawings is a pinch plate 56 that may be used to perform the web cut-off similar to the system shown in U.S. Pat. No. 6,056,229, the disclosure of which is incorporated by reference. While the drawings show the web W approaching the winding drum 50 generally vertically, the approach angle of the web to the winding drum 50 may be rightward or leftward of the generally vertical shown in the drawings. The pinch plate may be provided in a corresponding manner relative to the angle of approach of the web to the winding drum 50. Shown to the left and lower left of the winding drum are fingers 58 and a curved rolling surface 60 that may be used to guide a core 62 during web transfer and then guide the rolling log 64 to the winding region, similar to the system in U.S. Pat. No. 6,056,229. Other web severing mechanisms and/or web transferring mechanisms may be provided including systems disclosed in U.S. Pat. Nos. 5,538,199, 5,839,680, 5,979,818, 7,614,328, 5,150,848, 6,422,501, 6,945,491, 7,175,126, 7,175,127, 8,181,897, 9,586,779, EP 3148906, and other systems for severing the web on the winding drum with a movable blade or pinching pad and/or transferring the web vis-à-vis a longitudinal line or circumferential rings of glue or moisture, electro-static means, or a web tucking system. Although the description that follows describes a single belt, the description is not intended to be limiting in any sense and several parallel belts may be provided. Additionally, the term belt is not intended to be limiting, and may be viewed as a continuous flexible member arranged in an endless loop capable of being imparted with a velocity tangent to its surface, regardless of whatever material, materials, or construction techniques afford the function and properties described herein. Additionally, the term core or winding core is used to describe any center or inner structure about which the web material may be wound, including a tubular or solid mandrel, spindle, axle, shaft, cardboard core, nucleus of wound material, cores that are removed in operations subsequent to winding for making coreless products, for instance as shown in U.S. Pat. No. 9,284,147, etc. Further, the term "web" is intended to cover material in wide webs, narrow webs, single webs, and a plurality of webs (ribbons), whether slit or cut after unwinding, or derived from multiple unwinds.

When the core 62 is introduced by the inserter (not shown) for web transfer, it is guided into contact with the winding drum 50 by the transfer fingers 58, which are on the opposite side of the core inserting channel as the winding drum. When the core 62 contacts the winding drum 50, it very abruptly undergoes a step increase in its rotational velocity and is driven in rotation along the curved rolling surface 60 by the winding drum 50 toward the belt 52. The curved rolling surface 60 and winding drum 50 define the core inserting channel. The shape of the curved rolling surface 60 is generally concave with respect to the winding drum, and is spaced away from the winding drum at a distance slightly less than the diameter of the winding log, more preferably slightly less than the diameter of the core in the log, if the core is radially compliant and can radially flex as it rolls through the channel. Radial compression of the log, and more preferably also radial compression of the core, ensures positive rotation of the log as it is driven through the core inserting channel by the winding drum. As shown in FIG. 1, after the log 64 has traveled along the curved rolling surface 60, it contacts the belt 52 slightly before the narrowest point in the space S between the winding drum 50 and the belt 52 (e.g., the smallest gap dimension). As the rolling log 64 transitions off the rolling surface 60 and onto the belt 52, it very abruptly undergoes a step increase in its rotational velocity and reduction in its translational velocity, due to the fact that the curved rolling surface 60 has zero velocity and the belt 52 has a surface velocity in the opposite direction as the winding drum, feeding web, and inserted core. As shown in FIG. 1 the log 64 contacts the belt 52 slightly beyond the point where the belt surface curves around a pulley 66. In this position, the relative surface speed of the belt is less than the surface speed of the belt as it curves around the pulley 66, and provides a more consistent dynamic for winding and controlling the log 64 as it passes through the space between the winding drum and belt by avoiding a step change in belt surface velocity which may occur, due to its thickness, where the belt starts to curve around the pulley 66.

After the winding log 64 has been brought into contact with the belt 52 it must be advanced further through the space between the winding drum 50 and the belt 52 toward the winding nest N. This may be referred to as log introduction or log progression. It is understood that this is a critical phase in the winding cycle for control because the log is advancing very rapidly and increasing in diameter very rapidly. If properly controlled, the winding log 64 will decelerate both rotationally and translationally as it advances toward the winding nest N and remain in contact with both the winding drum and the belt during this transition. To bring the log 64 forward into the winding nest N, the belt 52 has a lower surface speed than the surface speed of the winding drum 50. The speed of the belt 52 may be varied through the product cycle according to a profile such that the log progresses into the winding nest N in a controlled fashion. Preferably the speed profile of the belt 52 is calculated as a function of the delivered web, log diameter, log position, or any combination thereof. The speed profile of the belt is calculated to advance the log 64 in a controlled fashion wherein contact of the log 64 is maintained with the winding drum 50 and the belt 52. During this introduction phase of the winding cycle the gap distance between the winding drum 50 and the belt 52 may be kept at a relatively constant dimension. In this case, the log advancement is controlled by the speed profile of the belt 52. Because the log first contacts the belt 52 slightly before the narrowest point in the space S between the winding drum 50 and the belt 52, and because the log is growing in diameter very rapidly at this time, the log may compress or deform radially as it passes forward through the narrowest point. This technique may be used to cause tight winding of the initial web wraps near the core through the elevated nip pressures. The level of tightness of winding at the start can be lowered by bringing the log into contact with the belt closer to and even at the narrowest point in the space S between the winding drum 50 and the belt 52. Depending upon the application, and especially applications at relatively higher speeds, where the incoming log has greater momentum, the belt surface speed may be operated faster so that the log does not skid through the nip, lose contact with the winding drum, and cease rotating. Thus, as the winding log is brought closer to the narrowest point in the space S between the winding drum 50 and the belt 52 for its initial contact, belt speed may be increased. Thus, belt speed and belt position relative to the winding drum may be changed as necessary based upon the application speed, size of the product, and desired firmness of the resultant log. Having the belt at a relatively fixed position relative to the winding drum may be more effective for tighter winding, which may be desired for certain firm and high firmness products.

When winding less firm and low firmness products tighter winding at the start is not desirable. To accommodate operational flexibility in this regard, a second degree of freedom may be added to the belt 52 so that the distance between the belt 52 and winding drum 50 may be varied through the product cycle according to a profile that allows the log to progress into the winding nest N in a controlled fashion without being radially compressed or deformed by passing through a narrow nip point. Preferably, the position profile of the belt 52 is calculated as a function of the delivered web, log diameter, log position, or any combination thereof. The position profile of the belt may be calculated to advance the log 64 in a controlled fashion wherein contact of the log 64 is maintained with the winding drum 50 and the belt 52. In this case, the log can be brought into contact with the belt farther from the narrowest point in the space S between the winding drum 50 and the belt 52 with greater control and without a tendency toward tight winding. In this case, the log advancement is controlled by the speed profile of the belt 52 and the position profile of the belt 52, which in combination afford greater control and winding quality for less firm and low firmness products.

As the winding log 64 continues to advance into the winding nest N and increase in diameter the speed of the belt 52 may continue to be increased. The winding log 64 has its greatest translational advancement velocity when it first contacts the belt 52, because the space between the winding drum 50 and the belt 52 diverges only slightly, does not diverge, or even slightly converges. As the winding log 64 advances farther and farther into the winding nest N, the surfaces of the winding drum 50 and the belt 52 diverge ever more greatly, and the log increases in diameter at an ever slower rate due to its increasing circumference. Therefore the surface speed of the belt 52 is relatively slower at the beginning of each cycle and is increased during the winding cycle to correctly control the log. Then, near the end of the winding cycle, the speed of the belt is slowed to cause the nearly finished log or finished log to discharge from the winding nest N. The slowing of the belt 52 causes the completed log 64 to roll rightward in the drawings, out of the winding nest N, on to a discharge surface 68 for further processing. This rightward travel preferably commences slightly before the web is severed for transfer to the next core, but it may commence at the same time the web is severed, or after the web is severed. A further purpose of slowing the belt 52 near the end of the winding cycle is to have the belt sufficiently decelerated to the correct velocity for controlling the next log 64 when it arrives at the belt 52 for introduction and advancement into the winding nest N. The start of the deceleration may be timed to cause a correct discharge of the finished or nearly finished log. The magnitude of the deceleration may be chosen to cause a correct introduction of the next log. The magnitude of the deceleration may be chosen to cause a correct discharge of the finished or nearly finished log and to cause a correct introduction of the next log.

Figure 7:
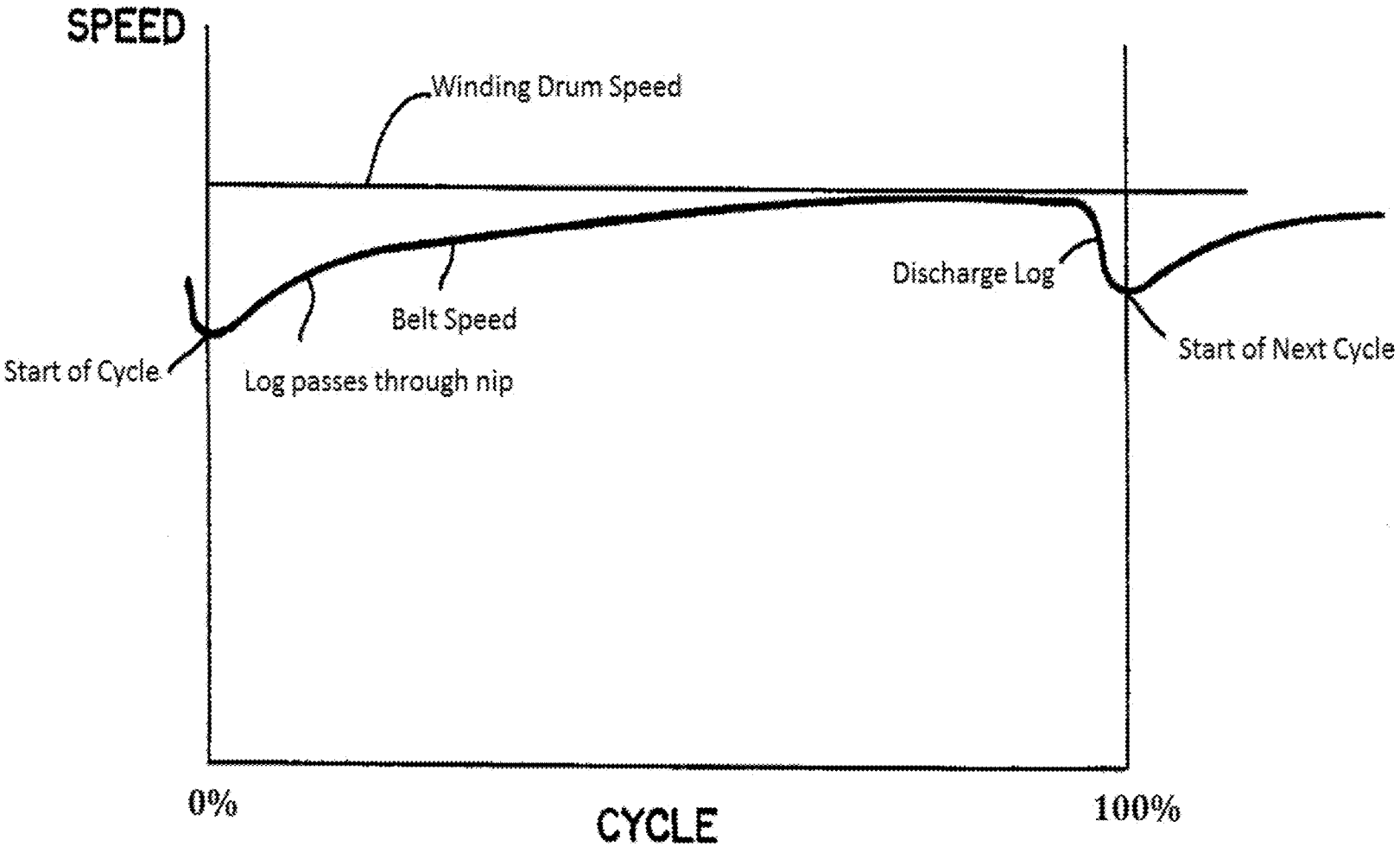
FIG. 7 illustrates an exemplary wind profile.

A control of the rewinder may establish a speed differential between the winding drum and the belt, which in turn controls the log progression through the nip between the winding drum and the belt. The surface speed of the belt may be at its lowest speed just before the arrival of the core/log so that the belt is increasing in speed when it is contacted by the core/log. The surface speed of the belt may be increased through the winding cycle as the growth of the log diameter and the geometry of the winding nest require a slower forward progression of the log. The surface speed of the belt may be relatively rapidly decreased near the end of the winding cycle, which in turn causes the log to start to advance more rapidly again for discharge. The control may store in memory a speed profile correlating belt speed over time, or belt speed versus wind cycle fraction, for the wind cycle. The belt speed profile may be executed as a position controlled motion. A speed profile may be executed as a position controlled motion by integrating a velocity profile. The belt speed profile may be preset (i.e., calculated and stored in a memory of the control of the rewinder) based on requested product parameters and then may be modified during the wind cycle, or between wind cycles, as needed. The belt speed profile may be preset for at least the intermediate phase of the winding cycle during which a preponderance of the log winding takes place. The belt speed profile may also be preset for the log introduction and/or log discharge phases. The belt speed profile may be calculated to account for log progression within the winding nest, increase of the log diameter during the winding, movement of the belt position, or any combination thereof. A calculated speed profile may be used that is based on the physics of the process to promote uniform winding, maximum diameter, and reduced vibration. FIG. 7 is a graph of an exemplary winding belt speed profile.

Figure 3:
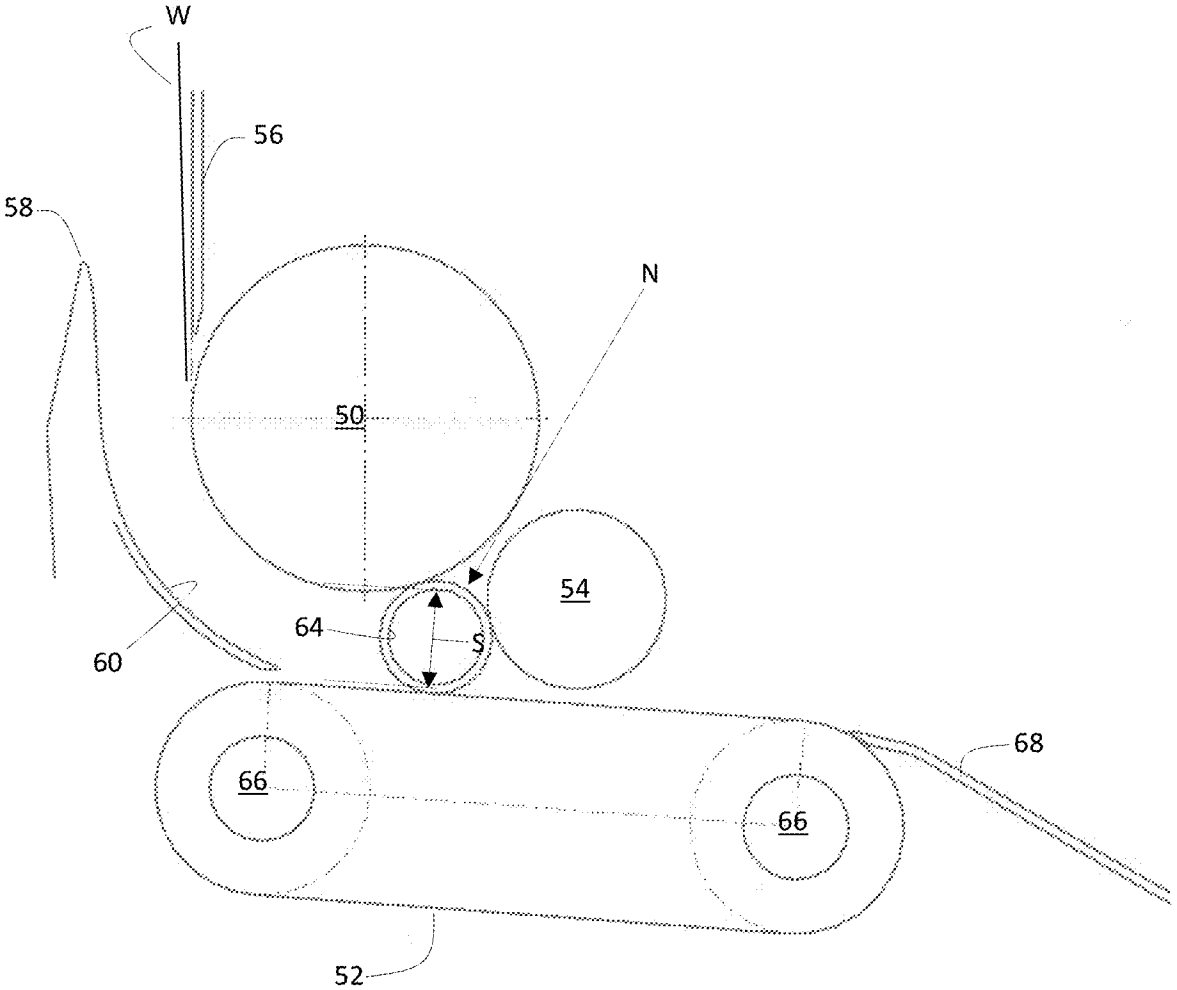
FIG. 3 illustrates the winding nest of FIG. 2 with the rider roll meeting an incoming log.
Figure 4:
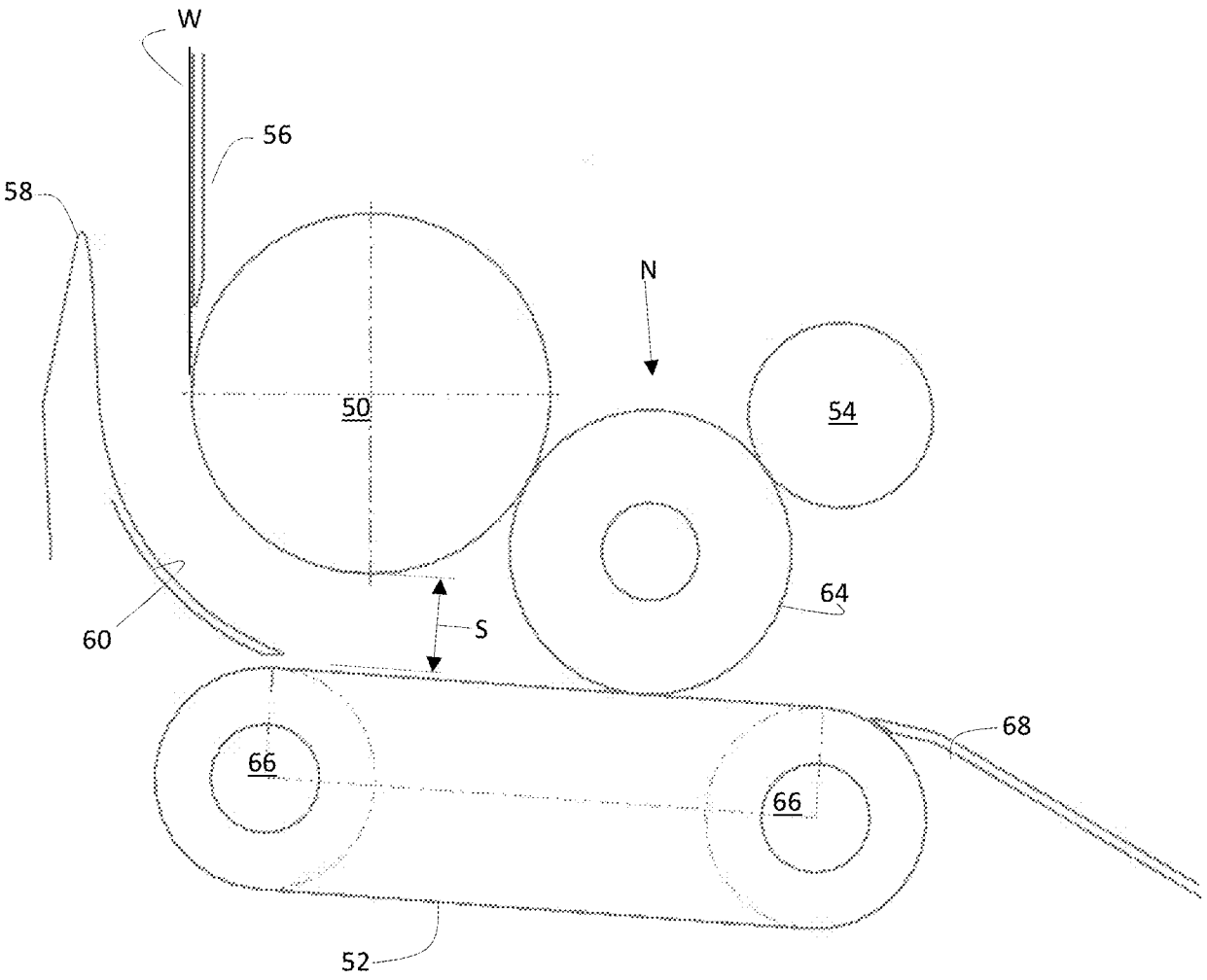
FIG. 4 illustrates the winding nest of FIG. 2 winding a 130 mm diameter log.
Figure 5:
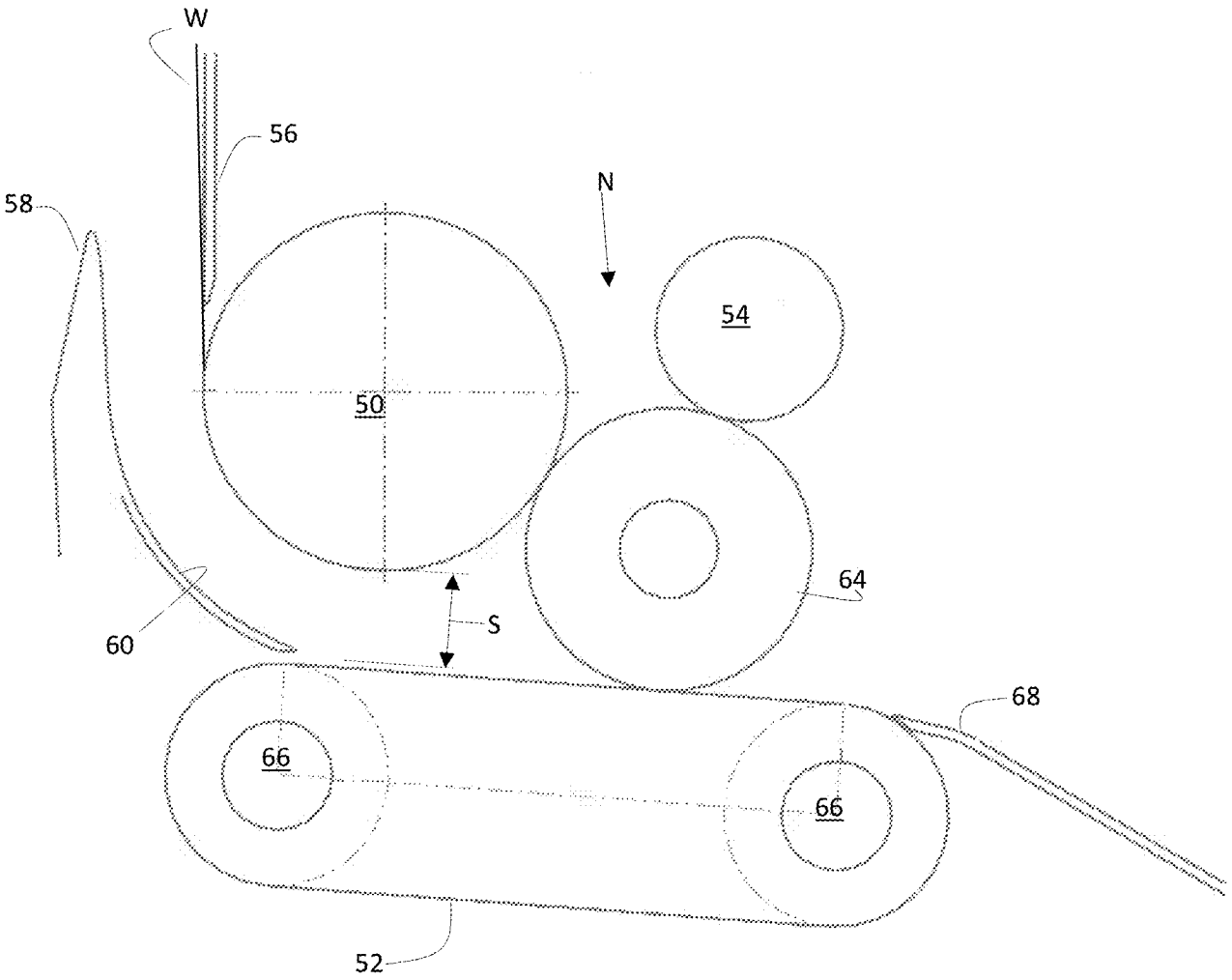
FIG. 5 illustrates the winding nest of FIG. 2 discharging a 130 mm diameter log.
Figure 6:
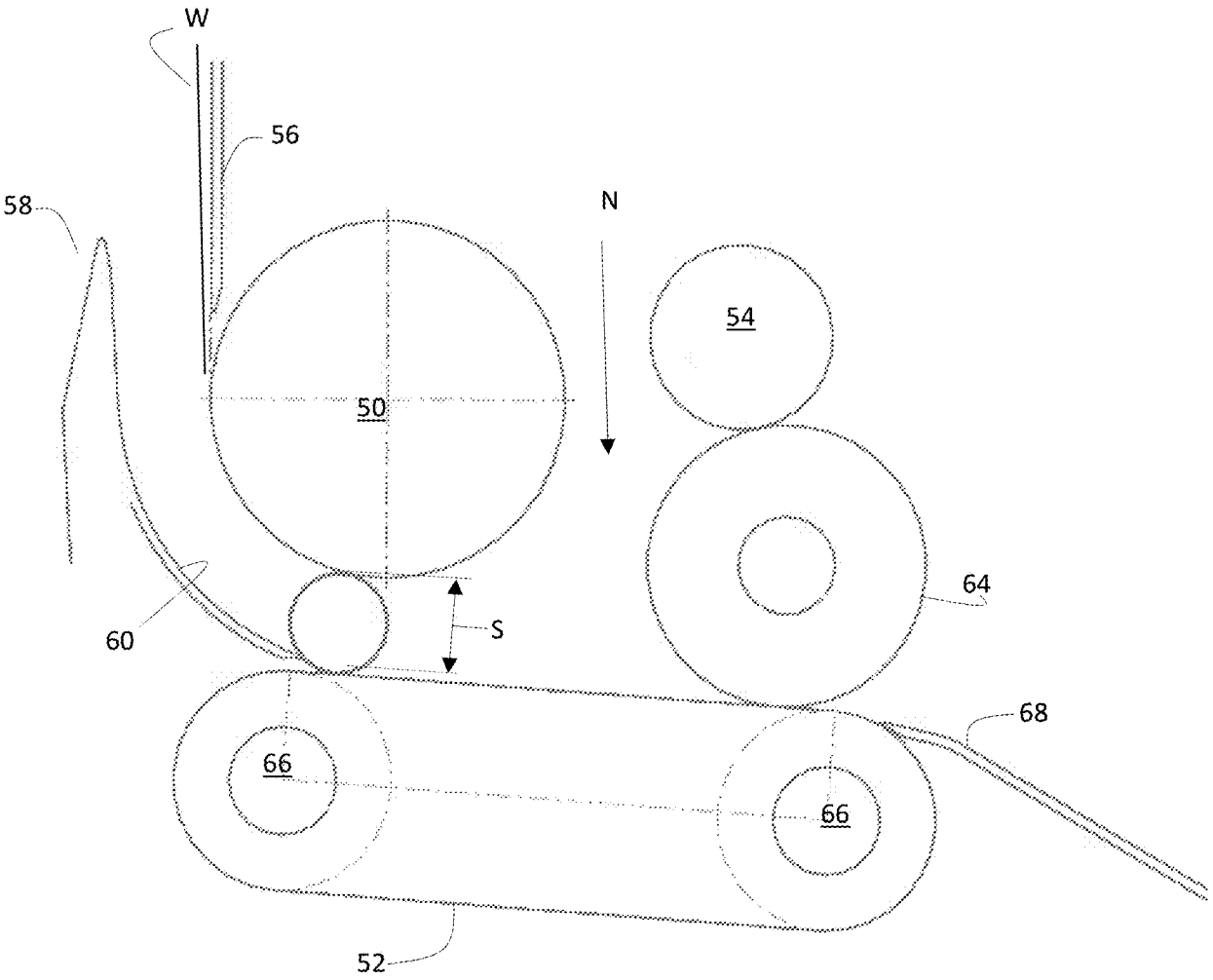
FIG. 6 illustrates the winding nest of FIG. 2 continuing to discharge a 130 mm diameter log.

FIG. 3 shows a rider roll 54 meeting an incoming log. FIG. 4 shows the rider roll 54 on the log during winding, at a position substantially equidistant from the winding drum 50 and belt 52. FIGS. 5 and 6 show the rider roll 54 at a higher positon on the log 64. The rider roll may be moved to a higher position to increase the space between the rider roll 54 and the belt 52 to allow a sufficient gap through which the discharging log can pass.

The rider roll 54 may be positioned in the winding nest N with a positioning mechanism 70 (FIG. 1). The positioning mechanism 70 may allow for compound motion, arcuate motion, linear reciprocating motion or any combination thereof through positioning motors and linkages. The positioning mechanism for the rider roll 54 preferably allows for compound motion so that the rider roll may maintain preferred log containment positions in the winding nest N during the preponderance of the log winding cycle. Near the end of the winding cycle, the rider roll positioning mechanism may move the rider roll 54 upward and nearer the top of the winding log 64 to afford an adequately large gap between the rider roll 54 and the belt 52 for the log to pass through to the discharge surface 68. The rider roll may have its surface speed increase during its upward movement around the log so its movement does not scuff or damage or wrinkle the log web wraps. The rider roll may have its surface speed increase at or near the end of the wind cycle to assist with accelerating the log for discharge. After the finished log 64 has moved clear of the rider roll 54 and the return path of the rider roll to the winding nest N, the rider roll may move down quickly to meet the next incoming log. The winding drum 50, belt 52, and the rider roll 54 provide three regions of contact at the log periphery for driving and controlling the winding log during the winding cycle. The rider roll speed profile and rider roll position motion profile may be calculated to account for log progression within the winding nest, increase of the log diameter during the winding, movement of the belt position, or any combination thereof.

The discharge surface 68 may be provided downstream from the end of the belt 52. The discharge surface 68 may include a table that has a starting position just beyond the point where the belt starts to curve around the rotatable pulley 66. If multiple parallel belts are used, the table may include fingers that interdigitate with the spacings between parallel belts. The fingers may extend beyond the curved portions of the belts, so that the log 64 transitions more gradually from the surfaces of the belts to the fingers of the discharge table. The discharge table fingers may have coordinated motion with the belt positioning mechanism, so a constant relationship is maintained between the fingers and belts. The discharge table fingers may be positionable independent of the belts, for instance, to recede beneath the belts at a position farther upstream in the winding nest for smaller diameter products and farther downstream in the winding nest for larger diameter products. The fingers may be positioned in order to set a desired distance over which the logs roll on the belts as they discharge. A discharge gate, or other device known in the art, may be provided downstream of the winding nest to capture a finished wound log, and/or control the timing of the exit of the finished wound log from the rewinder.

Without being limited to any theory, it is believed that a winding nest comprising a winding drum and belt, for instance as shown in FIGS. 1-6 (and in other figures to be discussed later), forms a winding nest that is favorable to run low firmness and large diameter, low log firmness logs at high speeds with less vibration. First, without being limited to any theory, it is believed the nip of the belt against the surface of a winding log has less potential to cause interlayer slip between the successive wraps of web within the rotating log than the nip of a drum against the surface of a winding log. It is believed that in a configuration where the winding nest is formed by upper and lower winding drums, contact pressure at the periphery of a winding log exerted by the upper and lower winding drums may induce interlayer slip within the log wherein the interior of the log phases forward with respect to the periphery of the log. Such a relative motion would have the effect of causing the log to wind tighter and smaller, which tends to be undesirable when winding low firmness, large diameter products. In such a configuration, it is believed that increasing contact pressure against the winding log exerted by the upper and lower winding drums may cause more interlayer slip while reduced contact pressure against the winding log periphery may cause less interlayer slip. Using a winding belt instead of a lower winding drum may significantly increase the area of the nip contact with the log, thereby reducing the nip pressure to reduce the interlayer slip. Also, without being limited to any theory, it is believed that in a configuration where the winding nest is formed by upper and lower winding drums, a low firmness log may have a concave indentation at its nips with the winding drums because low firmness logs can be readily deformed. This shape of indentation combined with the greater pressure of its smaller area of nip contact may penetrate deeper into the winding log and thus communicate with more layers of wrapped web, promoting interlayer slip. However, against a winding belt, it is believed that a low firmness log may have substantially flat, even possibly slightly convex, deformation. This shape of indentation may tend to penetrate less deep into the layers of wrapped web of the winding log and thereby reduce the interlayer slip. Thus, the geometry of the belt being flat, or slightly concave, with respect to the winding log, rather than convex as with a winding drum, may tend to reduce interlayer slip. Second, without being limited to any theory, it is believed the nip of the belt against the surface of a winding log has more potential to retain the caliper, or thickness, of the web being wound in the rotating log. As described above, using a winding belt instead of a drum may significantly increase the area of the nip contact with the log, and thereby reduce the nip pressure. Reduced nip pressure would reduce the tendency for the web material to thin by crushing the caliper or compressing the embossing. Retaining the thickness of the web material is advantageous when winding high bulk and low firmness products and low firmness large diameter products at higher speeds. To the extent a log is wound with vibration, the vibration energy may be absorbed or dispersed through the nip with the belt and may be spread over a larger contact area than would be the case with a winding drum, which may result in less tendency to produce an out of specification log.

The substantially flat, even possibly slightly convex, deformation of the log at its nip with the belt 52 may provide other advantages and may be enhanced by varying the characteristics or adjustments of the belts. The material on the surface of the belt may be compliant, and thus conform under the load of the log, increasing its contact area, and reducing the contact pressure and deformation on the log. The belt itself may be stretchable or elastic, and may extend under the load of the log, wrapping the log slightly, increasing its contact area, and thereby reducing the contact pressure and deformation on the log. The tension setting in the belt may also be varied to influence the contact pressure and deformation on the log. Additionally, the position of the belt under the winding log, where it bears a preponderance of the weight load of the log, may be advantageous over other configurations of winding nests or other possible positions of a winding belt with respect to the log.

In a surface rewinder winding nest, the log is supported at its periphery. In the case of a winding nest with just winding drums, the log weight load is supported by the drums, typically primarily a lower winding drum. In a winding nest with upper and lower winding drums, little can be done to cause a reduction of the pressure in the nip at the lower winding drum, because the weight of the log causes the pressure. However, given the shape of the belt 52 for reducing nip pressure, as described above, the same log weight may be supported with less nip pressure, as compared to a lower winding drum. Therefore, positioning the belt under the log, where it may support a preponderance of the weight of the log, may be especially beneficial for larger diameter, low firmness logs, which add weight load as they increase in size, and thus encounter rising nip forces through the wind cycle.

A belt could be utilized on any side of the winding log, but under the log is the most effective location partly because the weight load of the log is unavoidable. When winding low firmness logs in a 3-drum surface rewinder efforts can be made to reduce the nip pressures at the upper winding drum and the rider roll (though not as effectively as with a belt system, as is described in the next paragraphs of the disclosure), but little can be done about the weight of the log on the lower drum, and the nip there would typically have the greatest pressure, and its nip pressure would increase as the diameter of the log increases. So under the log is the most favorable position for the belt to alleviate a nip pressure. The arrangement may also be advantageous with processing of structured and/or textured webs (e.g., NTT, QRT, etc.), or specialized embossing in the web, during the wind cycle, because the lower contact pressure in the nip of the belt configuration compared to a configuration with a winding drum may tend to reduce thinning of the web material from crushing or compressing its structure or texture or its embossing. A reduced magnitude of radial deformation of the log in its nip with the belt, compared to a nip with a winding drum, may also induce less strain in the web wraps as they pass through the nip, which may help preserve the thickness of structured web and prevent elongation of the structured web. This in turn may reduce the potential for the structured web to reach a strain threshold beyond which a significant portion of the thickness of the structured web does not return to its nominal thickness when the tension load is removed or reduced.

As described above, without being limited to any theory, it is believed that reducing the nip pressure on a winding log may reduce interlayer slip within the log, and thereby facilitate winding low firmness and low firmness large diameter logs at higher speeds without excessive vibration, or with less vibration. Thus, it is believed that a benefit may be derived by reducing the pressure at all nips with the winding log, including at the winding drum and any rider rolls. A further advantage in using a belt beneath the winding log, and having it nearly or substantially horizontal, such as inclined from horizontal by less than 15° (more preferably by less than 11°, and more preferably by less than 7°) is that in this configuration it may allow for lower nip pressures between the log and the winding drum and the rider roll(s). It can be seen that the winding drum 50 bears substantially none of the weight of the log, so the surface speed of the belt 52 can be used to adjust the nip pressure independent of the log weight. Increasing the belt speed may increase the contact pressure at the nip between the log and the winding drum. Decreasing the belt speed may reduce, minimize, or even eliminate, the contact pressure at the nip between the log and the winding drum. It can be seen that if the inclination of the belt is zero degrees the rider roll also bears substantially none of the weight of the log, and if the inclination is a small angle, the rider roll may bear only a small fraction of the weight of the log. Decreasing the belt speed may increase the contact pressure at the nip between the log and the rider roll. Increasing the belt speed may reduce, minimize, or even eliminate, the contact pressure at the nip between the log and the rider roll. Optimizing the speed and position of the belt and the position of the rider roll may result in reduced, minimized, or even eliminated contact pressures at the nips between the winding drum and log and the rider roll(s) and log.

The belt 52 may be provided with a belt positioning mechanism (FIGS. 38-39, '130') so the angle of the belt and the spacing S of the belt relative to the winding drum 50 and rider roll 54 may be adjusted in accordance for a particular log 64 product based upon web material properties, core diameter, and finished log diameter. The belt may be positioned as needed to minimize the contact pressure at the nip points between the winding drum and the log, the belt and the log, and the rider roll(s) and the log. This tends to be advantageous to maximize wound log diameter. Further, the contact pressure between the winding drum 50 and the log 64, the belt 52 and the log, and the rider roll and the log, may be increased or decreased by adjusting the general position of the belt with the belt positioning mechanism, or by adjusting the relative angle of the belt from generally horizontal to more or less inclined. The position of the belt during the winding cycle allows different diameter products to be wound with reduced or minimized or optimized nip pressure during the entire winding cycle. In an upper and lower winding drum configuration, by contrast, logs typically must climb upward on the lower winding drum as they enter the winding nest. Thus early in the winding cycle the log tends to "lean" against the upper drum and the nip pressure may be greater than desired. If it is a large diameter log it will continue to advance as it grows in diameter until it is at top dead center on the lower drum, where it is briefly balanced between the upper drum and the rider roll. When it grows larger it passes across top dead center and starts to "lean" against the rider roll as it has a downward trajectory and the nip pressure may be greater than desired.

Without being limited to any theory, it is believed that a winding nest comprising a winding drum and belt, for instance as shown in FIGS. 1-6 (and in other figures to be discussed later), forms a winding nest that is favorable for improved control of the log during introduction into the winding nest N. As discussed above, the incoming log must be decelerated under good control through the space between the winding drum 50 and the belt 52 to be brought into the winding nest efficiently and reliably. It is believed that if the log deceleration is executed over a greater distance of log translation, then the acceleration magnitude may be reduced, which may in turn make the critical phase of log introduction to the winding nest better able to accommodate variations in the properties of the incoming web material, and machine operating conditions. It is believed that reduced acceleration magnitude may be less disruptive to the windings in the log, because less pressure is required in the nip between the winding drum and belt to control the log, which may better preserve the thickness of the web and avoid tighter windings in the log at the start of the cycle. A winding nest with a winding drum and a belt may be configured to have a translational distance sufficient for decelerating the log during introduction to the winding nest N. Generally speaking, the surfaces of two opposing drums diverge more rapidly as an object passes through the space between them compared to the surfaces of a drum and an opposing belt if the belt surface is substantially a flat plane. When a log 64 comes off the rolling surface 60 onto the belt 52 it has rotational and translational velocity. As explained above, as the rolling log 64 transitions off the rolling surface 60 and onto the belt 52, it very abruptly undergoes a step increase in its rotational velocity and reduction in its translational velocity, due to the fact that the curved rolling surface 60 has zero velocity and the belt 52 has a surface velocity in the opposite direction as the winding drum, feeding web, and inserted core. However, a more gradual divergence between the belt 52 and winding drum 50 requires the log to travel more rapidly through the space, so the surface speed of the belt may slow to a greater degree, and the magnitude of the abrupt velocity changes the log 64 experiences as it transitions onto the belt 52 may be reduced. Then, as the log passes through this space toward the winding nest N, a more gradual divergence between the belt 52 and winding drum 50 provides a greater distance and time to accomplish the introduction deceleration, which may afford a better and simpler control during the winding cycle. The positioning mechanism of the belt 52 during the initial portion of the wind cycle and the deceleration of the log as it enters the winding nest N may also tend to produce a uniform wind that does not have a tightly wound ring of web material W around the core 62 at the start of the wind cycle.

The belt 52 may be of unitary construction, or consist of at least two portions: (i) a log contact side that engages the log, and (ii) a pulley contact side that engages a pulley that drives the belt. The log contact side of the belt may have a covering layer. The log contact side of the belt is preferably wear resistant and has a high traction and/or high grip characteristic. The log contact side of the belt may comprise a rubber or elastomer type of material with high grip characteristics. The log contact side of the belt may comprise a rough surface with high traction characteristics. The log contact side of the belt may be changed or modified to have more or less grip or traction. A covering layer of the belt may be softer or harder, thicker or thinner, more or less compliant, depending upon the application, to provide desired characteristics for the interaction of the belt and the winding log. Surface textures may be imposed or deployed on the log contact side of the belt by casting, imprinting, machining, laser engraving, implanting, etc. Protrusions or embossments may be utilized on the log contact side of the belt. A high traction and/or grip characteristic on the log contact side of the belt is preferable to afford control of the winding log at its nip with the belt in the introduction, winding, and discharge phases even with minimal or minimized or low contact pressure at the nip. The pulley contact side of the belt may have a high traction and/or high grip characteristic, to reduce or minimize or eliminate slipping of the belt on the drive pulley during its acceleration and deceleration phases of the cycle. The pulley contact side of the belt may have an array of teeth which engage grooves in the pulleys to reduce or minimize or eliminate slipping of the belt on the pulley during its acceleration and deceleration phases of the cycle. The belt may have internal cords, as is known in the art, to increase its resistance to changing in length, so it remains substantially at a constant length during operation, including during its acceleration and deceleration phases of the winding cycle.

The tension in the belt 52 may be adjusted higher or lower depending upon the application to provide desired winding dynamics and interaction of the belt and the winding log. In one embodiment, tension in the belt 52 may be modified during the winding cycle as part of a winding profile, or based on sensors or other feedback measurements, in order to increase or reduce nip pressure, increase or reduce web elongation, reduce the log vibration, or alter other system characteristics. The tension may be changed in the belt 52 by moving one of the two pulleys 66 shown relative to the other, or by using a movable third pulley or movable sliding shoe (not shown) that acts against a span of the belt (e.g., the lower span) to alter the tension in the belt.

As mentioned earlier, rather than a single belt, a plurality of parallel spaced apart belts may be provided. For instance, each belt in the plurality of belts may be about 100 mm wide or up to about 500 mm wide or wider with a spacing or gap of about 25 mm between the belts. The rolling surface 60 from the infeed fingers 58 to the belts may be a contiguous surface or may comprise discrete fingers with spacing between the fingers. The fingers 58 may terminate short of the belt surface, or may project past the belt surface and interdigitate with the gaps of the parallel and spaced apart belts. Each of the belts in the plurality of belts may be independently adjustable to accommodate any variation between the belts. A tensioner, movable third pulley, or sliding shoe may be used in connection with each belt to provide an adjustment to ensure proper tension. The plurality of belts may be driven with one pulley or each belt may have a dedicated pulley.

Figure 8:
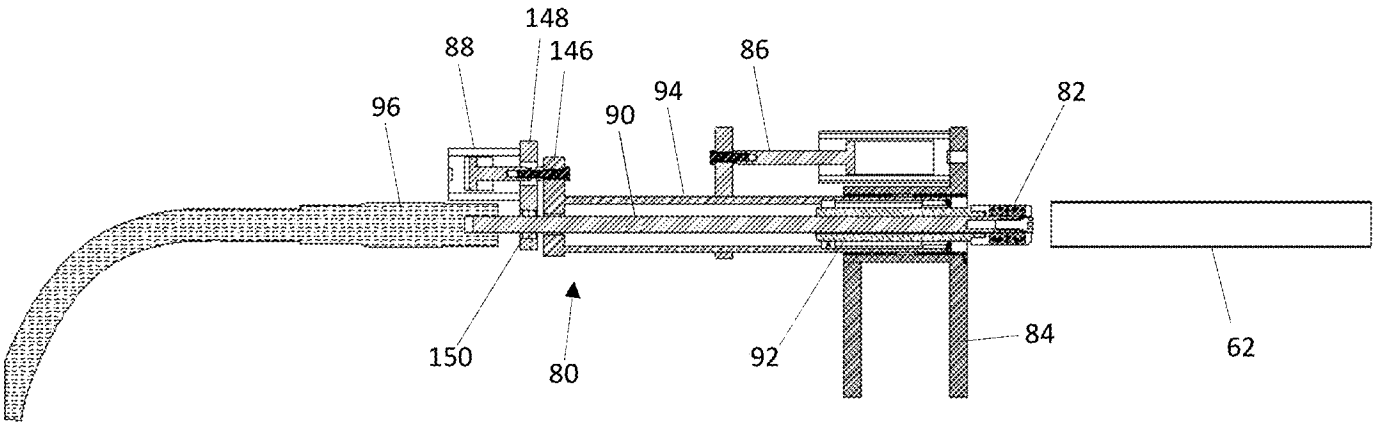
FIG. 8 illustrates an exemplary core end engagement assembly prior to engaging a core.
Figure 9:
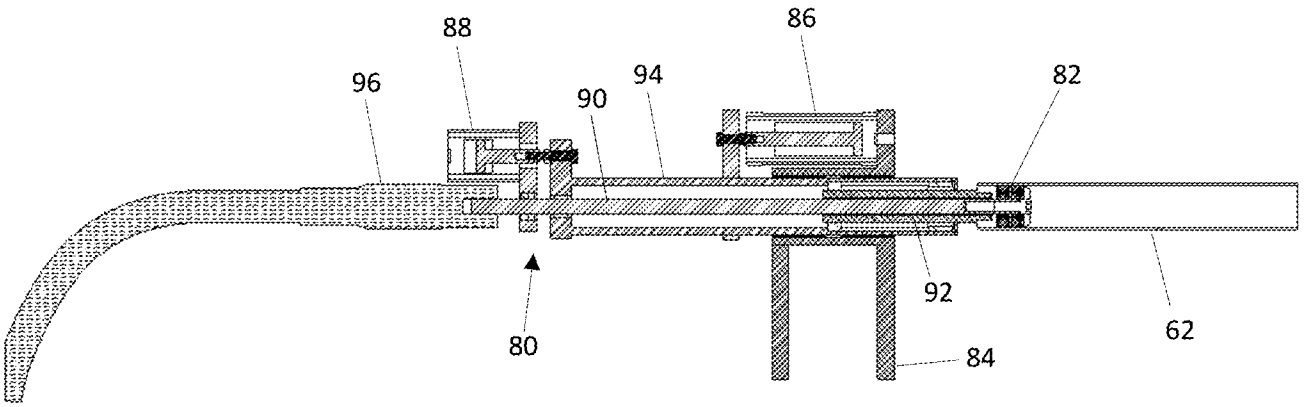
FIG. 9 illustrates the core end engagement assembly of FIG. 8 engaging the core.

As shown in FIGS. 8-9, a core end engagement assembly 80 may be provided to engage and, depending on the application, rotationally drive the core during the winding cycle. A core end engagement assembly 80 may be provided with a core chuck 82 to engage with one end of the core 62. A second core end engagement assembly axially opposite of the core 62 may also be provided. The second core end engagement assembly may also include a second chuck 82 to engage with the axially opposite end of the core 62. The chuck 82 may engage an end face of the core or inner diameter surface of the core or both. The core 62 may be rotationally driven by the chuck 82 of one or both of the core end engagement assemblies 80. The chuck 82 preferably engages the core 62 after the web has been transferred to the core. The chuck preferably engages the core 62 after the log has transitioned from the rolling surface 60 onto the belt 52 and therefore has relatively reduced translational velocity, compared to when rolling along the rolling surface 60. The chuck 82 may engage the core 62 after the log has passed through the narrowest point in the space S between the winding drum 50 and belt 52. The chuck 82 may engage the core before the log contacts the rider roll 54, when the log contacts the rider roll, or after the log is in contact with the rider roll. The chuck may engage the core when the log is in contact with the winding drum 50, belt 52, and a rider roll 54.

Each chuck 82 may be positioned in the winding nest N with a positioning mechanism 84. The chuck positioning mechanism 84 may allow for compound motion, arcuate motion, linear reciprocating motion or any combination thereof. Preferably, the chuck positioning mechanism 84 may operate with compound motion so it can match the center of the winding log, as the log increases in diameter, and the log center traces a nonlinear path. The chuck 82 may disengage before log discharge, and may disengage before the web is severed for the next transfer. The chucks 82 may reciprocate parallel to the core central axis for engagement to and disengagement from the core 62. The core end engagement assembly 80 may include a pneumatic, hydraulic, electronic or mechanical actuator 86 that allows the chucks 82 to reciprocate substantially in alignment with the core central axis for insertion into and withdrawal from the hollow ends of the core 62. The core end engagement assembly 80 may also have a pneumatic, hydraulic, electronic or mechanical actuator 88 that enables the chuck 82 to expand radially outward to engage the inner diameter surface of the core 62. For instance, as shown in FIGS. 8 and 9, the actuator 88 linearly moves a control rod 90 which in turn moves the chuck 82 between engaged and disengaged positions relative to the inner diameter surfaces of the core 62. The control rod 90 may be slidingly disposed in a support shaft 92 with sleeve bearings located on axial ends of the support shaft. The support shaft 92 may be rotatably mounted in a drive housing 94 with roller bearings that allow the support shaft 92 to rotate with respect to the drive housing 94, and restrain the support shaft from moving axially with respect the drive housing 94. The drive housing 94 may be attached to the core end engagement assembly positioning mechanism 84. The drive housing 94 may be mounted in plain bearings in a frame arm of the core end engagement assembly positioning mechanism 84, which allows the drive housing to be moved axially with respect to the frame arm. The drive housing may be guided axially so the drive housing can only move axially and cannot rotate with respect to the frame arm.

Prior to engaging the core 62, the chucks 82 may rotate to a speed matching the rotational speed of the core. A motor (not shown) coupled to a flexible drive shaft 96 may rotationally drive the chuck 82. The flexible drive shaft 96 may be coupled to the control rod 90 adjacent the actuator 88 at an axial end of the drive housing 94. The chucks 82 may rotate freely at the speed of the rotating log. Accordingly, the chucks may be idling chucks. The chucks 82 may also, or in the alternative, tend to impart a slight braking action against the log during at least part of the wind cycle. The braking action may be provided via a mechanical or magnetic clutch-type mechanism and/or via the motor.

After engaging the core 62, the chucks 82 may move axially away from each other, thereby developing an axial tension force in the core. Applying an axial tension force to the core may reduce, minimize, or delay vibration of a winding log, particularly if winding a lower firmness log and/or operating at a higher winding speed. After engaging a tubular winding core, the inner diameter surface of the core may be pneumatically pressurized through one or both of the chucks 82. The internal pneumatic pressure may be used to develop an axial tension force in the core. The core chucks may be used to control the winding of the log by opposing vibration, instability, telescoping, or any other unplanned or erratic movements during the winding cycle. The core chucks may be used to control interlayer slip within the log. The core chucks may be used to oppose interlayer slip. Without being limited to any theory, it is believed that opposing forward-phasing interlayer slip can be advantageous when winding web material into loosely wound rolls and/or low firmness rolls. It is believed that the core chucks may oppose forward-phasing interlayer slip by applying torque to the core in the direction opposite to the direction of rotation of the log. The core chucks may be used to promote interlayer slip. Without being limited to any theory, it is believed that promoting forward-phasing interlayer slip can be advantageous when winding web material into tightly wound rolls and/or high firmness rolls. It is believed that the core chucks may promote forward-phasing interlayer slip by applying torque to the core in the same direction as the direction of rotation of the log.

Each core chuck 82 is preferably driven in rotation by the motor (not shown) which has position and/or velocity feedback. A control of the rewinder may establish a speed profile for the core chuck 82. This speed profile may be relative to the winding drum speed, web feeding speed, and/or speed of the winding belt. The rotational speed of the chucks 82 may be relatively faster early in the wind cycle, when the log diameter is relatively smaller, and relatively slower later in the wind cycle, when the log diameter is relatively larger. The rotational speed of the chucks may be decreased through the winding cycle as the growth of the log diameter requires a slower rotation of the log center. The control may store in memory a speed profile correlating chuck speed over time, or chuck speed versus wind cycle fraction, for the wind cycle. The chuck speed profile may be executed as a position controlled motion. A speed profile may be executed as a position controlled motion by integrating a velocity profile. The chuck speed profile may be preset (i.e., calculated and stored in a memory of the control of the rewinder) based on requested product parameters and then may be modified during the wind cycle, or between wind cycles, as needed. The chuck speed profile may be preset for at least the intermediate phase of the wind cycle during which a preponderance of the log winding takes place. The chuck speed profile may also be preset for the return phase, wherein the chucks travel from their position at the end of winding a finished log to their position for engagement to the core of a subsequent log. During this return motion phase the chucks may increase in speed from a slower speed near the end of the cycle to a faster speed nearer the beginning of the cycle. The chuck speed profile during the winding phase may be calculated to account for log progression within the winding nest, increase of the log diameter during the winding, movement of the belt position, or any combination thereof. Calculated speed profiles that are based on the physics of the process can promote uniform winding, maximum diameter, and reduced vibration by eliminating the erratic slipping that typically occurs with approximated profiles that are created manually by operators or technicians, or with motion equations not tied to the physics of the process. The chuck speed profile may substantially match the rotational speed that theory suggests the winding core should have for the case of zero interlayer slip. The chucks may be caused to rotate faster for at least part of the cycle, causing a log to wind tighter. The chucks may be caused to rotate slower for at least part of the cycle, causing a log to wind looser. Offsetting, scaling, stretching, and/or other manipulations of this profile may be used to produce a speed profile wherein the chucks rotate faster or slower for at least part of the cycle.

Each core chuck positioning mechanism 84 may position the core end engagement assembly 80 in the winding nest N by a motor, or motors, which have position feedback. A control of the rewinder may establish a position profile for the core chuck. This position profile may be relative to the winding drum, winding belt, and/or rider roll(s). The control may store in memory a position profile correlating chuck position over time, or chuck position versus wind cycle fraction, for the wind cycle. The chuck position profile may be executed as a position controlled motion. The chuck position profile may be preset (i.e., calculated and stored in a memory of the control of the rewinder) based on requested product parameters and then may be modified during the wind cycle, or between wind cycles, as needed. The chuck position profile may be preset for at least the intermediate phase of the wind cycle during which a preponderance of the log winding takes place. The chuck position profile may also be preset for the return phase, wherein the chucks travel from their position at the end of winding a finished log to their position for engagement to the core of a subsequent log. The chuck position profile during the winding phase may be calculated to account for log progression within the winding nest, increase of the log diameter during the winding, movement of the belt position, or any combination thereof. The chuck position profile may substantially match the positions that theory suggests the winding core should have for the case of a circular log. Offsetting, scaling, stretching, and/or other manipulations of this profile may be used to produce a chuck position profile that takes into account deformation of the log by the winding elements, such as at the belt due to the weight of the log and/or due to pressure from the rider roll(s); and/or to affect the nip pressures of the log against the winding elements; or to produce any desired chuck position profile that differs from the set profile associated with the application.

Though speeds, motions, and positions of the winding elements are disclosed as preferably being calculated based on the machine geometry and physics of the winding process, this does not preclude manual or automated adjustments based on observation and/or feedback signals. For example, the core chuck speed may be adjusted based on a measurement of the core or log rotational speed. For example, the core chuck position may be adjusted based on a measurement of the core or log position. Any winding parameters and any speed, motion, and position profiles including the belt speed, belt position, rider roll speed, rider roll position, core chuck speed, core chuck position, and the web tension may be adjusted, refined, shifted, offset, stretched, or manipulated by an operator based on visual observation, product measurements, substrate measurements, or process measurements, or by the rewinder control system, based on sensor feedback or operator input. The observations, measurements, feedback, and data may include, and are not limited to, caliper of the incoming web material, machine direction tensile modulus of the incoming web material, z-direction modulus of the incoming web material, tension and changes in tension of the incoming web material, the diameter and/or firmness of wound logs, vibration of logs during winding, caliper of web measured in finished logs, comparison of measured properties in the web before winding and after winding, and comparison of a measured web caliper value to a calculated web caliper value for a roll. The calculated average caliper for a wound roll product may be obtained with the following equation, where the area of the cross-section of a roll is divided by the length of the web material wound into the roll.

$$C = \frac{\pi}{4} * \frac{(D^2 - d^2)}{L}$$

In this equation c is the average caliper for a wound product, D is the finished diameter at the periphery of the roll, d is the diameter at the start of the web windings, which is typically the outside diameter of a winding core, and L is the machine direction length of the web that is wound into the roll.

FIGS. 10-16A and 16B show another embodiment of a winding nest configuration. It is similar in layout and function to that shown in FIGS. 1-6 so the same reference characters are used to identify like components. In the embodiment shown in FIGS. 10-16A and 16B two rider rolls 54A,54B are provided instead of one. The rider rolls 54A, 54B may use the same positioning mechanism, and such a positioning mechanism may provide compound motion, arcuate motion, linear reciprocating motion or any combination thereof. In the alternative, a separate positioning mechanism 70,72 (FIG. 10) for each rider roll may be provided. In connection therewith, in one example, the rider roll 54A may have simple arcuate motion centered about the center of the winding drum 50 with its positioning system 72, and the rider roll 54B may have compound motion with its own dedicated positioning mechanism 70.

Figure 11:
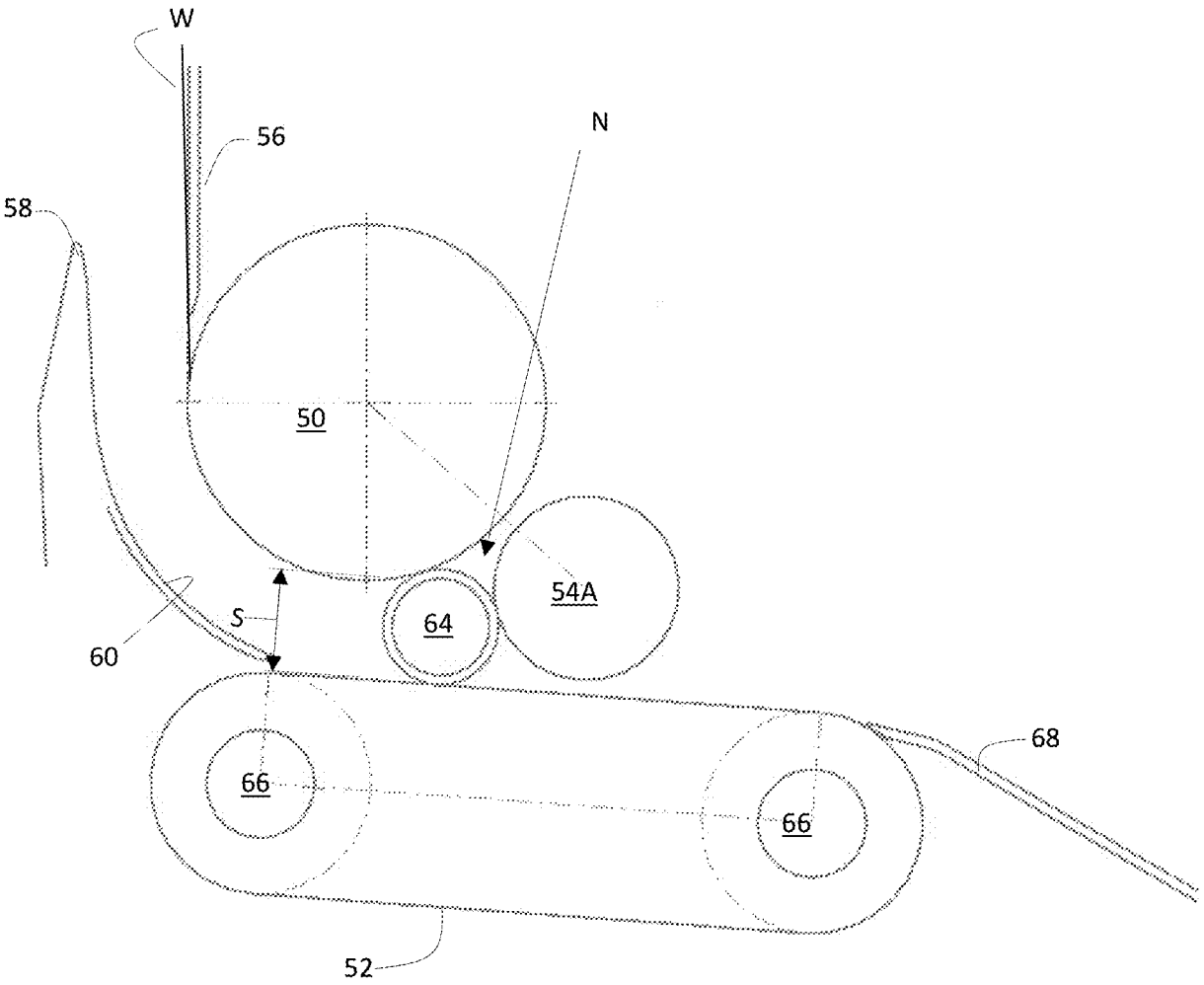
FIG. 11 illustrates the winding nest of FIG. 10 with the rider roll meeting an incoming log, and the second, further rider roll not shown for purposes of clarity.
Figure 12:
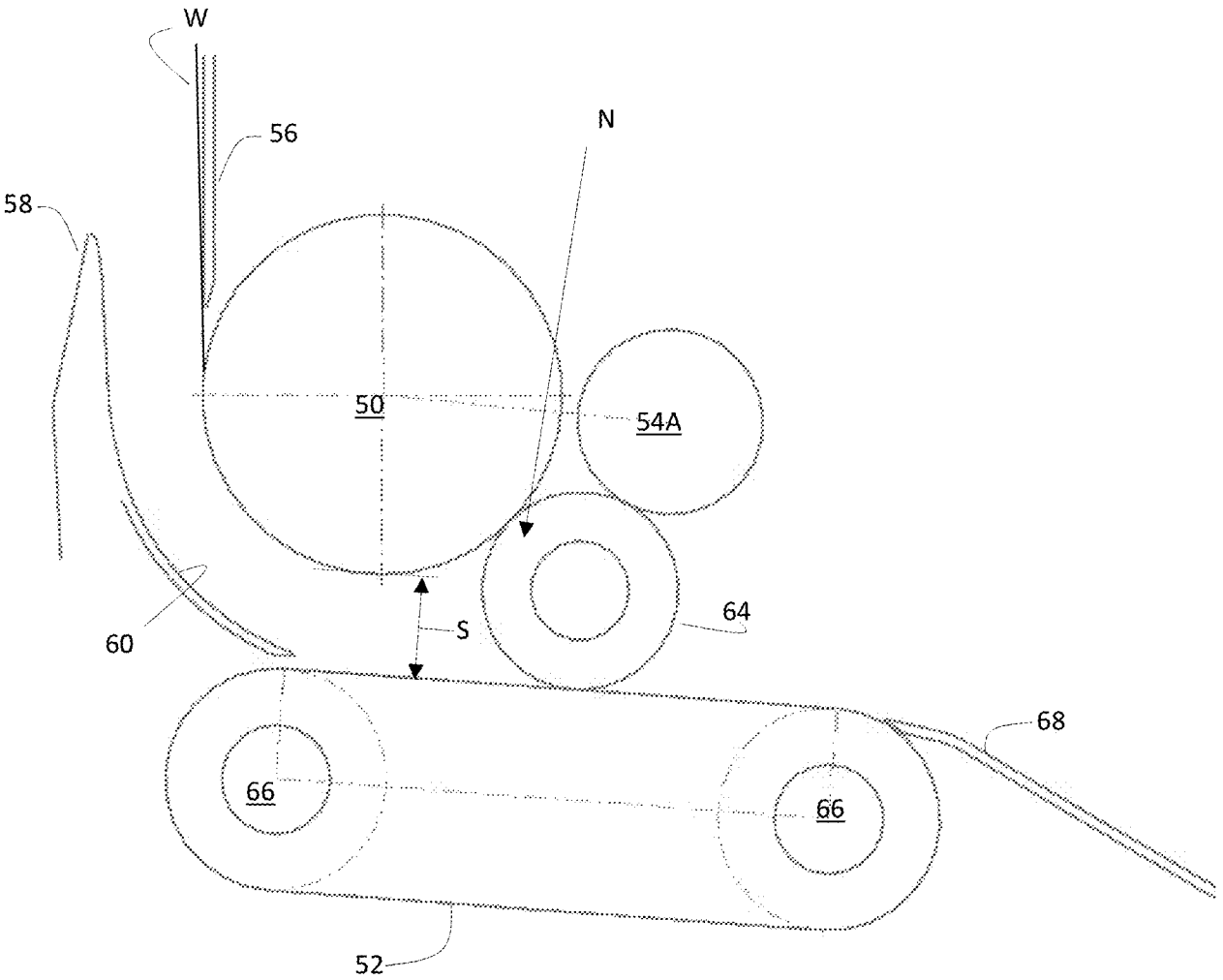
FIG. 12 illustrates the winding nest of FIG. 10 with the rider roll contacting a 90 mm diameter log, and the second, further rider roll not shown for purposes of clarity.
Figure 13:
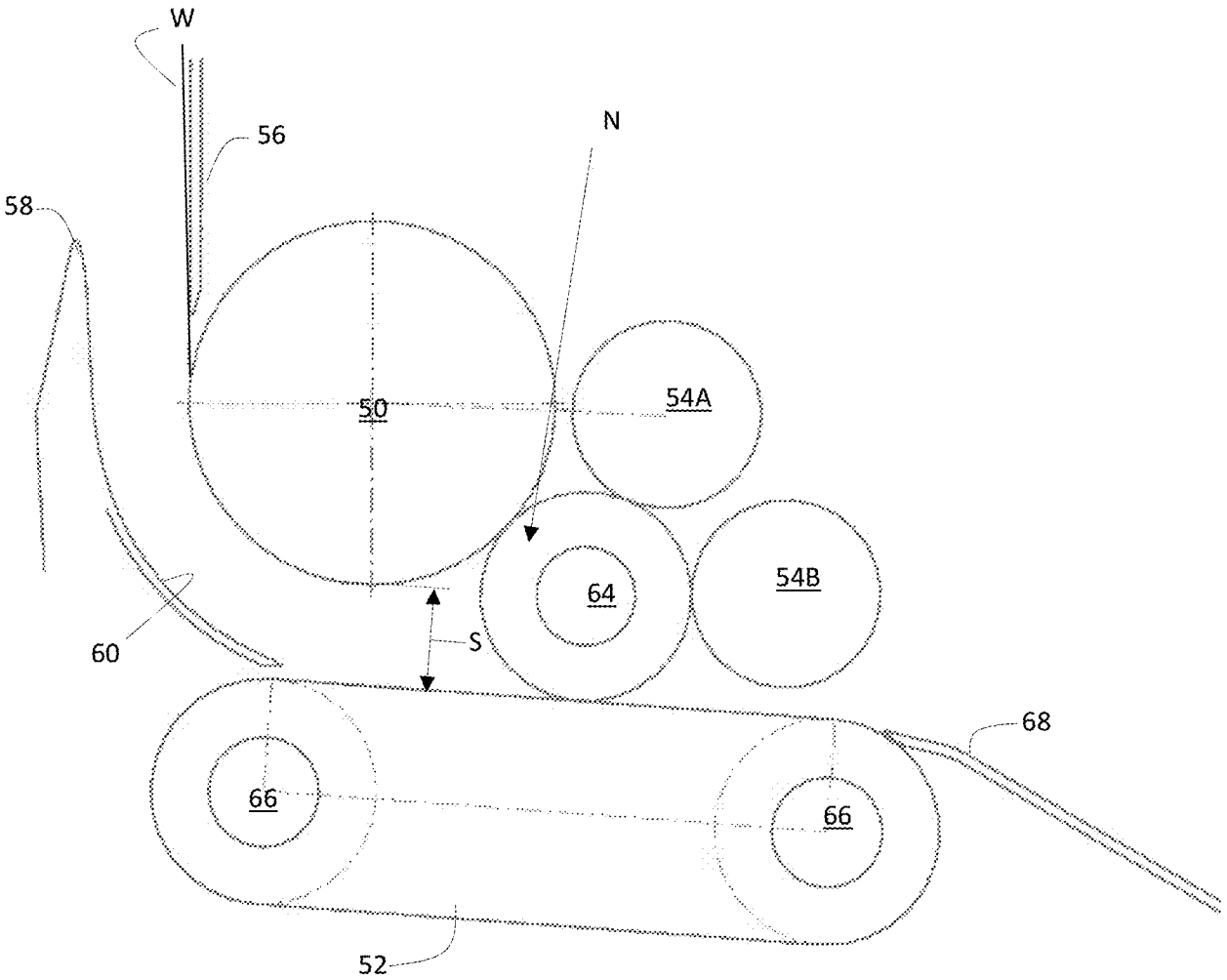
FIG. 13 illustrates the winding nest of FIG. 10 with both rider rolls contacting a 95 mm diameter log.
Figure 14:
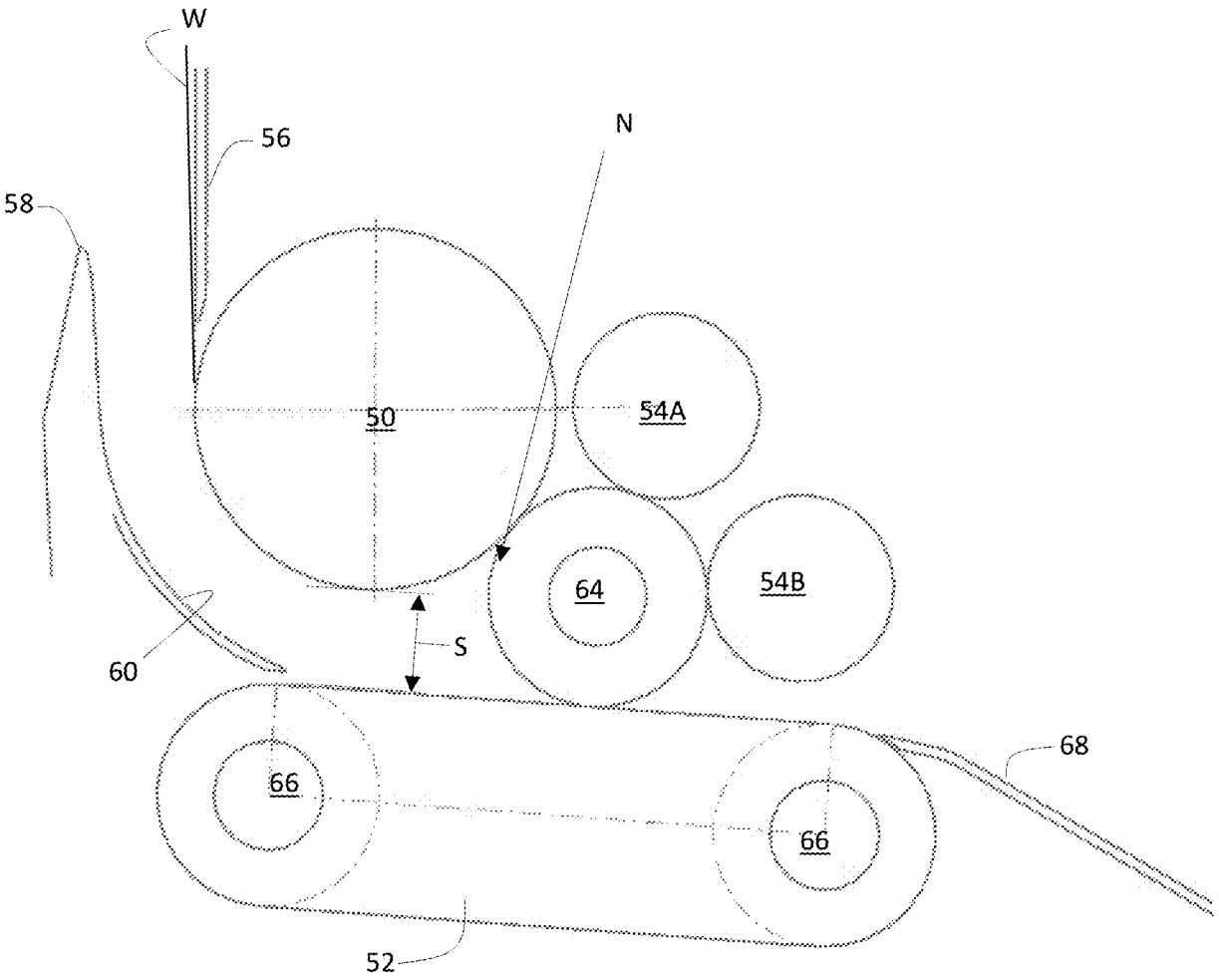
FIG. 14 illustrates the winding nest of FIG. 10 winding a 100 mm diameter log.
Figure 15:
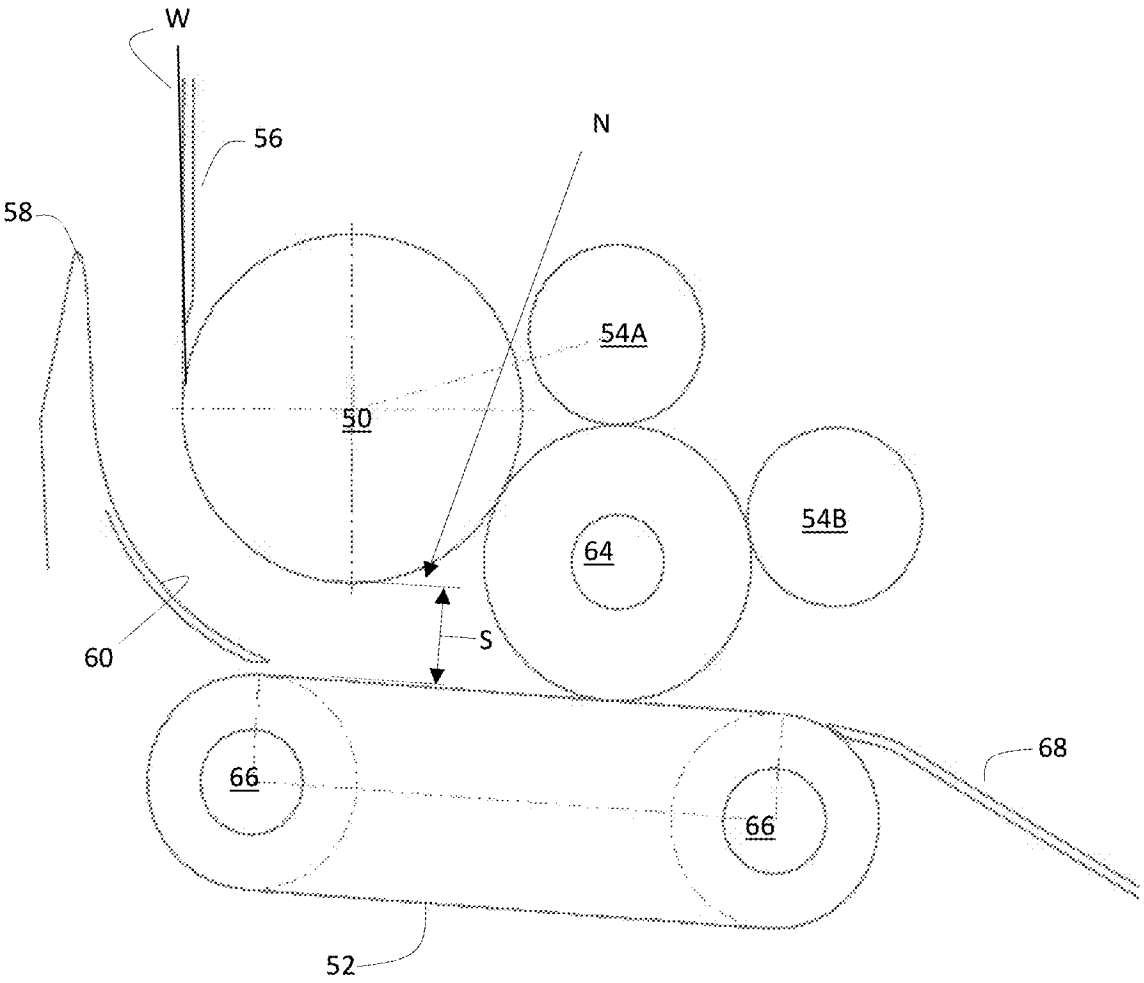
FIG. 15 illustrates the winding nest of FIG. 10 winding a 130 mm diameter log.
Figure 22:
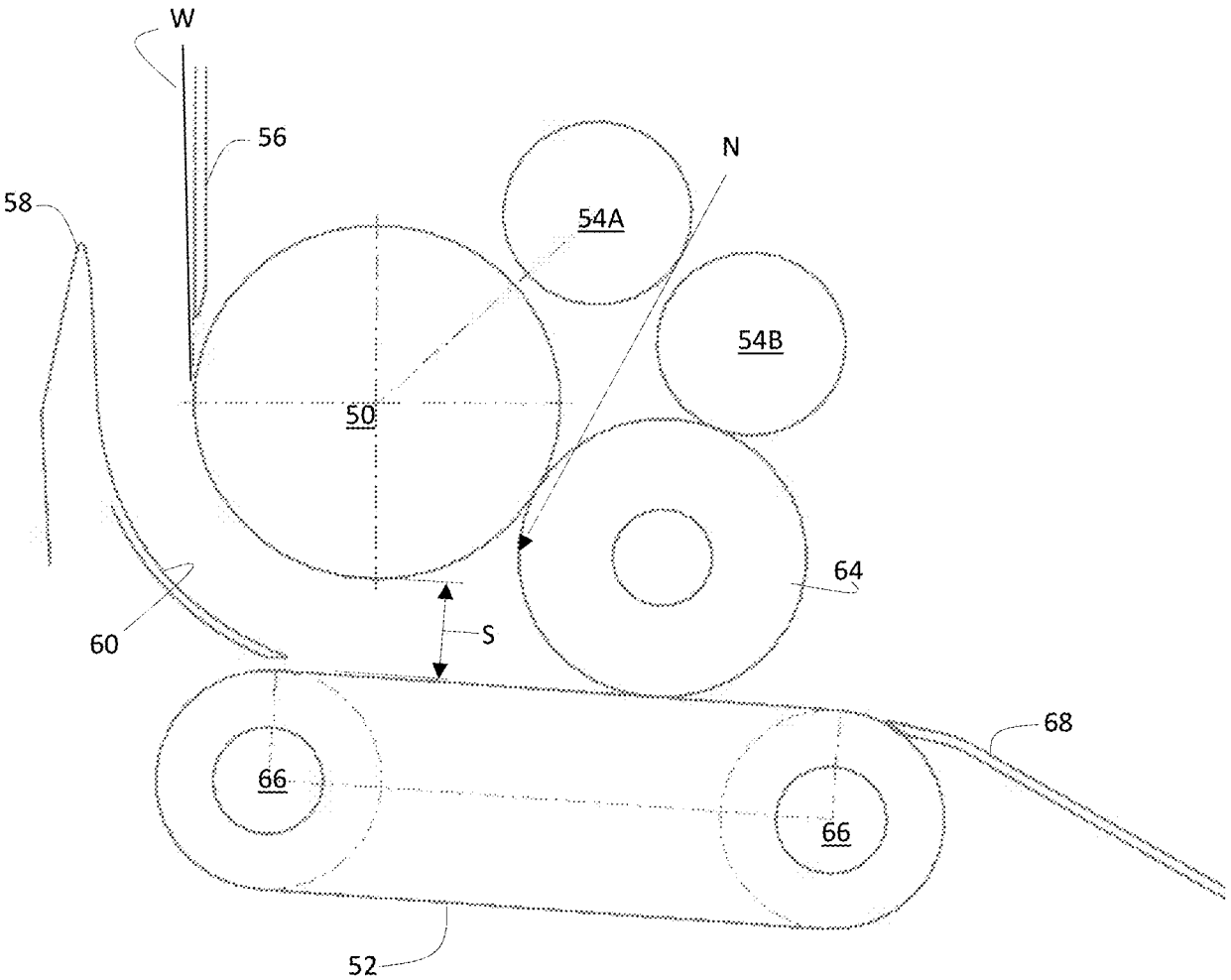
FIGS. 22-24 illustrate the winding nest of FIG. 10 discharging a 130 mm diameter log according to an alternate method.

The rider roll 54A closer to the winding drum 50 may engage incoming log 64 first. As the log 64 increases in diameter during the winding cycle, the rider roll 54A may travel toward the top of the winding log 64, making space for the rider roll 54B to engage the log 64 at the side of the log (per the drawings). For very small diameter logs, the system may be configured to use only one of the rider rolls, where there may not be space available to have both rider rolls 54A,546 engaged during a majority of the winding cycle. As shown in FIG. 12, the rider roll 54A only may be used. Alternatively, for instance, as shown in FIG. 22 discussed further below, the rider roll 54A may be parked out of the way and the rider roll 54B only may be used, if there is adequate clearance and the compound motion positioning mechanism of the rider roll 54B has adequate downward travel to engage a small diameter log 64. FIG. 11 shows the rider roll 54A meeting an incoming log. FIG. 12 shows the rider roll 54A having migrated to near the top of a winding log 64, and there is now space for the rider roll 54B to approach the side of the log as shown in FIG. 13. FIGS. 13-14 show the rider roll 54B in contact with the log 64, at a position substantially equidistant from the rider roll 54A and the belt 52. Operation of the rider rolls at log discharge may depend on the relative diameter of the finished log, as described below:

Very Small—Only one rider roll is used, so the rider roll 54A or 54B controls the log winding and the log discharge in conjunction with the belt.

Small—The rider roll 54A controls the log discharge in conjunction with the belt and the rider roll 54B moves away from the log, so it does not block the exit path of the log.

Medium—The rider roll 54B orbits higher on the log 64 while still remaining in contact. Then the rider roll 54A initiates log discharge in conjunction with the belt. As shown in FIGS. 17-21, as the log 64 departs, the rider roll 54B tracks with the log, and remains in contact with the log for the most part during discharge, and assists with log discharge. Contact of the rider roll 54B with the log 64 need not be continuous during discharge because the log already has translational momentum, and the discharge is also controlled by speed reduction of the belt 52. The presence of the rider roll 54B above the log 64 ensures the discharge is completed and also serves to contain and direct a log that may be vibrating at the start of its discharge.

Figure 16A:
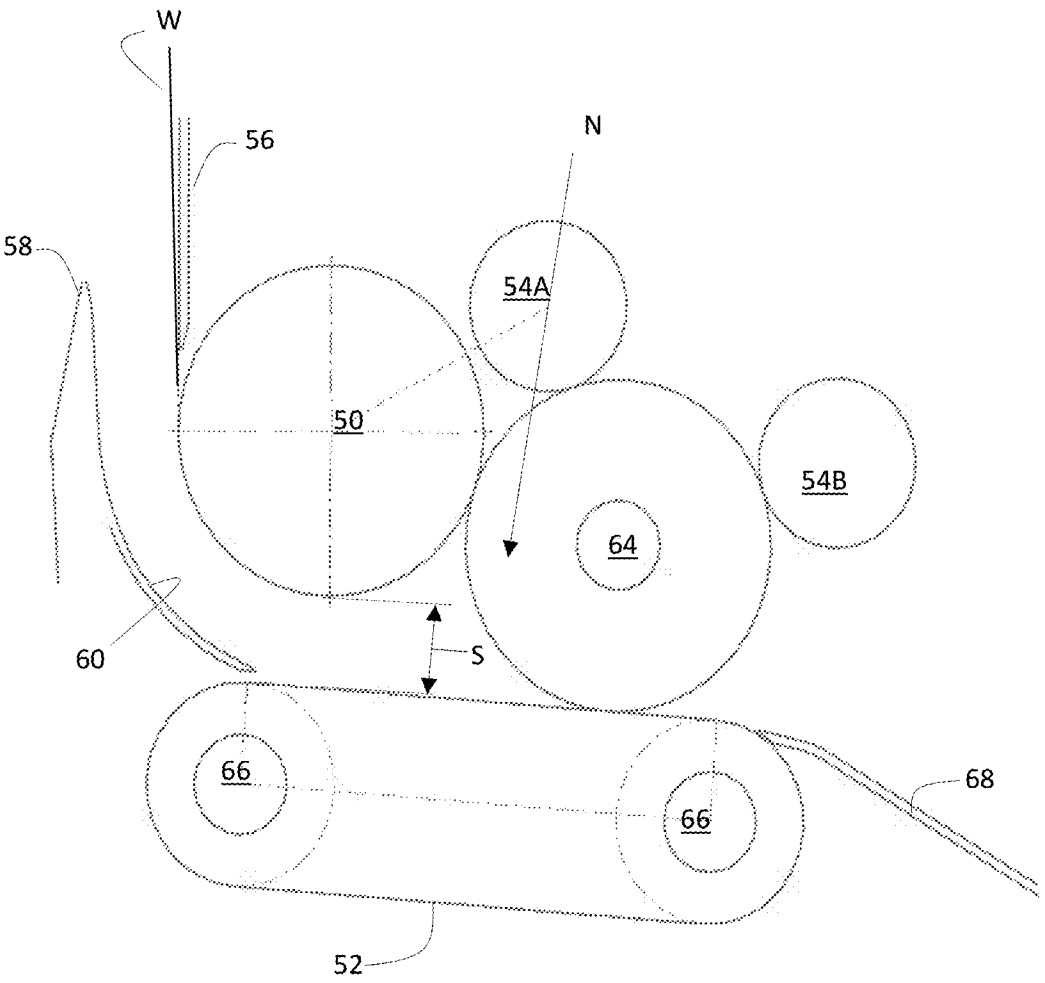
FIG. 16A illustrates the winding nest of FIG. 10 winding a 165 mm diameter log.
Figure 16B:
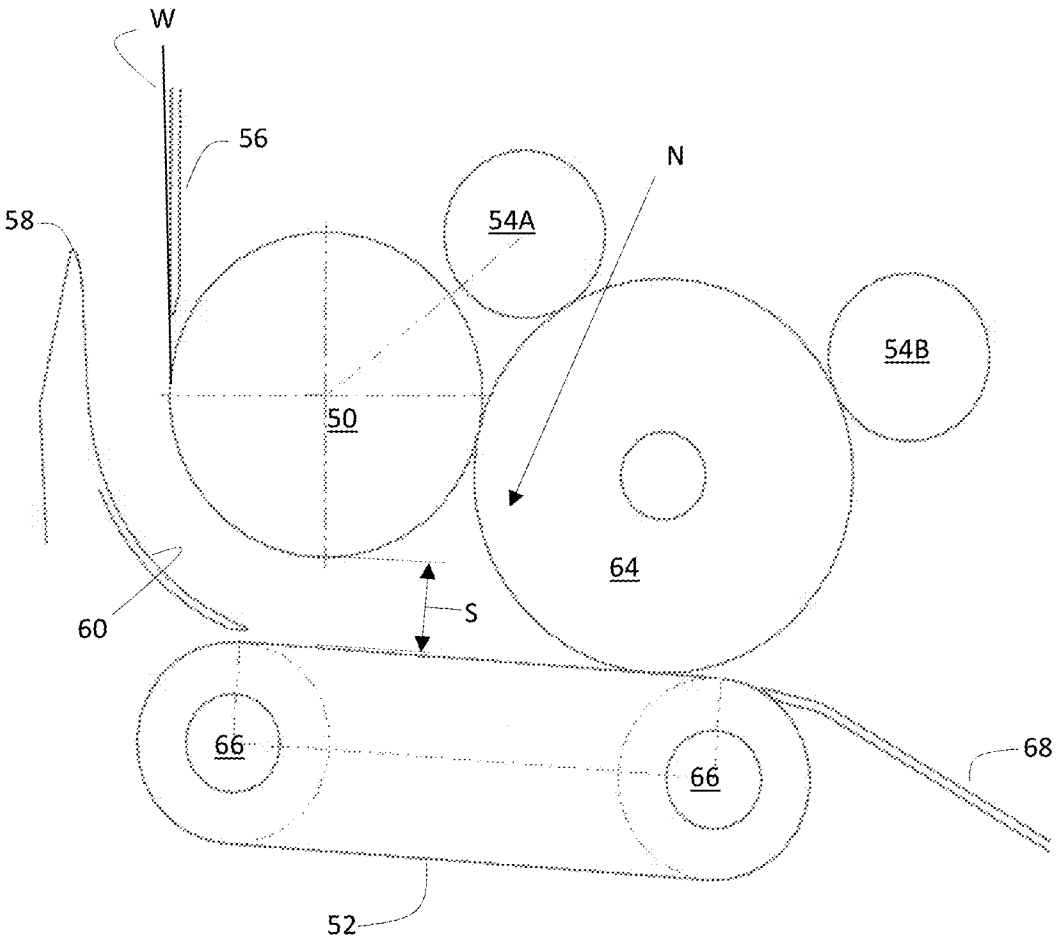
FIG. 16B illustrates the winding nest of FIG. 10 winding a 200 mm diameter log.
Figure 17:
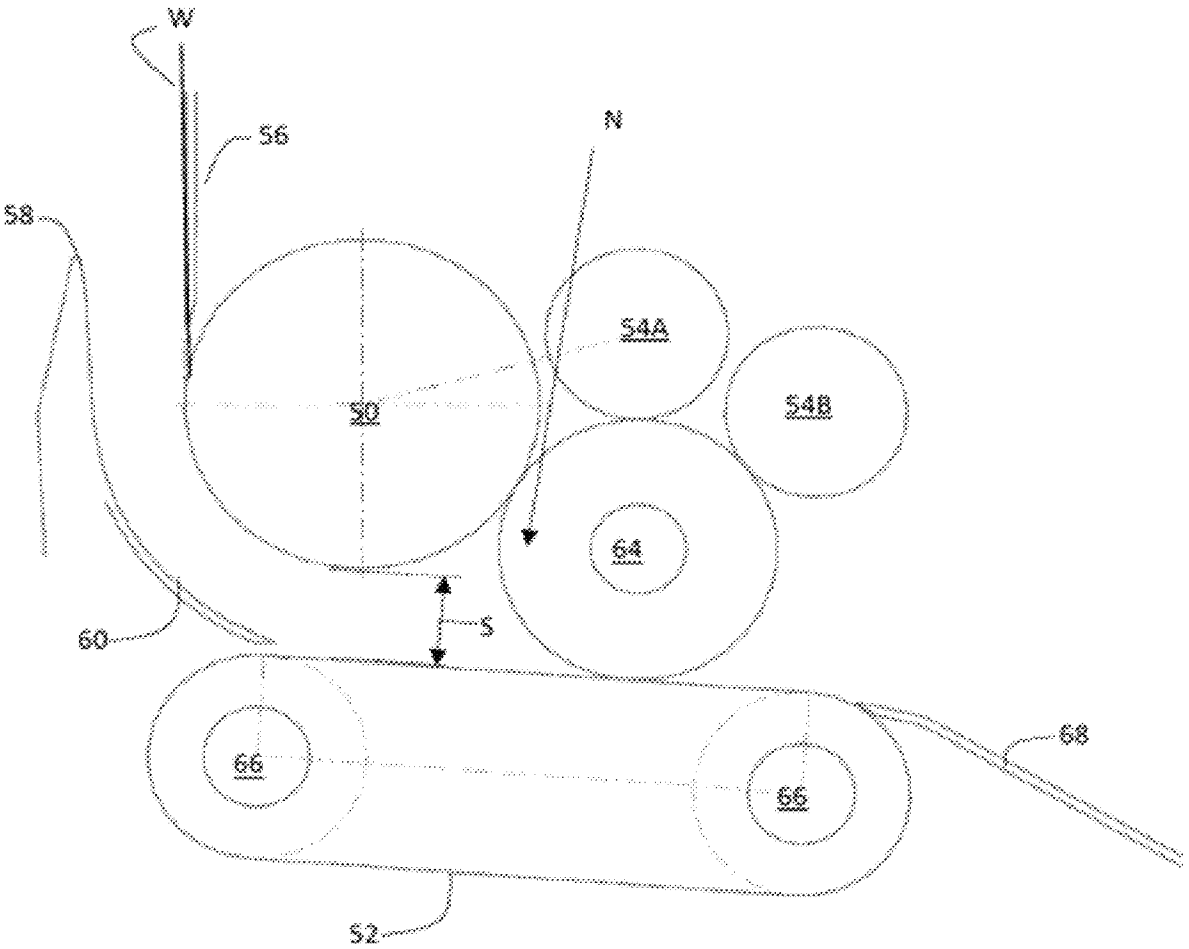
FIGS. 17-21 illustrate the winding nest of FIG. 10 discharging a 130 mm diameter log.
Figure 18:
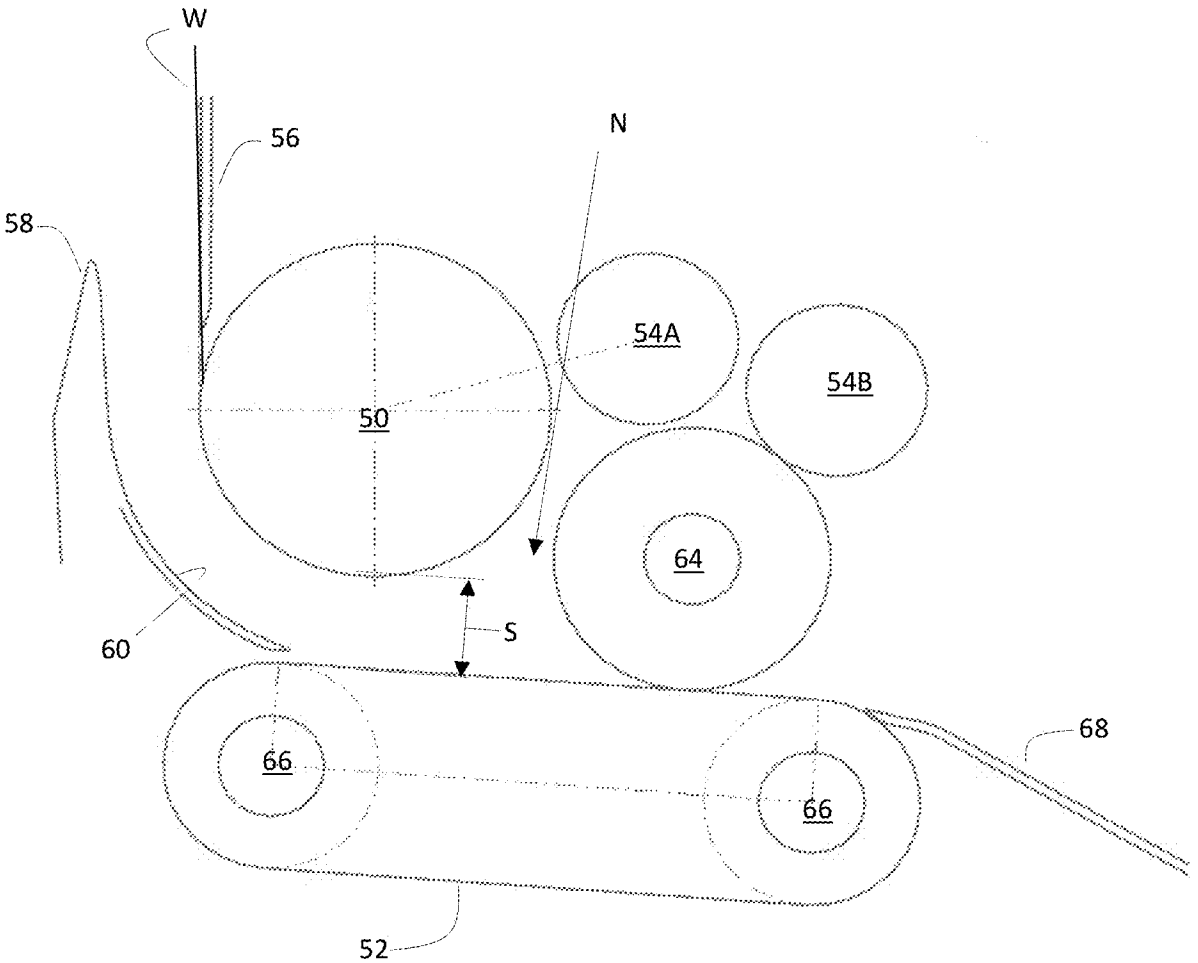
Figure 19:
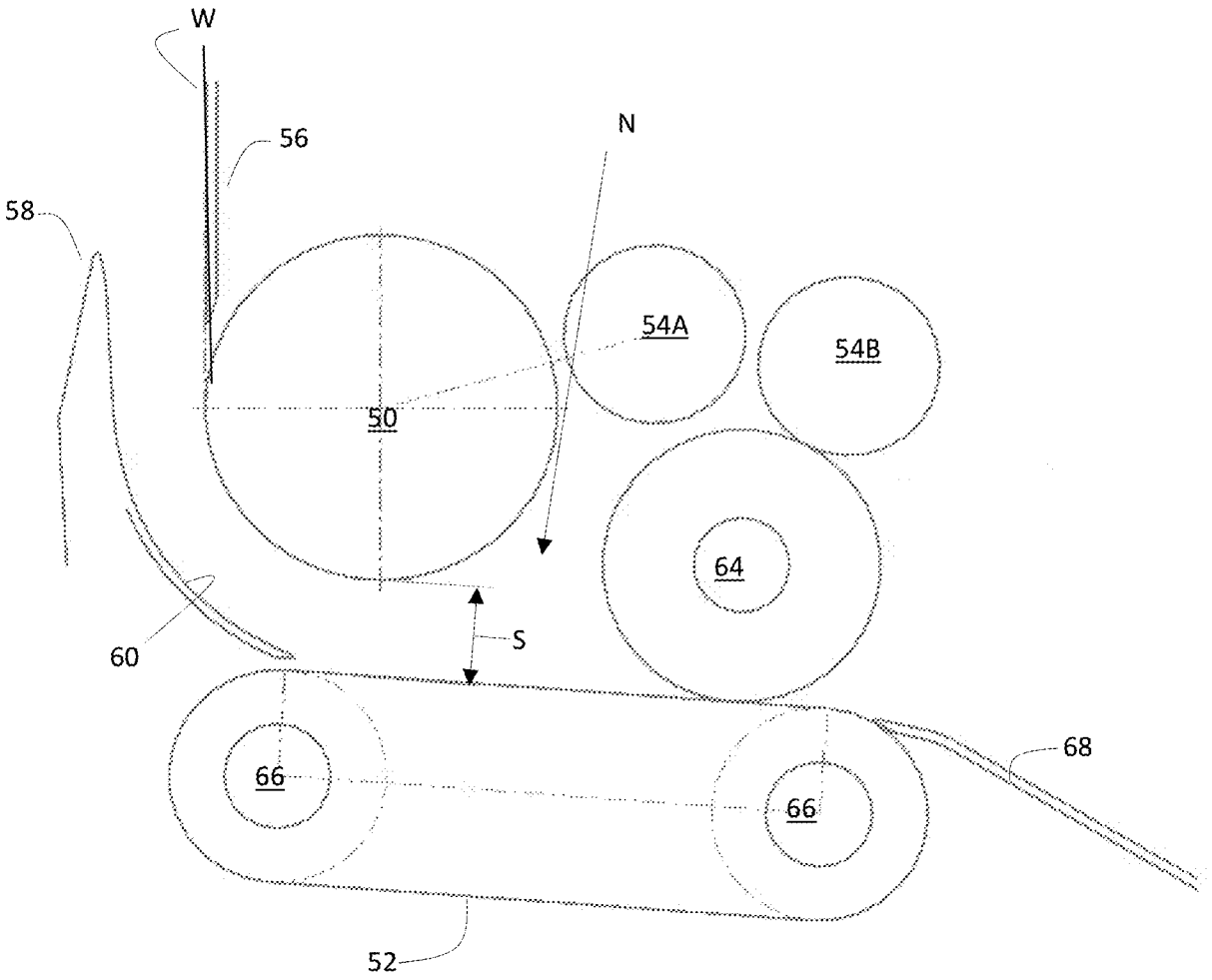
Figure 20:
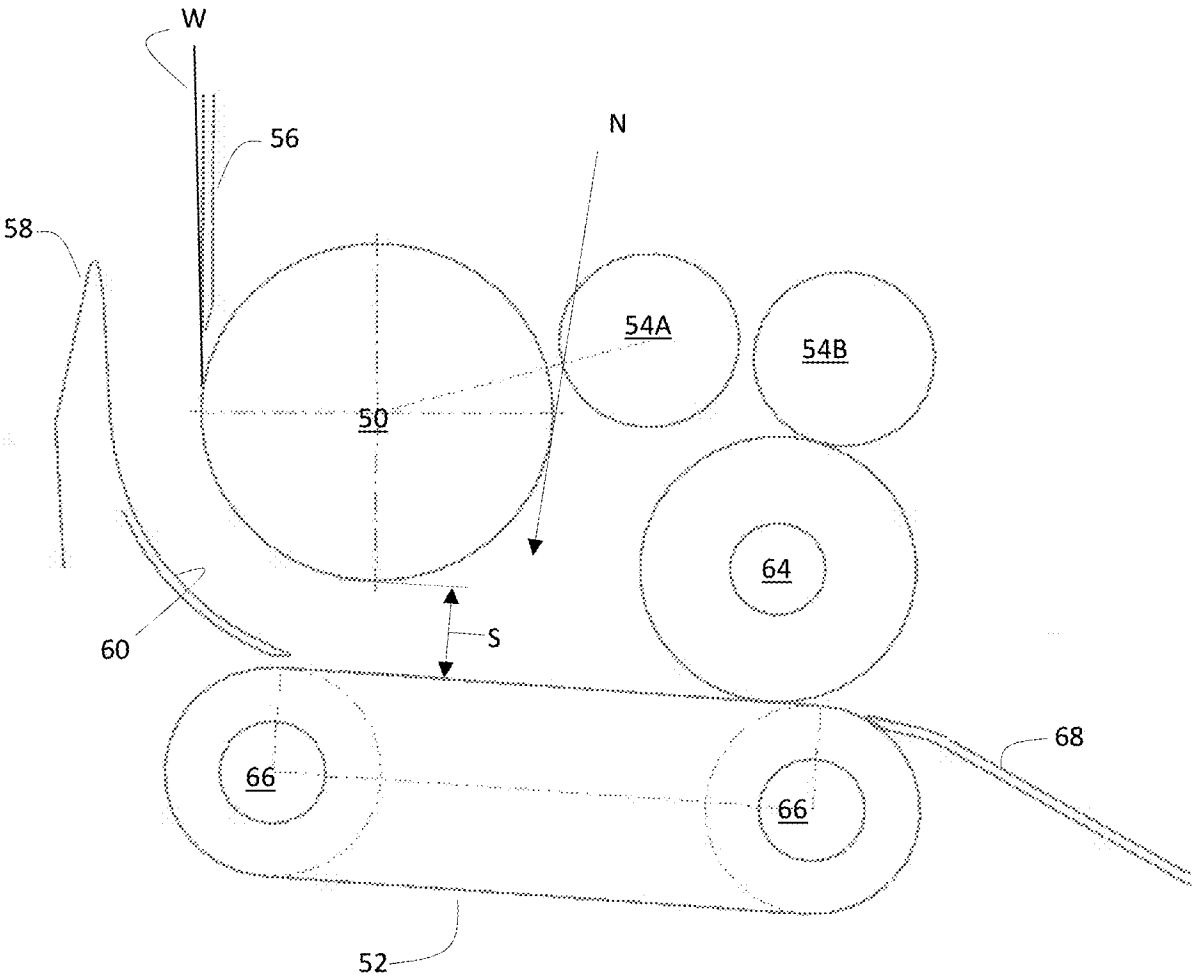
Figure 21:
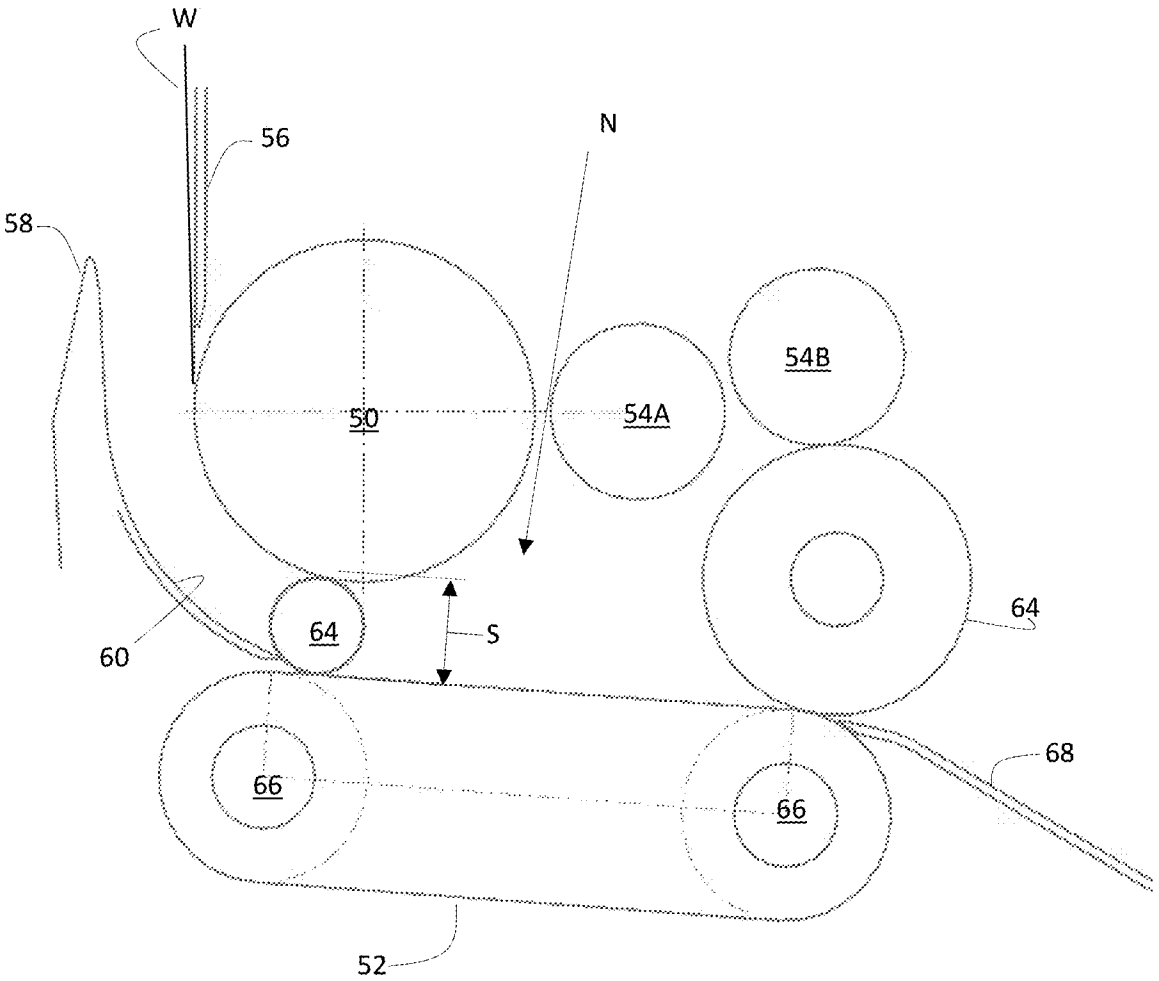

Large—During winding of a large diameter log the rider roll 54A may be moved to an upstream side of the winding log 64 and no longer be above the log so that the rider roll does not assist with the log discharge. The rider roll 54B may orbit to a preferred discharge position and control the log discharge in conjunction with the belt. An example of a large log is shown in FIGS. 16A and 16B.

Figure 23:
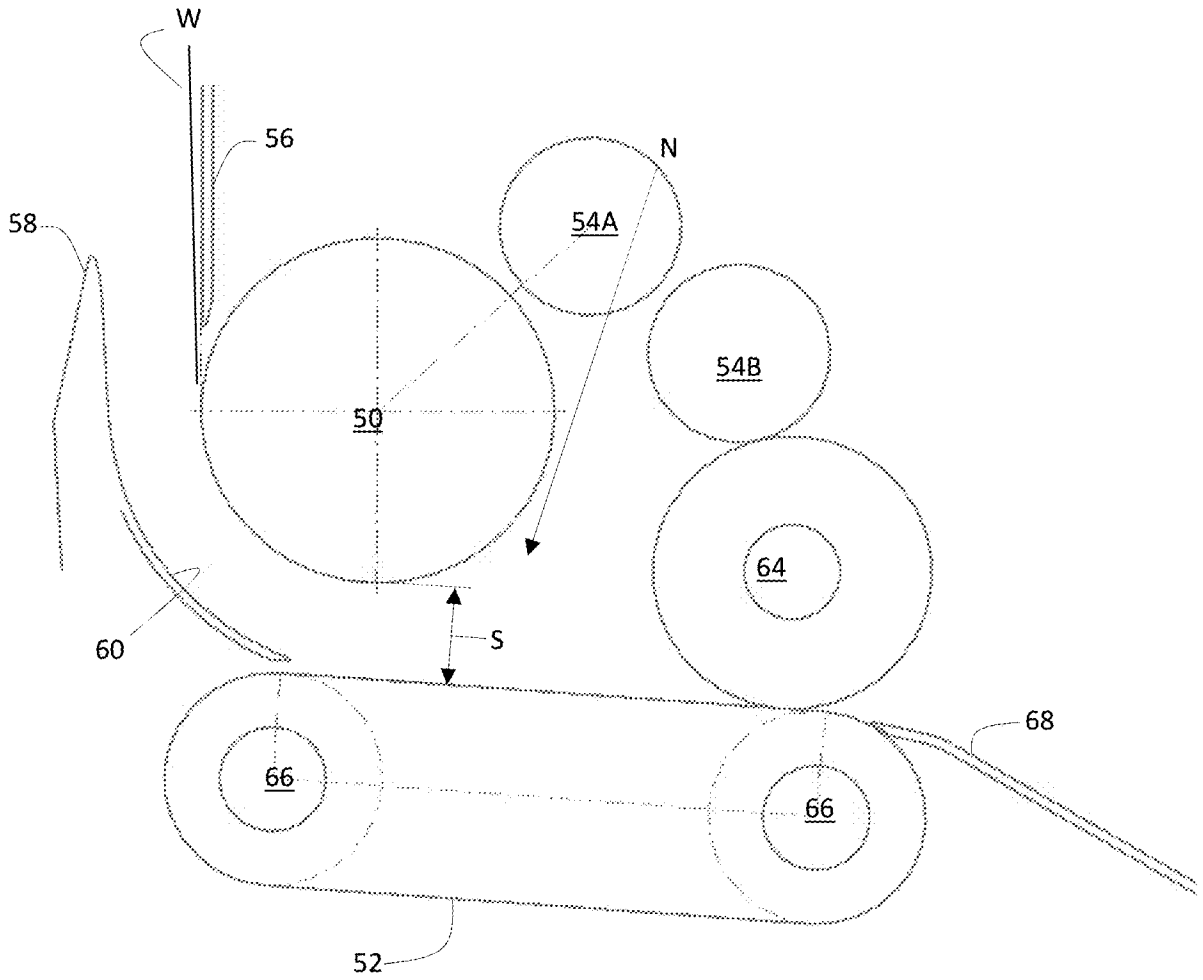
Figure 24:
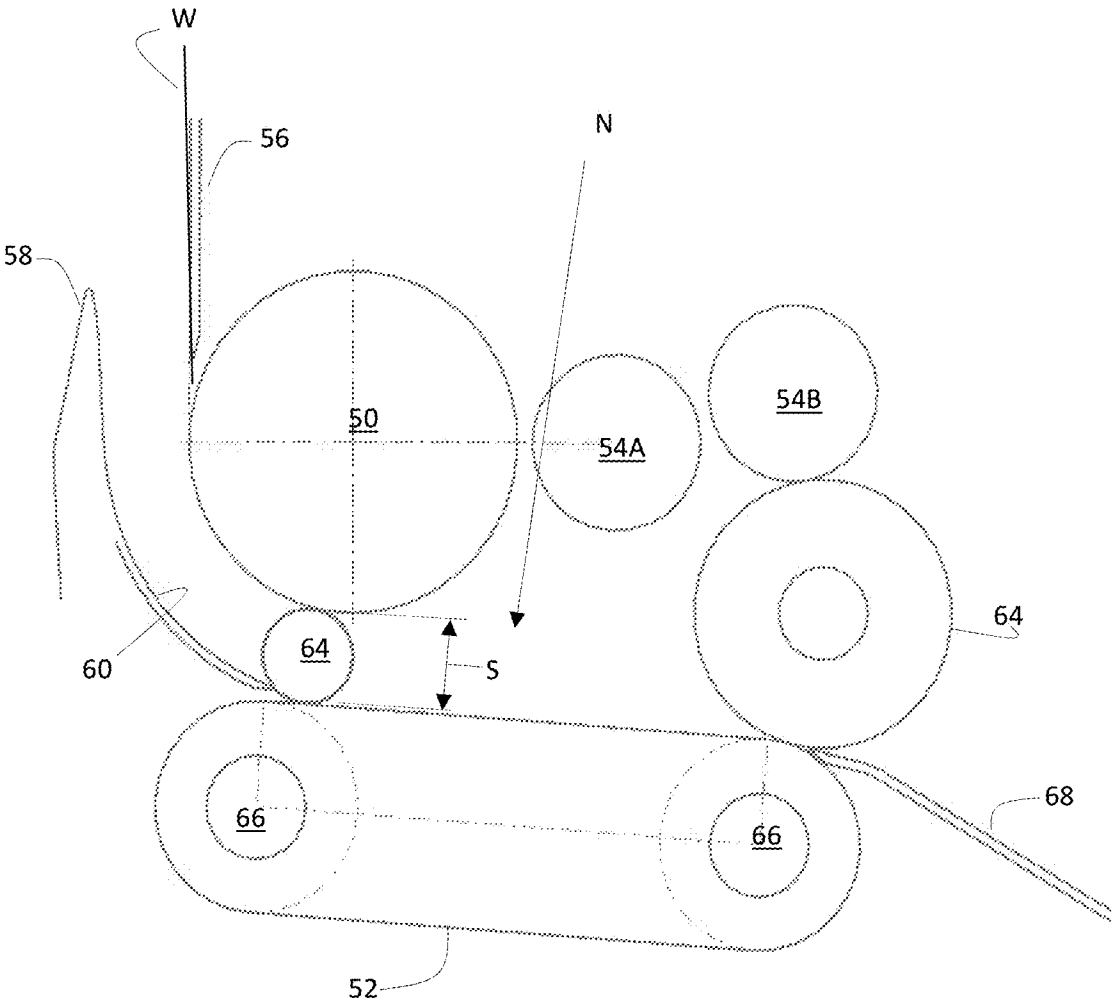
Figure 25:
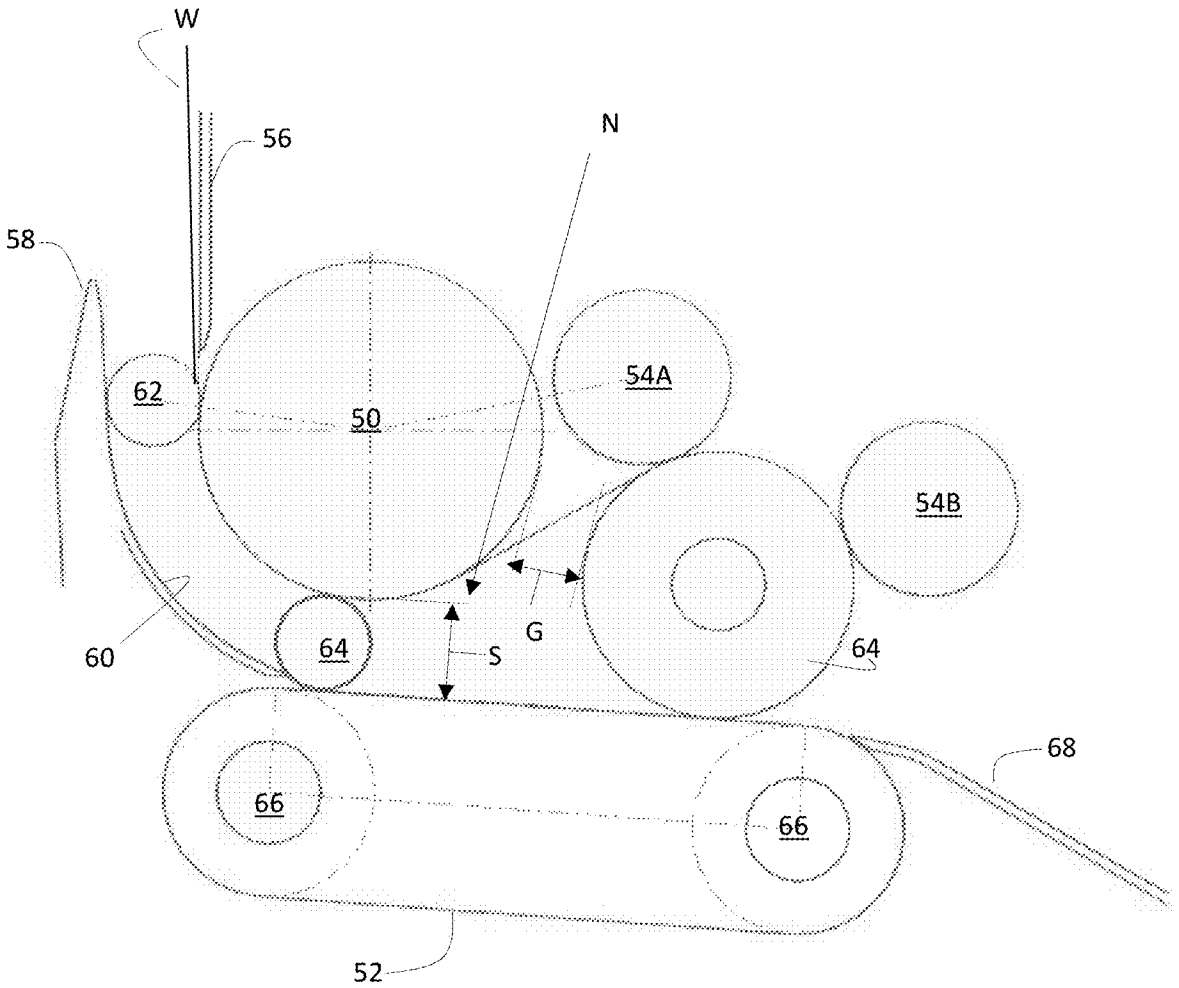
FIG. 25 shows an alternate embodiment of a winding nest configuration comprising a winding drum, a belt, and two rider rolls where the winding log is spaced from the winding drum.
Figure 26:
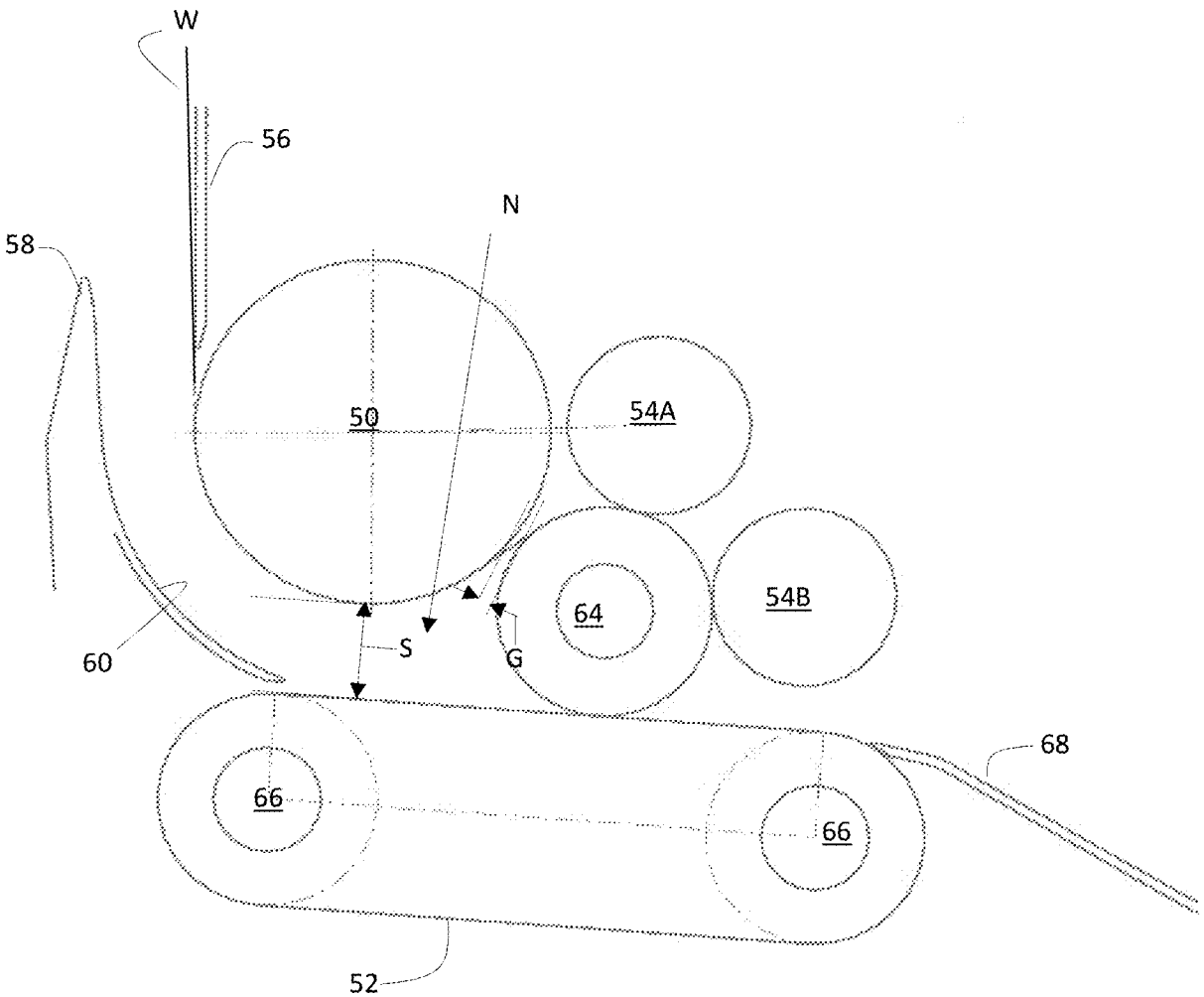
FIG. 26 illustrates the winding nest of FIG. 25 winding a 100 mm diameter log, where its gap to the winding drum is 5 mm and the length of the web span is approximately 37 mm.
Figure 27:
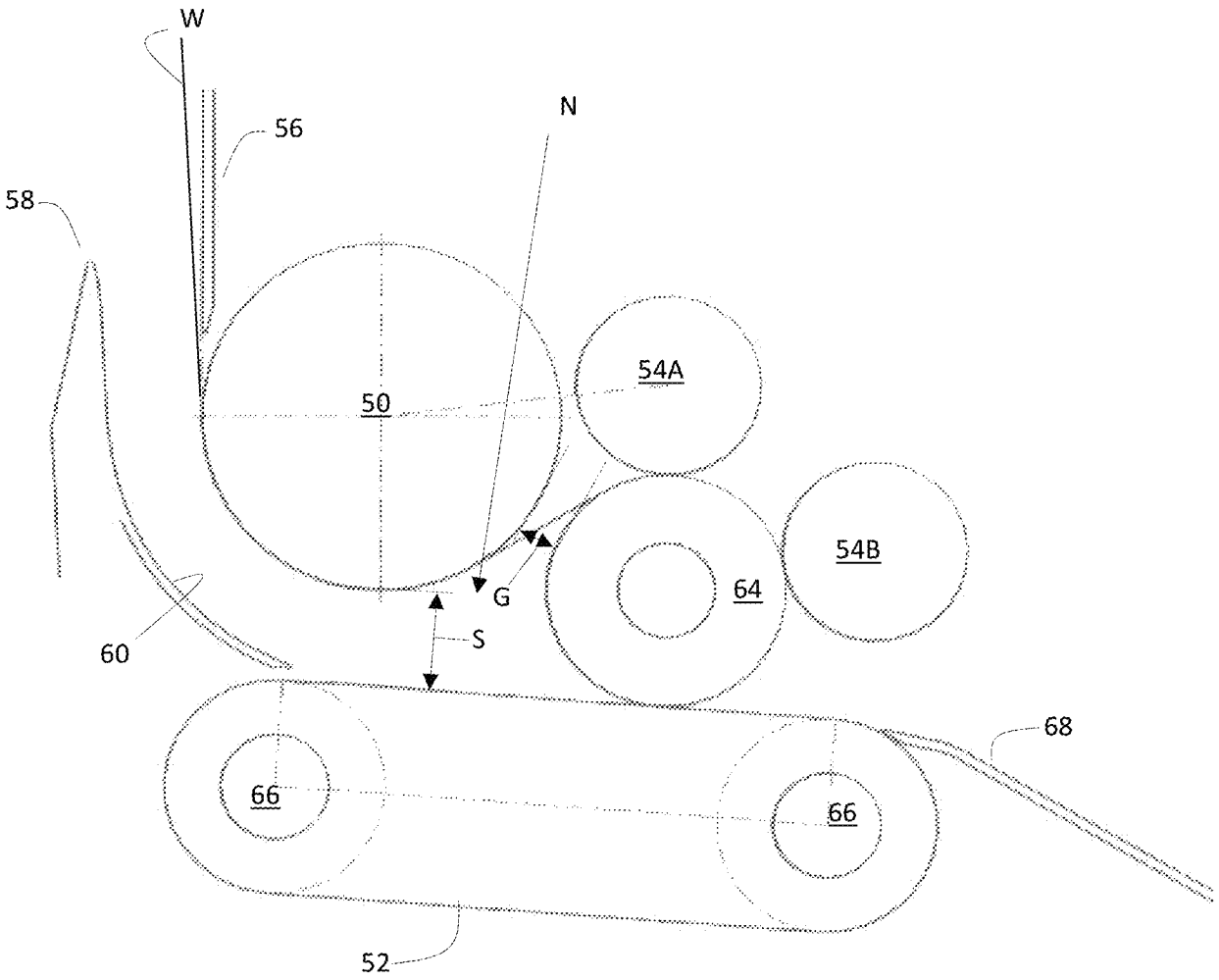
FIG. 27 illustrates the winding nest of FIG. 25 winding a 110 mm diameter log, where its gap to the winding drum is 17 mm and the length of the web span is approximately 71 mm.
Figure 28:
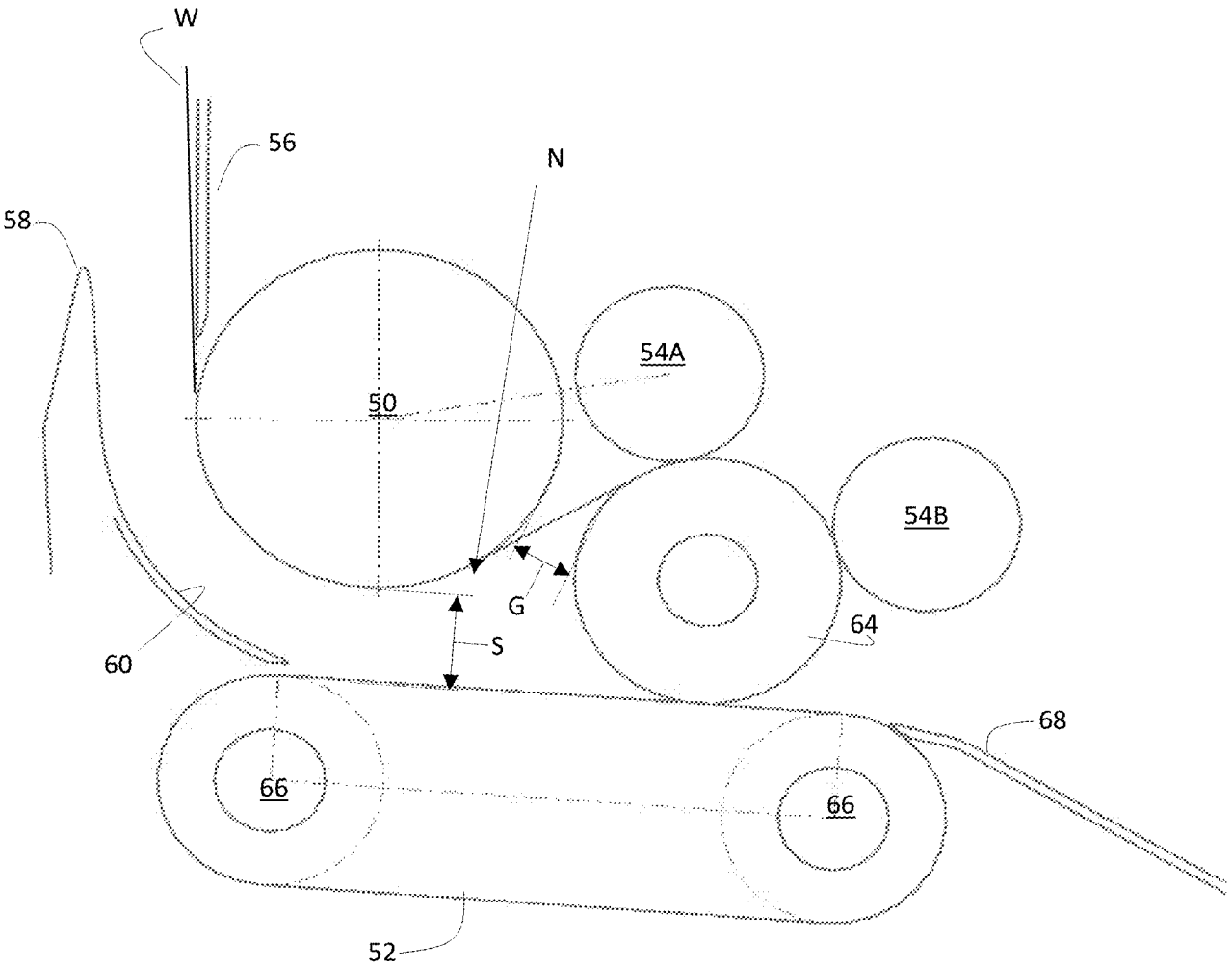
FIG. 28 illustrates the winding nest of FIG. 25 winding a 120 mm diameter log, where its gap to the winding drum is 25 mm and the length of the web span is approximately 88 mm.
Figure 29:
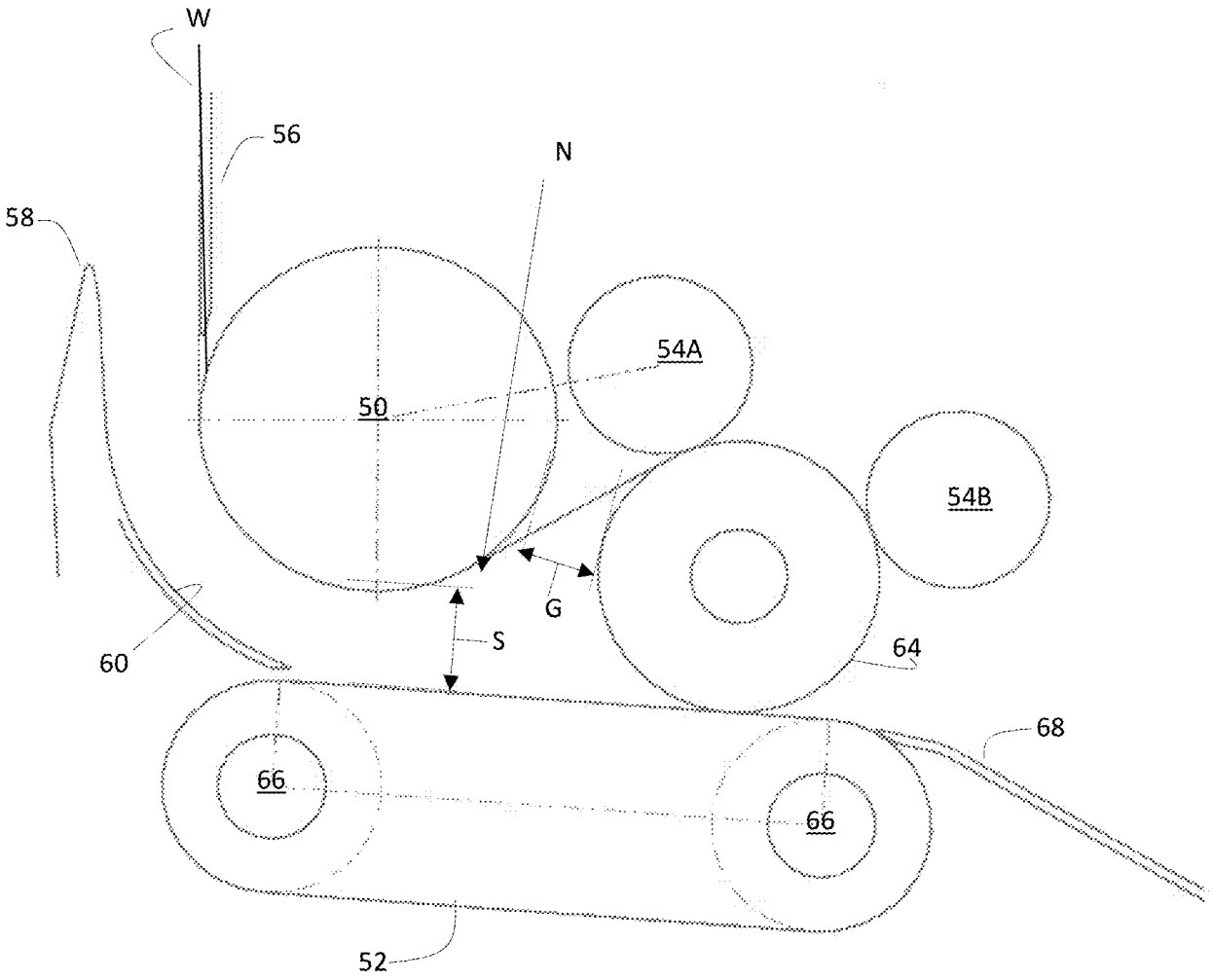
FIG. 29 illustrates the winding nest of FIG. 25 winding a 130 mm diameter log, where its gap to the winding drum is 35 mm and the length of the web span is approximately 108 mm.

Alternatively, for certain log diameters it may be preferable to move the rider roll 54A away from the winding log 64 to make space for the rider roll 54B to orbit higher to a more preferred position for log discharge (see FIG. 22). When the rider roll 54A is clear and the rider roll 54B has moved to its position for log discharge, the rider roll 54B initiates log discharge in conjunction with the belt. As the log 64 departs, the rider roll 54B may track with the log, and remain in contact with the log for the most part during discharge, and assist with log discharge. Contact of the rider roll 54B with the log 64 need not be continuous during discharge because the log already has translational momentum, and the discharge is also controlled by speed reduction of the belt 52. The presence of the rider roll 54B above the log 64 ensures the discharge is completed and also serves to contain and direct a log that may be vibrating at the start of its discharge. The rider roll 54A may initiate its return to meet a subsequent log as the rider roll 54B moves out of its path. An example of this log discharge is shown in FIGS. 22-24.

In the winding nest configuration as shown in FIGS. 10-24, the winding nest N utilizes three contact regions spaced evenly about the log from early in the wind cycle, followed by four contact regions well-spaced about the log for a preponderance of the winding cycle when vibration of the log is most likely to occur, followed by three regions of contact well-spaced about the log at the start of log discharge. Having four contact regions at the log periphery, which drive the log in rotation and spatially contain the log, is favorable for winding low firmness and low firmness large diameter logs at higher speeds without excessive vibration, or with less vibration. Without being limited to any theory, it is believed that the log can be driven in rotation with less contact pressure, and therefore less forward-phasing inter-layer slip, if the driving is executed at four contact regions rather than three. Further, if a log starts to vibrate it is believed that the control afforded by four contact regions may better contain the vibrating log, and with less contact pressure than by three contact regions. Providing two rider rolls 54A and 54B may allow reduced contact pressure at the rider roll nip points, and for reduced contact pressure at the nip between the winding drum 50 and the log, which may in turn allow for winding logs of relatively larger diameter and/or at relatively higher speeds. The reduced contact pressure on the log at the nips may further reduce the compression, tension and/or elongation of the wraps of web material that tend to distort or thin a structured web or embossing. A core chuck 82 or core chucks as described previously may be provided in the winding nest configuration shown in FIGS. 10-24.

Figure 30:
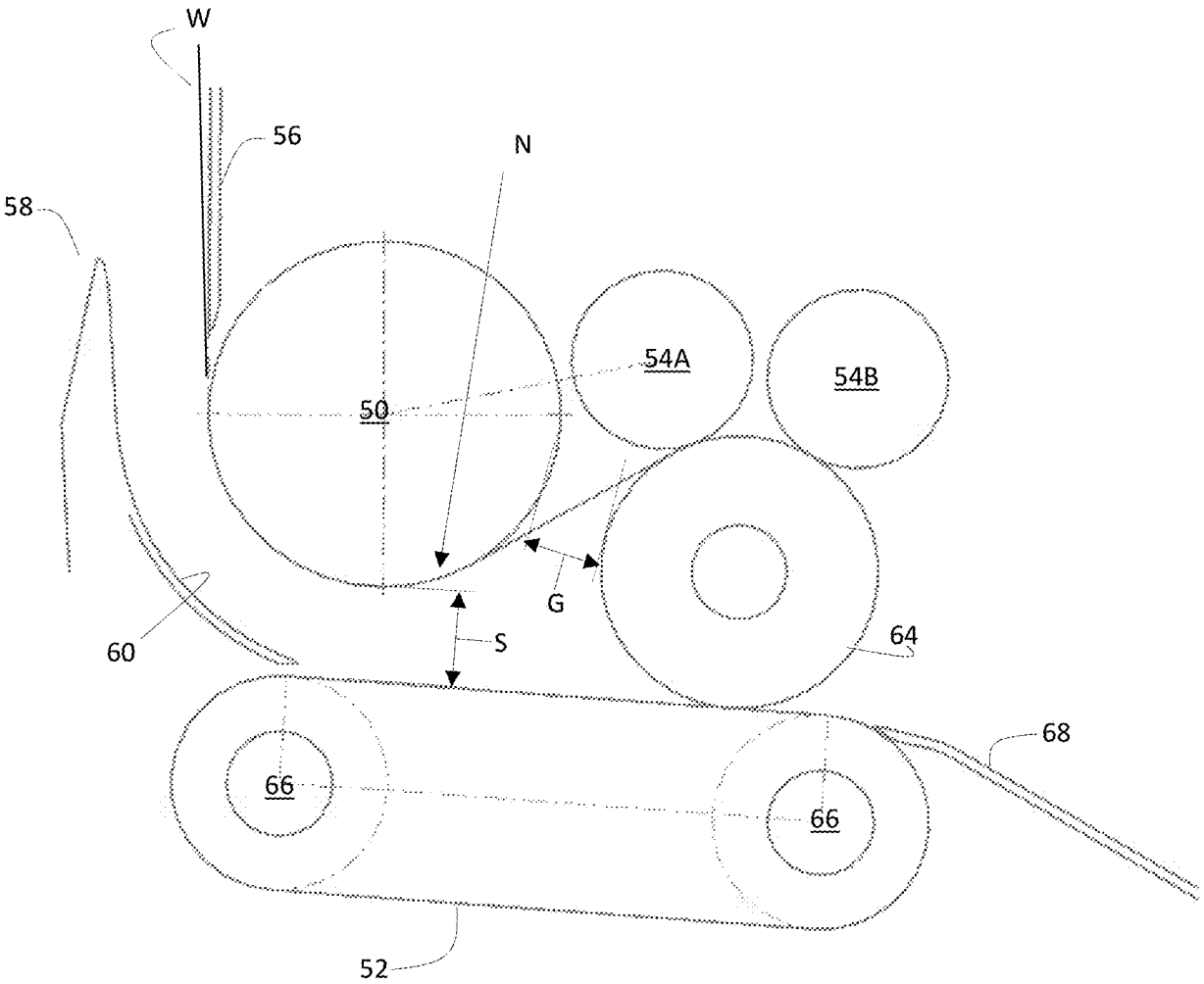
FIG. 30 illustrates the winding nest of FIG. 25 discharging a 130 mm diameter log.
Figure 31:
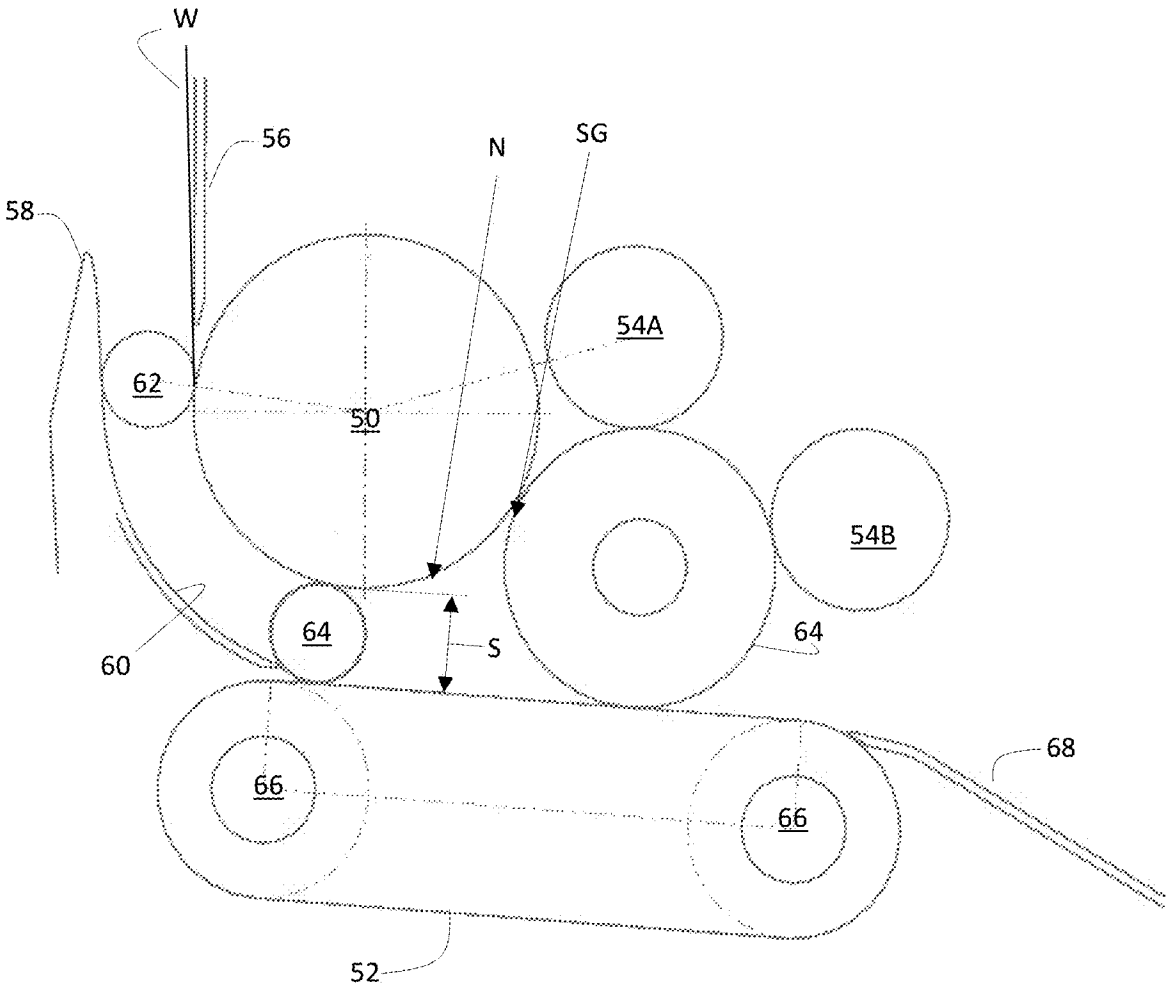
FIG. 31 shows an alternate embodiment of a winding nest configuration comprising a winding drum, a belt, and two rider rolls where the winding log is spaced from the winding drum.
Figure 32:
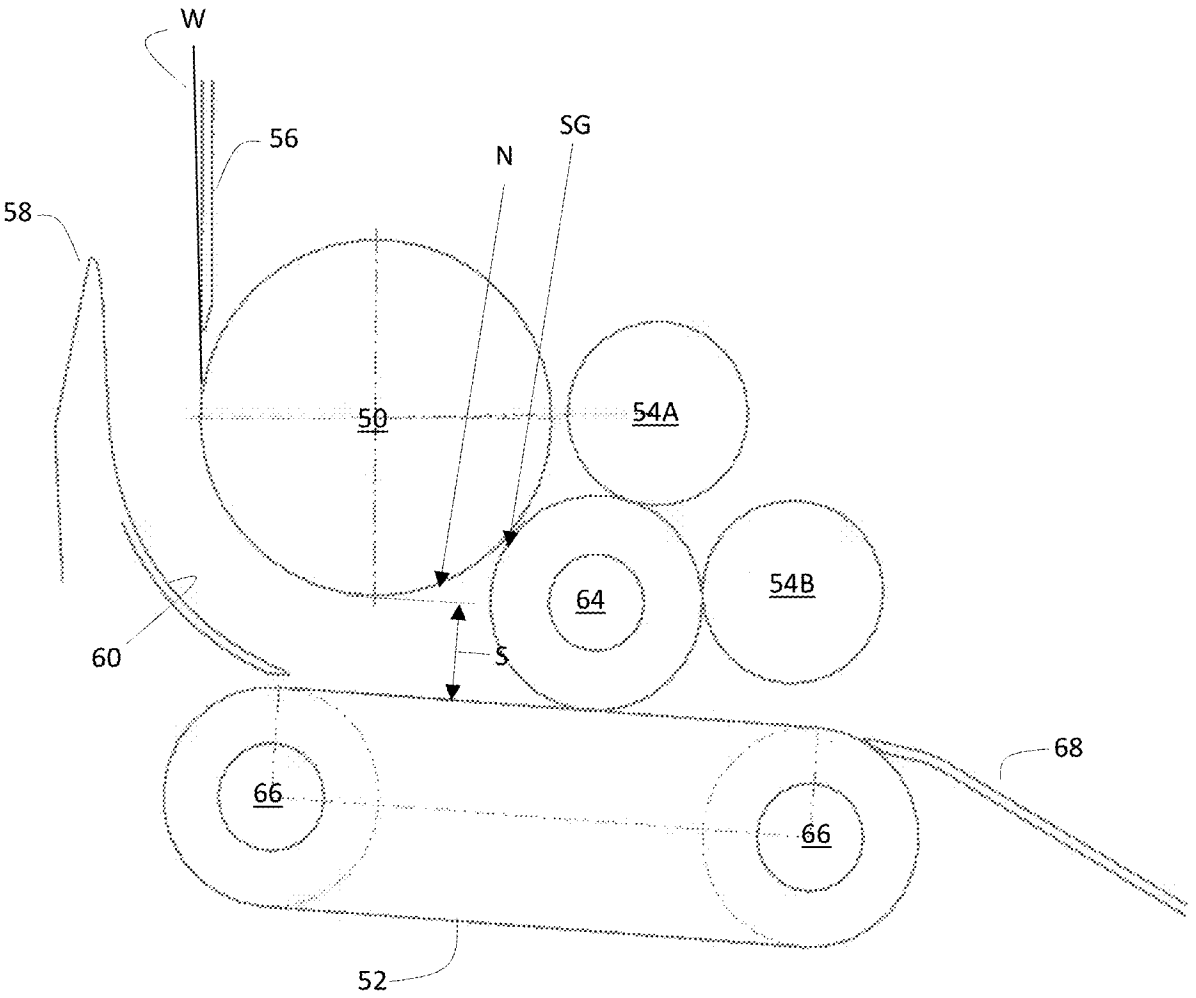
FIG. 32 illustrates the winding nest of FIG. 31 winding a 100 mm diameter log, where its gap to the winding drum is 2 mm and the length of the web span is approximately 23.1 mm.
Figure 33:
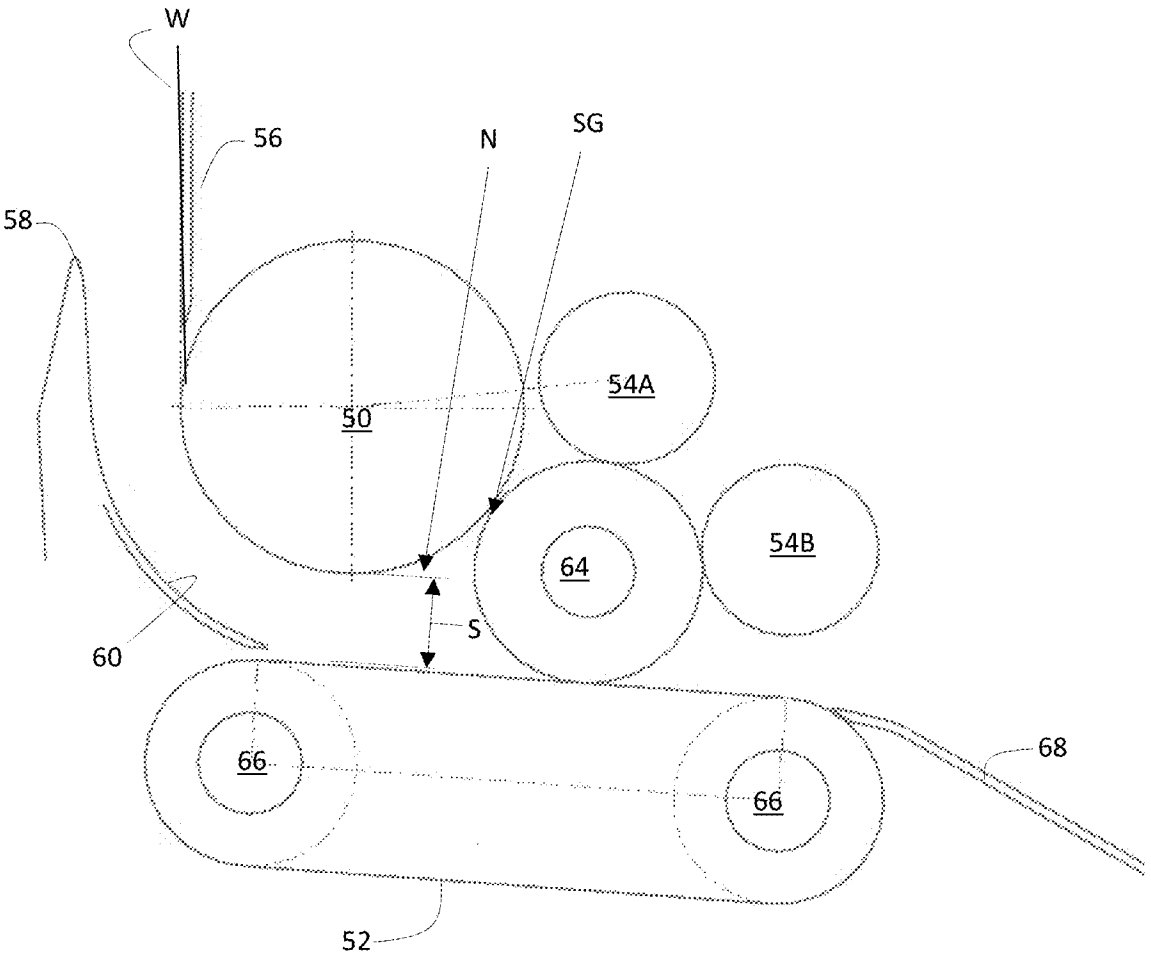
FIG. 33 illustrates the winding nest of FIG. 31 winding a 110 mm diameter log, where its gap to the winding drum is 2 mm and the length of the web span is approximately 23.5 mm.
Figure 34:
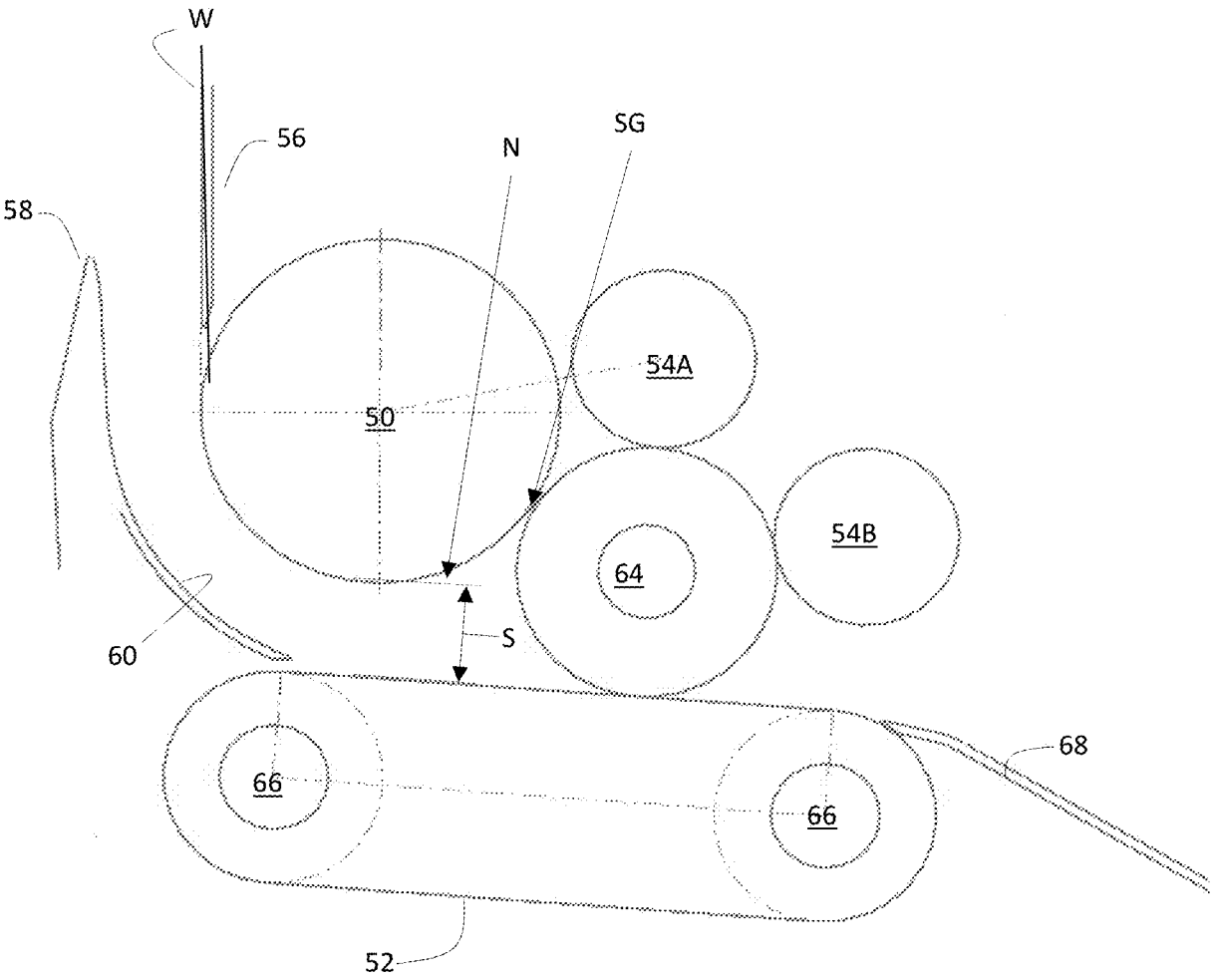
FIG. 34 illustrates the winding nest of FIG. 31 winding a 120 mm diameter log, where its gap to the winding drum is 2 mm and the length of the web span is approximately 24.0 mm.
Figure 35:
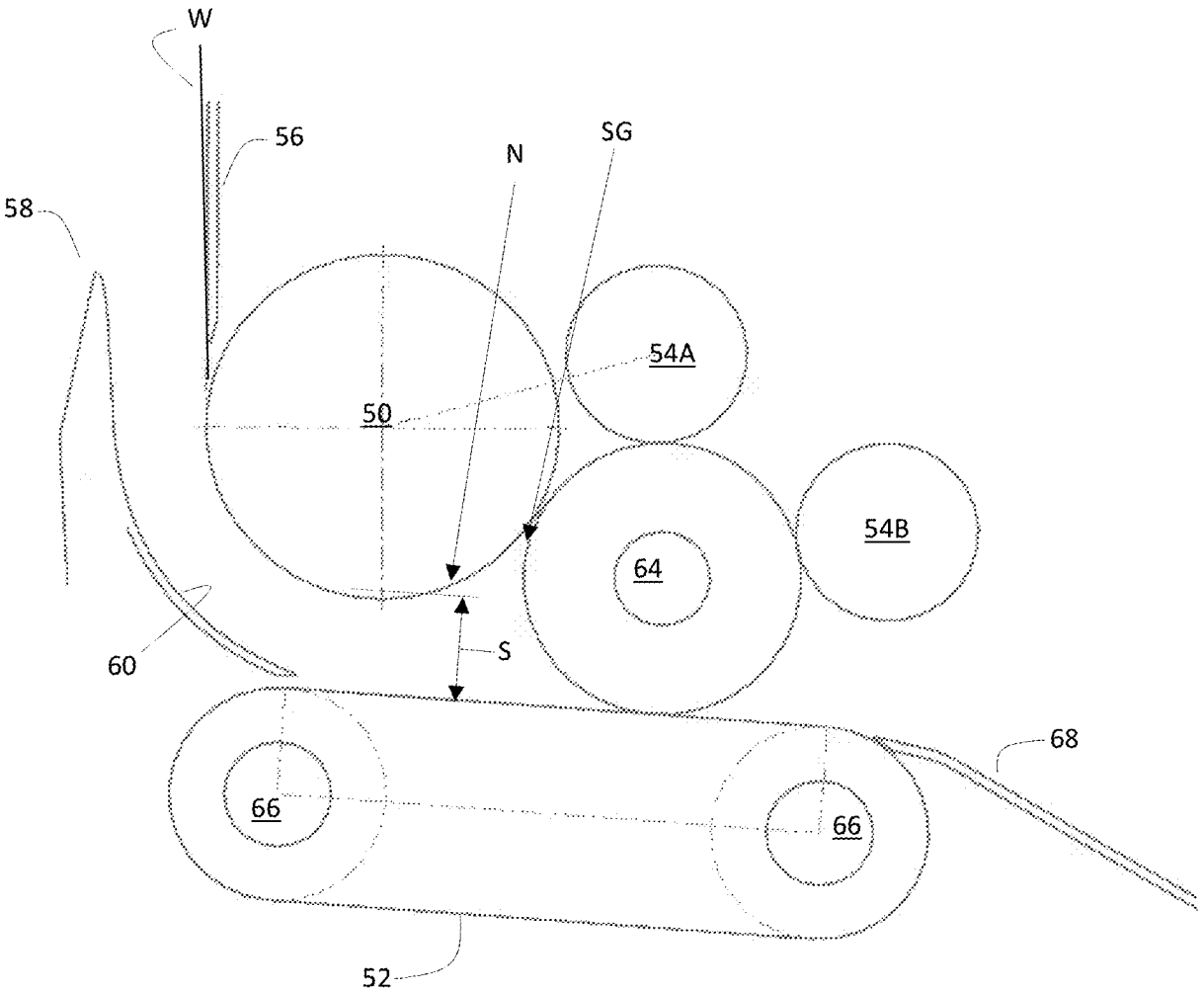
FIG. 35 illustrates the winding nest of FIG. 31 winding a 130 mm diameter log, where its gap to the winding drum is 2 mm and the length of the web span is approximately 24.4 mm.
Figure 36:
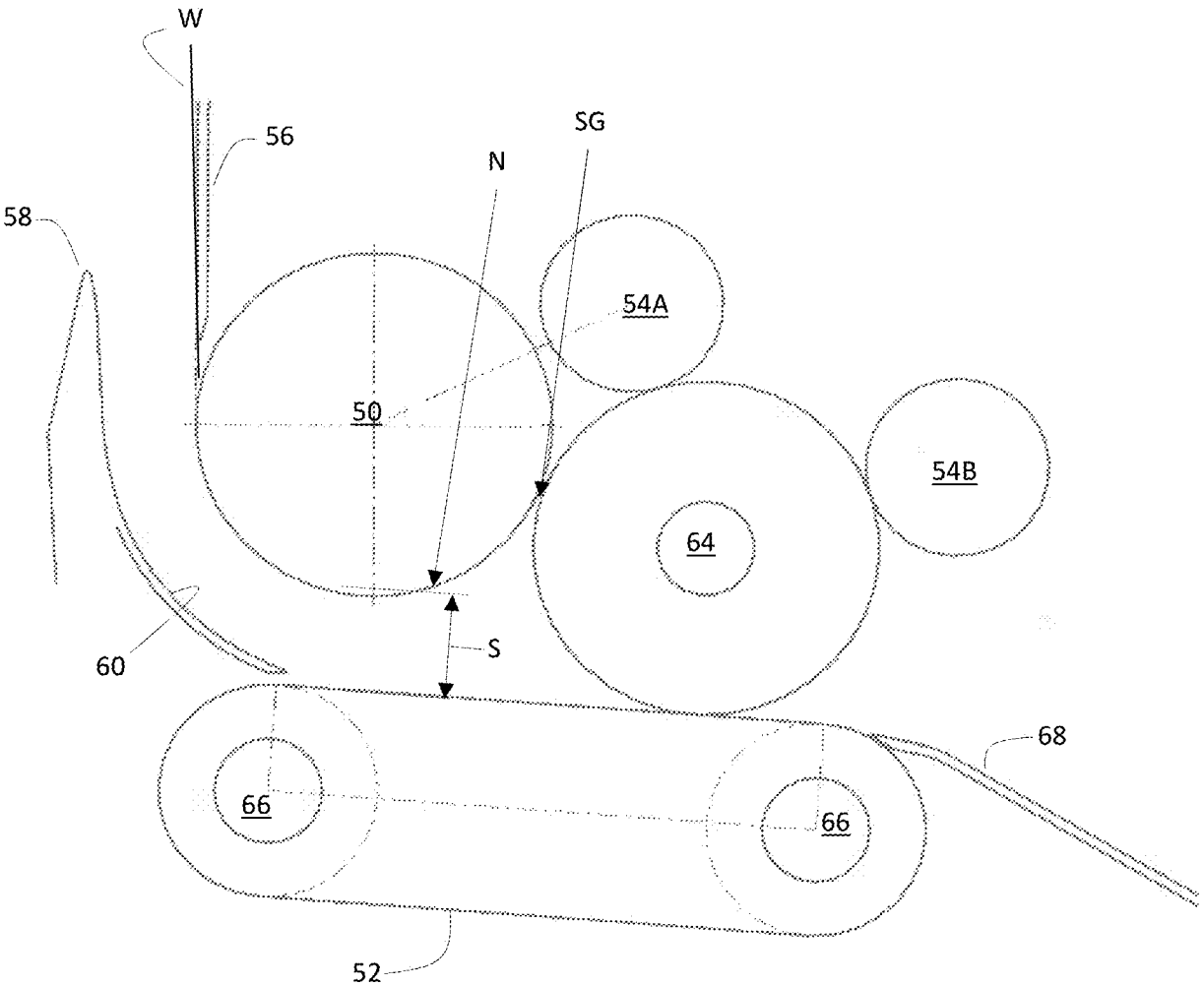
FIG. 36 illustrates the winding nest of FIG. 31 winding a 160 mm diameter log, where its gap to the winding drum is 2 mm and the length of the web span is approximately 25.6 mm.
Figure 37:
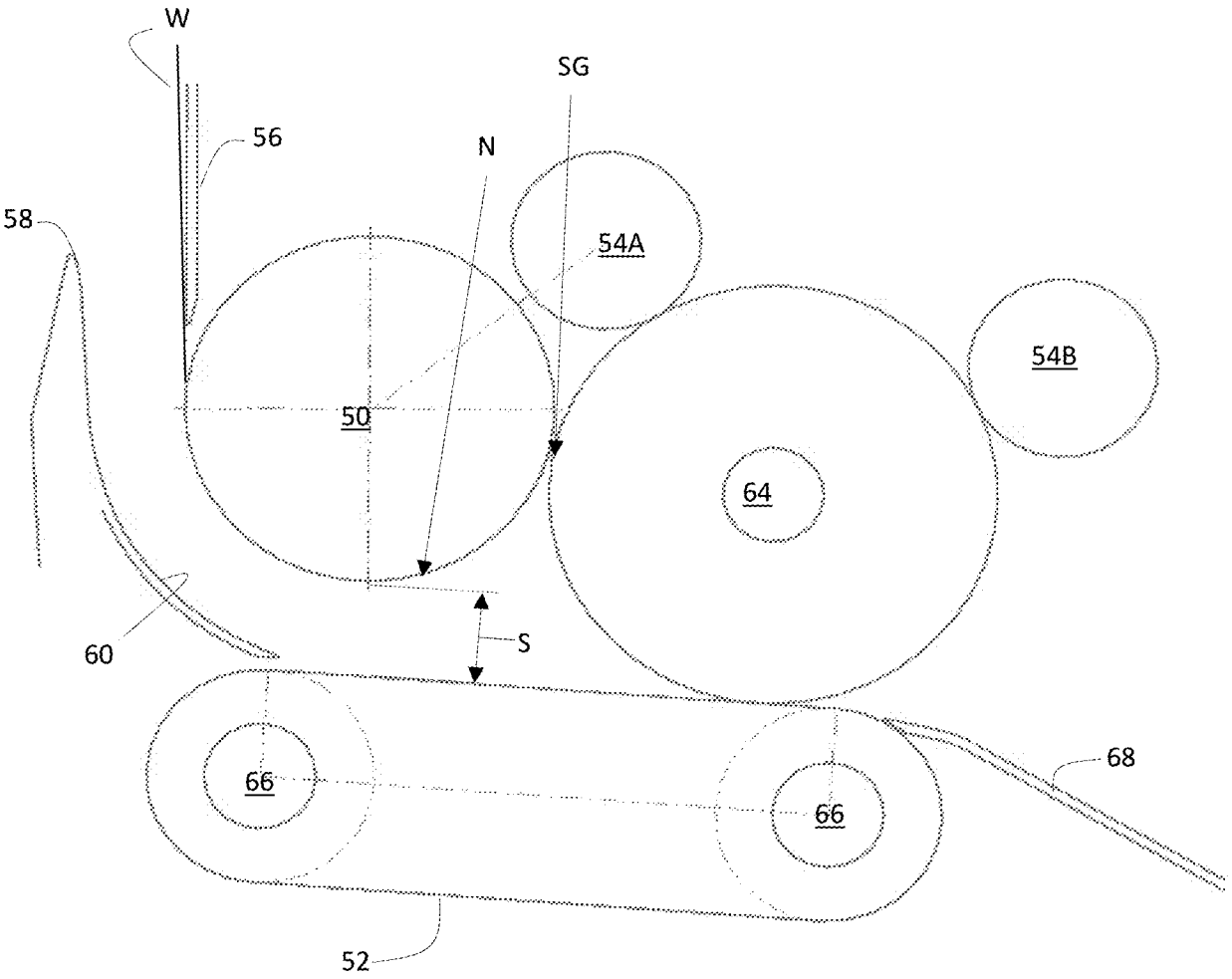
FIG. 37 illustrates the winding nest of FIG. 31 winding a 200 mm diameter log, where its gap to the winding drum is 2 mm and the length of the web span is approximately 27.1 mm.

FIGS. 25-30 show another embodiment of a winding nest configuration similar to the winding nest configuration of FIGS. 10-24, but providing a gap between the winding log 64 and winding drum 50 for a substantial portion of the winding cycle, preferably a majority of the winding cycle, more preferably greater than three-quarters of the winding cycle. The fraction of the winding cycle in which the log can be wound with a gap to the winding drum is influenced by the product length and its diameter with respect to the winding nest geometry. Therefore, the fraction of winding cycle in this configuration will vary by necessity and can also be varied for optimization of the process and product. The size of the gap may also be varied for optimization of the process and product. Without being limited to any theory, it is believed that moving the winding log away from the winding drum 50 during the winding cycle and forming a secondary winding nest between the rider roll 54A, the rider roll 54B, and the belt 52, wherein the web is not wrapped around and delivered into the log by any of the elements that are surface driving the log, but rather is laid onto the winding log independent of the surface driving elements, may be beneficial to winding high bulk and low firmness logs at high speeds, especially when done in conjunction with core chucks supporting and driving the core. The beginning part of the winding cycle may be like the beginning of the winding cycle for the winding nest configuration of FIGS. 10-24. For instance, FIG. 11 shows the rider roll 54A meeting an incoming log. FIG. 12 shows the rider roll 54A having migrated to near the top of a winding log 64, allowing space for the rider roll 54B to approach the side of the log, as shown in FIG. 13. FIG. 13 shows the rider roll 54B in contact with the log 64, at a position substantially equidistant from the rider roll 54A and the belt 52. The gap may be formed after the rider roll 54A has moved toward the top of the winding log 64 far enough that the log can be translated away from contact with the winding drum 50 under good control, for instance as shown in FIG. 14. At this point, the surface speed of the belt may be reduced to cause the log to move away from the winding drum 50. The rider rolls 54A,546 may assist with controlling the movement of the log 64 away from the winding drum 50. The core chucks 82 may also be engaged and rotationally driving the core 64, and may assist with controlling the movement of the log away from the winding drum. FIGS. 25-30 show winding a log in the winding nest with two rider rolls and the belt and a gap G between the log 64 and the winding drum 50. When the winding of the log 64 is nearly complete, the rider roll 54B may orbit to near the top of the log, providing space for the log to discharge. FIG. 30 shows the rider roll 54B having orbited upward to make space for the log discharge, as described previously. A core chuck or core chucks as described previously may be provided in the winding nest configuration shown in FIGS. 25-30.

FIGS. 31-37 show an alternate embodiment of a winding nest configuration similar to that of FIGS. 10-24 and FIGS. 25-30 where the motions of the winding drum 50, two rider rolls 54A,546 and the belt 52 are controlled to produce a small gap between the winding drum 50 and the log 64, and the rewinder control may monitor and enable changes in the amount of the gap during the winding cycle as may be desired to optimize the product and process. An objective of monitoring and changing the amount of the gap in the winding configuration of FIGS. 31-37 is to minimize the contact pressure in the nip between the winding drum 50 and the log 64. Without being limited to any theory, it is believed that moving the winding log away from the winding drum 50 during the winding cycle with a relatively small amount of gap, may be beneficial to winding high bulk and low firmness logs at high speeds, especially when done in conjunction with core chucks supporting and driving the core. It is believed a small gap may provide at least partial benefits of having a gap, as described previously, and yet provide at least partial benefits of having four contact nips, as described previously, because the gap is relatively small. The presence and/or size of a gap at this nip may be discerned by visual observation and/or sensor feedback. The sensor feedback may include photo-electric emitters and detectors and/or computer vision systems or other suitable devices. Modification of the motions may be made by an operator and/or the rewinder control system. Depending upon how the log reacts to the commanded motions, the motions may be adjusted to optimize the product and/or process. By way of example, if the gap is large, the motions may be adjusted to reduce the gap. If the gap is absent, the motions may be adjusted to create a gap. If the gap is too small, the motions may be adjusted to increase the gap. The motions may be adjusted so the gap is small and intermittent. In this way, the contact pressure between the log 64 and the winding drum 50 may be reduced or minimized or eliminated, and yet retain the advantages of winding with four regions of contact to some degree.

By way of example, the motions of the belt 52 and the rider rolls 54A,546 may be controlled to cause a gap between the winding drum 50 and the log 64 having a target dimension of 2 mm. A feedback loop associated with the control system may be enabled to sense whether a gap was created at this interface and measure its size. Though a gap may briefly form between the log 64, and the winding drum 50, the log may wind less tightly due to the reduced or eliminated pressure at its interface with the winding drum, and thus have relatively increased diameter and thereby rapidly or immediately fill this gap and resume contact with the winding drum. The feedback loop would sense the gap has closed. The control system may then, optionally, modify the motion profiles again to another target gap dimension or larger target gap dimension, possibly resulting in an even larger diameter log. This is advantageous when trying to maximize wound log diameter. The feedback of log diameter may be used to control the gap. For example, motions may be controlled to maintain the condition of no gap, intermittent gap, or an approximate size of a gap, when the desired log diameter is achieved. Motions may also be controlled to create a gap, create an intermittent gap, or increase the size of a gap, when the log diameter is too small. Motions may be controlled to eliminate a gap, eliminate an intermittent gap, or reduce the size of a gap, when the desired log diameter is too large. Motions may be controlled to eliminate a gap, eliminate an intermittent gap, or reduce the size of a gap, based on the level of the log vibration. Depending upon the amount of gap, one or both rider rolls may be controlled to have greater or less surface speed or positioned to provide greater or reduced pressure on the log, and/or the belt may be controlled to have greater or less surface speed. Even with a no-gap condition during stable log winding, there may be minimal nip pressure between the winding drum and the log so the winding drum for the most part delivers the web and only slightly drives rotation of the log. The gap may also close at least intermittently with log vibration. In this condition, the close proximity of the winding drum 50 to the log 64 serves to offer a fourth region of contact for log containment. The gap feedback may be used to adjust upstream processes such as embossing or calendaring, or web speed.

The beginning part of the winding cycle may be like the beginning of the winding cycle for the winding nest configurations of FIGS. 10-24 and FIGS. 25-30. FIG. 11 shows the rider roll 54A meeting an incoming log. FIG. 12 shows the rider roll 54A migrated to near the top of a winding log 64, allowing a space for the rider roll 54B to approach the side of the log. FIG. 13 shows the rider roll 54B in contact with the log 64, at a position substantially equidistant from the rider roll 54A and the belt 52. The gap may be formed after the rider roll 54A has moved toward the top of the winding log 64 far enough that the log can be translated away from contact with the winding drum 50 under good control. The surface speed of the belt may be reduced to cause the log to move away from the winding drum 50. The rider rolls 54A,54B may assist with controlling the movement of the log 64 away from the winding drum 50. The core chucks 82 may also be engaged and rotationally driving the core 64, and may assist with controlling the movement of the log away from the winding drum. FIGS. 31-37 show winding a log in the winding nest with two rider rolls and the belt and a small gap SG between the log 64 and the winding drum 50. When the winding of the log 64 is nearly complete, the rider rolls 54A,54B and belt 52 may cooperate to cause discharge of the log from the winding nest as described previously. A core chuck or core chucks 82 as described previously may be provided in the winding nest configuration shown in FIGS. 31-37.

Another alternate embodiment is a winding nest comprising a winding drum 50 and a belt 52 as shown and described in connection with FIGS. 1-6, but with the rider roll 54 omitted. In connection with this embodiment the winding core and web would pass into the winding area N as with the other embodiments, with its introduction controlled by the winding drum 50 and speed profile of the belt 52. The speed profile of the belt comprises a cyclic reduction and increase of the speed, as described previously. The belt 52 may also have its position varied with respect to the winding drum to further control the log progression, as described previously. In various cases, for example winding relatively firm logs, or at reduced winding speeds, or of narrower web widths, or a combination thereof, control of the log by the winding drum 50 and belt 52 may be sufficient. As described previously, the belt speed may be increased, or elevated, which tends to wind the log tighter, and also tends to increase the contact pressure of the log against the winding drum, which affords further control of the log. When the winding of the log is nearly complete the belt 52 may decrease in speed, causing the log to move away from the winding drum 50 for discharge, as previously described. The surface of the belt may have a slight incline downward toward the log discharge direction, which may assist with log discharge. An advantage of this embodiment is the reduced cost of having no rider roll(s). As was described above, it may be effective and economical at winding relatively firm logs, or at reduced winding speeds, or of narrower web widths. It may be useful especially in winding products which are often converted in narrower web widths. This may include plastic films, nonwovens, pressure sensitive substrates, specialty web materials, and the like. A core chuck or core chucks as described previously may be provided in this winding nest configuration. The core chuck or chucks may engage the winding log after it has come into contact with the belt and is being driven in rotation by the winding drum and the belt. The rotational speed and position of the core chucks may assist with control of the winding of the log. The rotational speed and/or position of the core chucks may assist with log discharge. Near or at the end of the winding cycle the chucks may increase in rotational speed to assist with log discharge. Near or at the end of the winding cycle the chucks may translate with the log to assist with log discharge.

Figure 38:
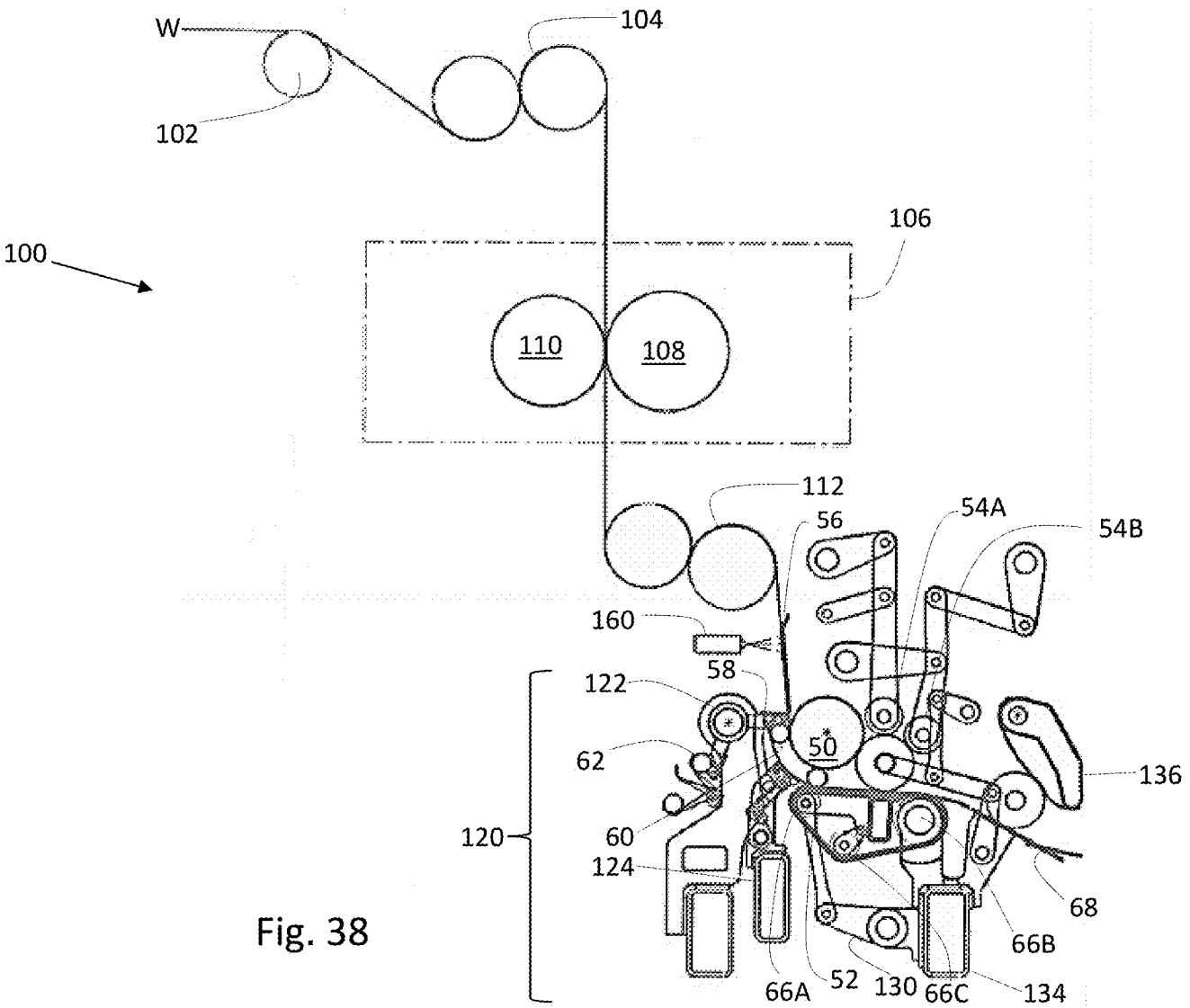
FIG. 38 shows a side view of an exemplary embodiment of a rewinding system incorporating a winding nest configuration comprising a winding drum and a belt.

FIG. 38 shows a schematic side view of an embodiment of a rewind system 100 which may use a winding nest configuration as described previously in this specification and include other components forming a path for the web material W to be wound. It may include a web spreading roller 102. It may include upper web feeding and guiding rollers 104, also referred to as upper draw rolls. Disposed downstream therefrom, the rewinder may be provided with a perforating unit 106. The perforating unit 106 may be configured to produce perforation lines in the web material W, which make the web weaker at localized points where it may be separated by the rewinder for web transfer or may be separated by the end user into individual sections or sheets, or both. Perforating roll member 108 may be provided with stationary cutting knives or blades for the perforating function. Perforating roll member 110 may be provided with one or more rotating knives or blades for the perforating function. Non-contact perforation devices known by those skilled in the art may also be used. Downstream of the perforating unit 106, the rewinder may be provided with lower web feeding and guiding rollers 112, also known as lower draw rolls. The lower draw rolls 112 may direct the web W to the rewinder apparatus 120. The relative speeds of the draw rolls 104,112 and the rewinder apparatus 120 may be changed with respect to each other, and with respect to other upstream equipment (not shown), to alter the tension in the web material W to be higher or lower, or optimized. In particular, the speed relationship between the upper and lower draw rolls 104,112 may be altered to modify or optimize the web tension through the perforating unit 106, and the speed relationship between the lower draw rolls 112 and the rewinder apparatus 120 may be altered to modify or optimize the web tension into the rewinder apparatus 120. Altering the speed relationship may be used to increase or decrease the web tension. Altering the speed relationship may be used to maintain or substantially maintain the web tension, for instance, in response to a disruption, such as when the web is severed or when the web is transferred to a core to initiate winding a log, or a change in the web material properties, such as a change in the elastic modulus of the web material. These speed relationships may be set to reduce or minimize or substantially eliminate the web tension, especially the web tension into the rewinder apparatus 120. Very low, and even substantially zero, web winding tension is favorable for winding high bulk logs and low firmness logs and low firmness logs of large diameter, and to maximize the diameter of log which can be wound from a certain length of web material. These speed relationships may be altered manually or automatically, based on observation or feedback signals, or according to a pre-defined profile the executes cyclically with the log winding cycle.

Disposed between the lower draw rolls 112 and the rewinder apparatus 120 is a web severing and core insertion apparatus 122. U.S. Pat. No. 6,422,501 discloses a core feeding, gluing, and insertion apparatus, which may be incorporated herein. Each core 62 may have a longitudinal line of transfer glue applied as it enters the rewinder apparatus 120. The core 62 may enter on guides (not shown) which bring it onto the lifting fingers at their lower shown position. These lifting fingers may rise to their upper shown position to load a core to the core inserter, which may receive and hold the core with vacuum. The lifting fingers may descend to their intermediate shown position, which allows a space beneath for a subsequent core to arrive and a space above for the core on the inserter to pass by. When the core inserter rotates clockwise to its insertion and web pinching positions, the lifting fingers may also rotate clockwise to move from above the core in the guides to beneath the core in the guides, which is a way to facilitate operation at high core loading and cycle rates.

U.S. Pat. Nos. 6,056,229 and 6,422,501 disclose a web severing and transfer apparatus which may be incorporated herein. A stationary pinch plate 56 may be provided on the same side of the web as the winding drum, in close proximity to the web. As the perforation which is to be severed to complete a winding cycle, and start the next winding cycle, approaches the winding drum, the core inserter rotates clockwise so the pinch pads disposed on it may approach the stationary pinch plate and the winding core disposed on it may approach the infeed fingers 58. The core inserter motion may be timed and phased to pinch the web against the stationary plate when the perforation is just downstream of the core, so in very rapid succession an abrupt tension rise severs the perforation and the core is pressed against the web between it and the winding drum and starts to rotate. As the core rotates the longitudinal strip of transfer glue may cause the leading edge of the web to adhere to the core and thus start winding of the log 64.

The log may continue along the transfer fingers 58 and rolling surface 60 to the winding nest N as previously described. The transfer fingers 58 and rolling surface 60 are shown supported on a beam 124. This beam 124 may be movable with respect to the winding drum 50 to adjust and optimize the distance from the drum to the fingers 58 and rolling surface 60. This movement may be used to adjust the distance based on the core diameter and/or core stiffness. The movement may be accomplished by supporting the beam on linear slides (not shown). The transfer fingers 58 may have a pivot mount with their inclination adjustable with a four-bar linkage. Their inclination may be adjusted to optimize the guiding of the core to its contact with the winding drum for the web transfer. Alternatively the transfer fingers 58 and/or rolling surface 60 may be exchanged for different shape parts to accommodate different core diameters, different core diameter ranges, and/or optimization of the distance to the winding drum 50.

Figure 39:
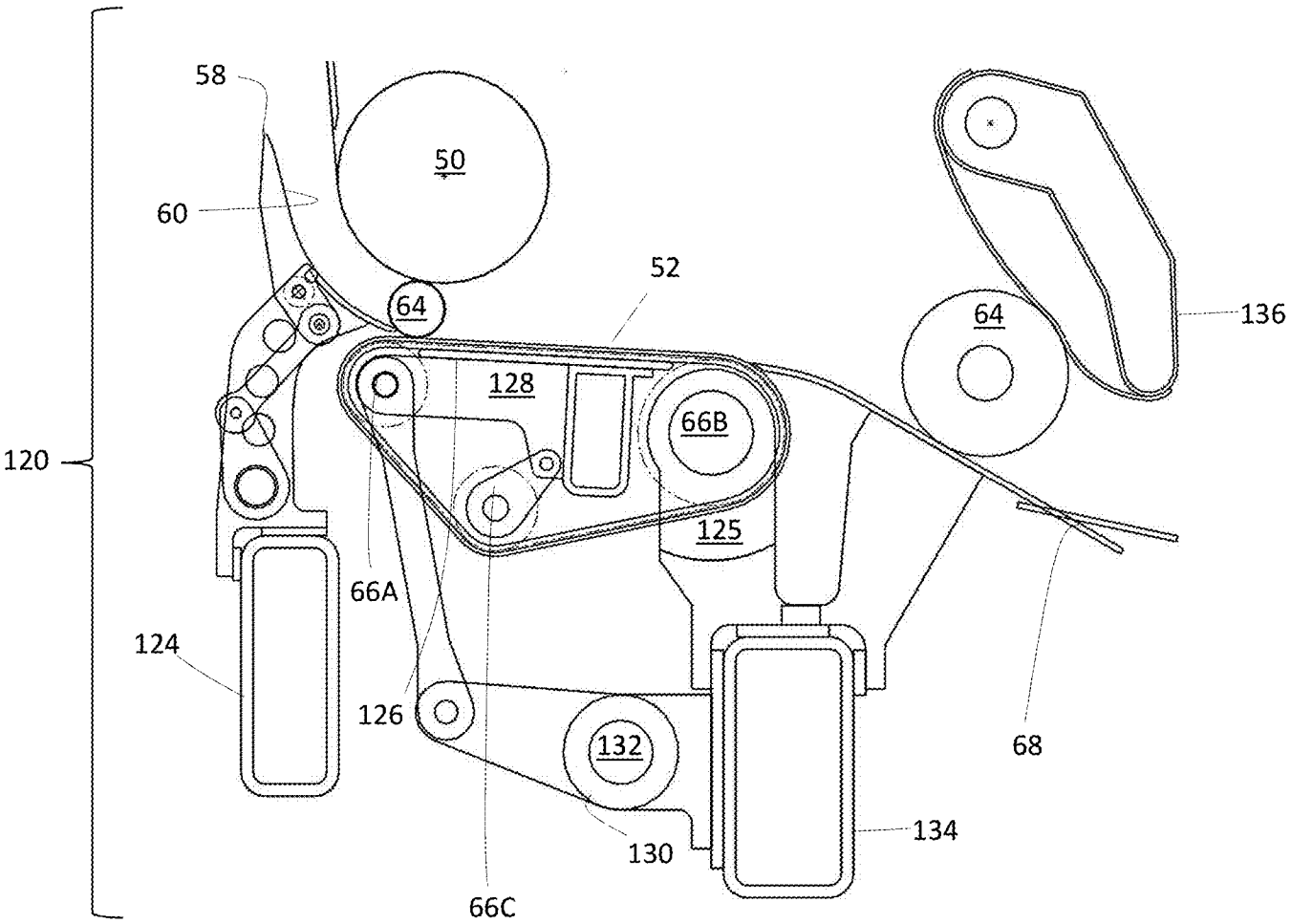
FIG. 39 shows an exemplary embodiment of the winding nest configuration of FIG. 38 with an incoming log shown at the moment of contact with the belt and other structural elements of the rewinding apparatus removed for ease of illustration.
Figure 40:
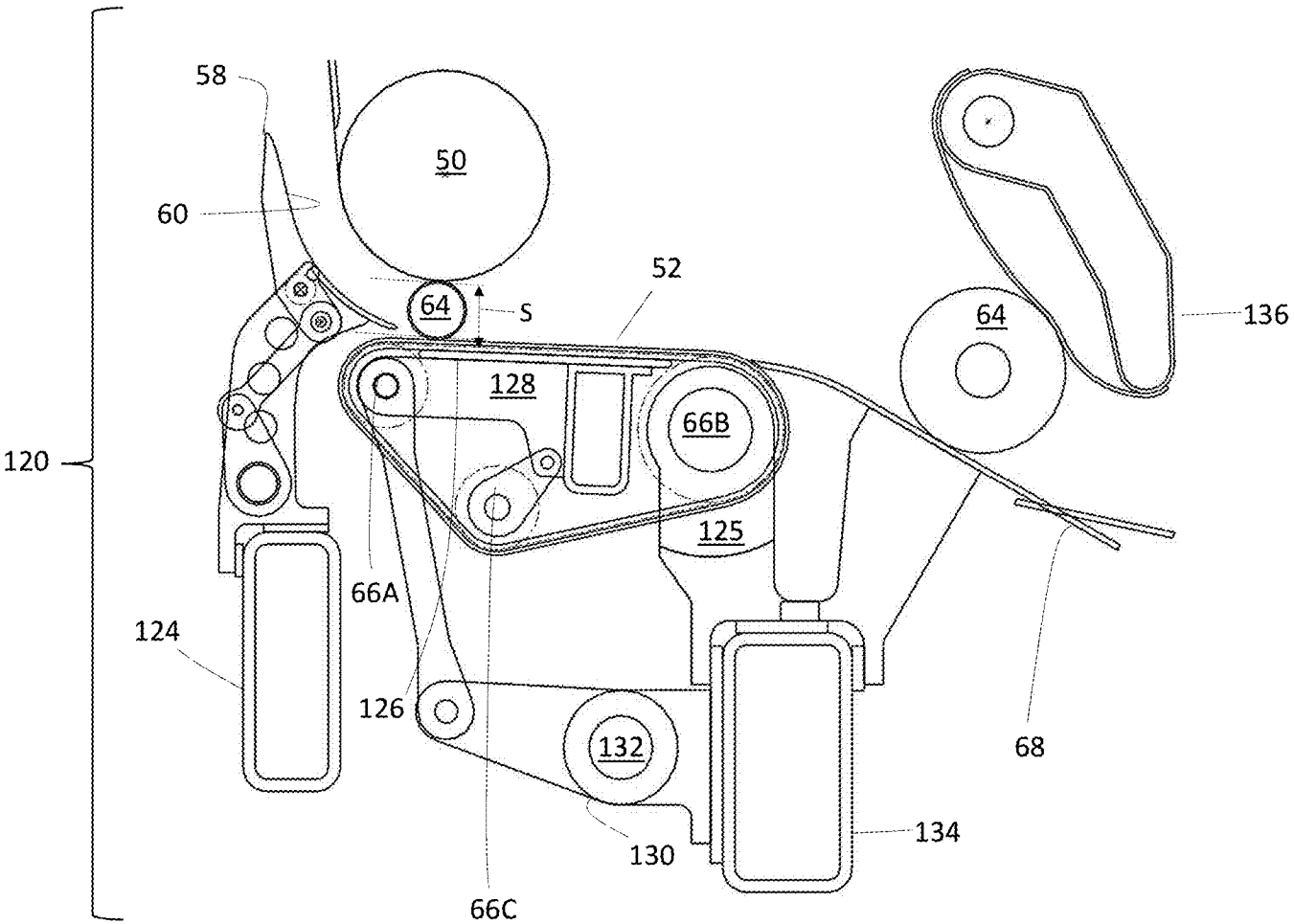
FIG. 40 illustrates the winding nest of FIG. 39 with the belt at a lower position and the log having a larger diameter at a more advanced position.
Figure 41:
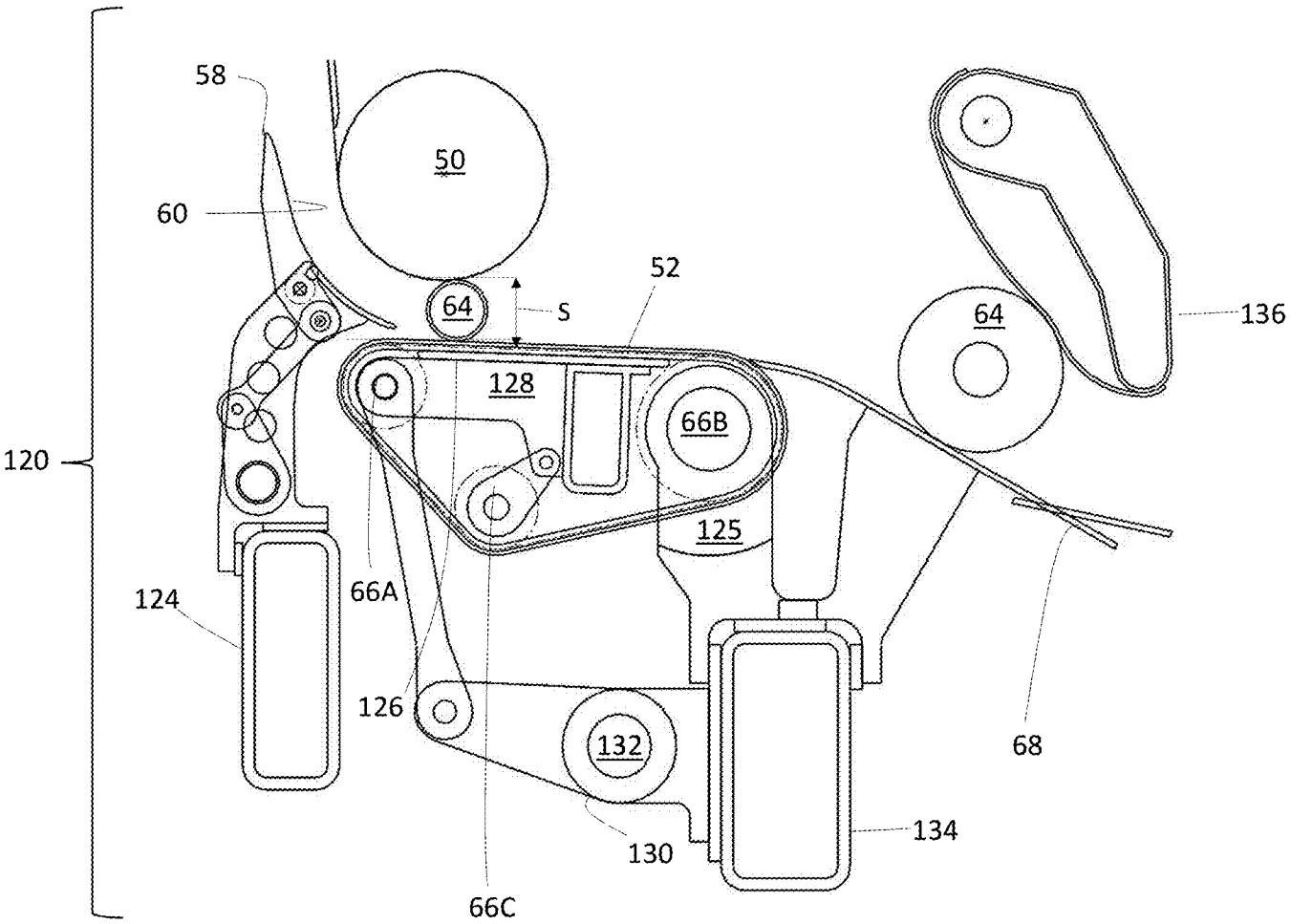
FIG. 41 illustrates the winding nest of FIG. 40 with the belt at a lower position and the log having a larger diameter at a more advanced position.
Figure 42:
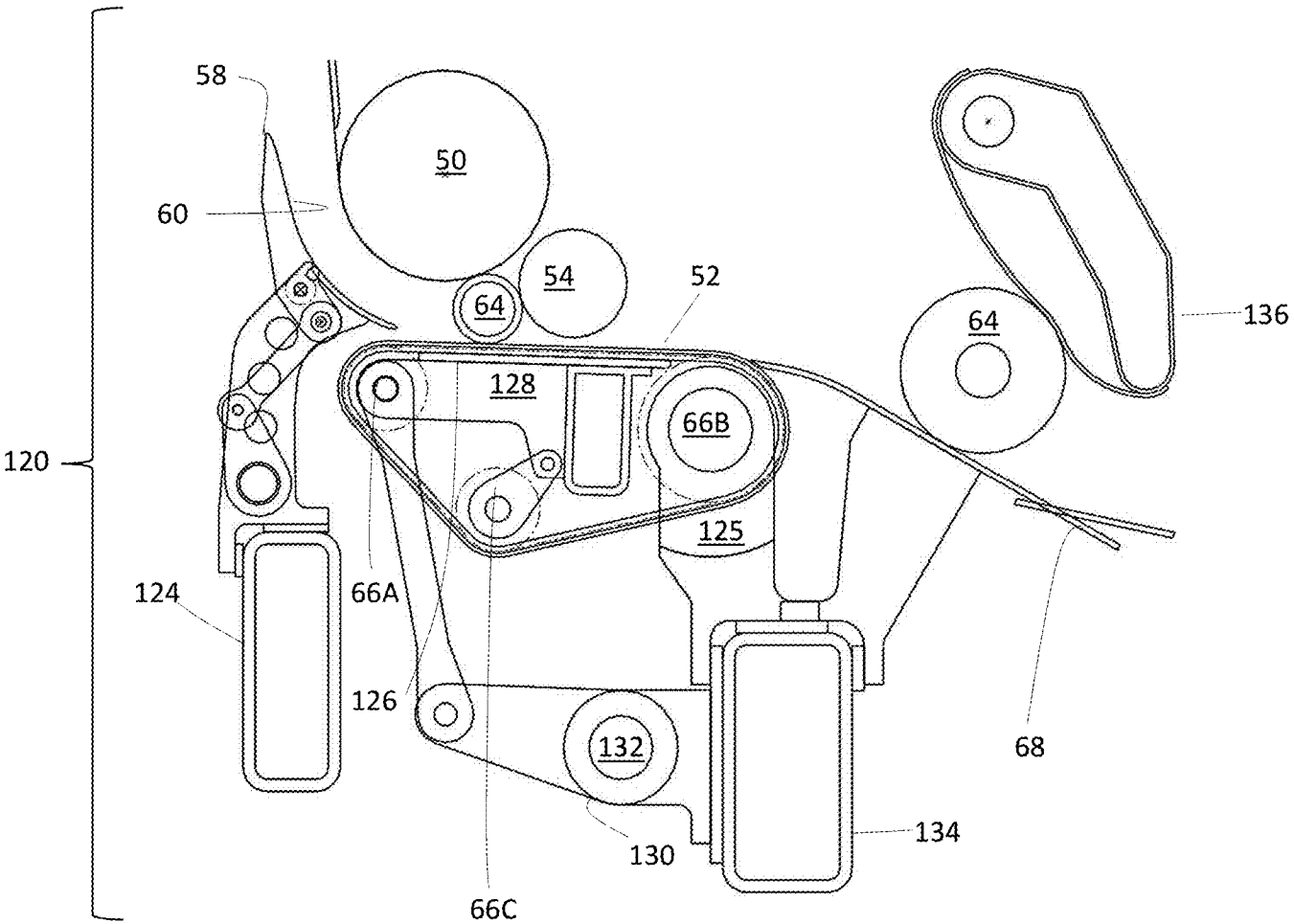
FIG. 42 illustrates the winding nest of FIG. 41 with the belt at a lower position and the log having a larger diameter at a more advanced position, with the rider roll contacting the log.

Making reference to FIG. 39, the belt 52 may be supported by upstream and downstream pulleys 66A,66B. The belt 52 may be driven to have a surface velocity by the downstream pulley and a motor 125 coupled thereto. A pulley 66C may be provided in the portion of the belt loop opposite the log contact portion of the loop. The pulley 66C may be movable to facilitate setting the tension in the belt. The pulley 66C may be moveable to facilitate mounting and/or dismounting a belt 52. The belt 52 may have a support 126 inside the belt loop that may operate against its inside surface in the portion of the belt loop that contacts the log 64. This support surface 126 is preferably flat. The support surface may also be slightly concave or convex. The support surface 126 may be in continuous contact with the belt during operation or intermittent contact, or not in contact. The belt support surface 126 tends to prevent excessive deflection or deformation of the belt. The support surface 126 may be set to have a gap to the belt 52 when idle. The belt 52 may contact the support surface 126 when it deflects or deforms under the load of a heavy winding log, or rider roll nip pressure transmitted through the log, or a crash event, or during an instance of a web blowout or failed log discharge, or the like. The support surface 126 is preferably comprised of low friction material, or coated with a low friction material, to minimize power losses to friction and/or wear of the belt and/or wear of the support surface. Exemplary low friction materials are plastics, acetal, nylon, and the like. The upstream and downstream ends of the support surface 126 may have chamfers and/or radii along their edges to facilitate smooth transfer of the belt or belt teeth onto and off of the support surface.

Also, making reference to FIG. 39, inside the belt loop, there may be a structure 128 to support the pulleys 66A,66C rotatably mounted in bearings and the belt support surface 126. The support 128 may comprise a beam element that extends substantially for the width of the belt(s) 52. The structure 128 may be supported from a beam outside the loop at or near its ends and optionally at intermediate points, or an intermediate point, as well. Utilizing an intermediate support or intermediate supports may allow the structure 128 to be sized smaller and with less mass, which is favorable for rapid motions.

Referring to FIGS. 39-42, cyclically moving the belt surface 52 farther from and closer to the winding drum 50 during the introduction and winding of the log may be accomplished by a belt positioning apparatus 130, which may comprise pivots, linkages, or a slide, or a combination thereof. Preferably, the belt positioning apparatus 130 includes pivoting motion driven by a motor 132 and linkages. Preferably, the belt 52 may pivoted about the downstream pulley 66B, which may also be the drive pulley for the belt 52. The downstream pulley 66B may be comprised of a single pulley. The downstream pulley may be comprised of at least two adjacent coaxial pulleys, with at least one intermediate bearing support between them. Also arranged on the beam 134 may be a pivot with a crank arm to control a four-bar linkage which is connected near the upstream end of the belt 52, which may be used to raise and lower the upstream end of the belt. The coupler of this four-bar linkage may connect at the axis of the upstream pulley 66A. A crank arm and 4-bar linkage may be disposed at each end of the belt system and at at least one intermediate support. The crank arms on the pivot are controlled by a motor with position feedback to execute the motion profile of the belt position for the log introduction and winding.

FIGS. 39-42 illustrate an example of how the belt 52 may be pivoted downward during log introduction to the winding nest N with the belt positioning mechanism 130. The belt positioning mechanism 130 may also be used to optimize the size of the space S of the nip between the belt 52 and the winding drum 50 and/or the angle of the belt. A beam 134 may be movable with respect to the winding drum 50 to adjust and optimize the space S between the belt 52 and the winding drum 50. The space S may be adjusted based on the core diameter and/or core stiffness independent of the belt inclination angle. This movement may be used to adjust the height of the belt system to compensate for reduction in thickness of the belt from wear. The movement may be accomplished by supporting the beam 134 on linear slides (not shown). The discharge surface 68 may be supported from the same beam 134, to facilitate retaining a correct relationship between the discharge surface 68 and the belt 52 when the belt height is adjusted. It is preferable that the exit height of the log from the rewinder is constant, so a fixed height rolling surface may be provided downstream from the adjustable height discharge surface, with fingers on its upstream side interdigitate with fingers on the downstream side of the discharge surface 68 to ensure a reliable log transition. A discharge gate 136 may be provided above the discharge surface 68 to capture a finished wound log and/or control the timing of the exit of the finished wound log from the rewinder apparatus 120.

Figure 10:
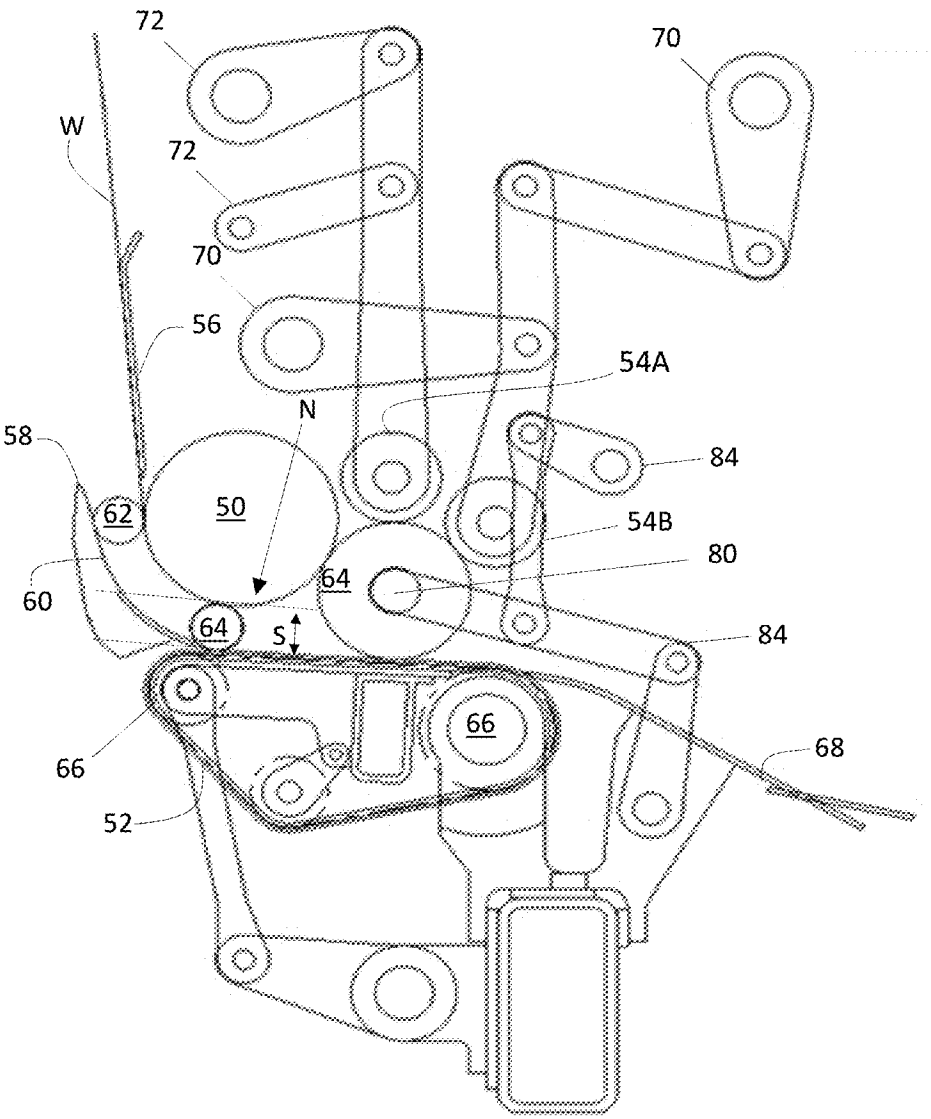
FIG. 10 illustrates an alternative embodiment of a winding nest configuration comprising a winding drum, a belt, and two rider rolls.

Making reference to FIG. 10, the rider roll positioning system 72 has geometry that develops an arc motion for the rider roll 54A with the center point of its arc coincident with the central axis of the winding drum 50. This is accomplished by using a four-bar linkage with parallel crank and follower links of common length. All points on the coupler execute an arc motion. The upper pivot may have crank arms controlled by a motor with position feedback to execute the motion profile of the rider roll position. The lower pivot may have follower links supported in simple bearing or bushing joints. A motor with its axis of rotation mounted coincident to the upper pivot may be used to control the rider roll positon. The rotational drive for the rider roll 54A may comprise timing belts operating on pulleys which are mounted adjacent to and coaxial with the linkage joints. The timing belt drive may extend in sequence back to a motor with its axis of rotation mounted coincident to the lower pivot, or near the lower pivot.

FIG. 10 illustrates a positioning system 70 which may be used for the rider roll 54B. The positioning system 70 allows for compound motion, which is a 2 degree-of-freedom device capable of arc motion, linear motion, or any combination thereof. This is accomplished by having motor controlled crank arms at the lower left pivot and motor controlled crank arms at the upper right pivot. Together the motors control the position of the rider roll 54B and can move it through the winding nest according to any motion path. The crank arms at both pivots are controlled by motors with position feedback to execute the motion profile of the rider roll position. The motors used to control the rider roll position may be mounted with their axes of rotation coincident to the lower left pivot and upper right pivot. The rotational drive for the rider roll 54B may comprise timing belts operating on pulleys which are mounted adjacent to and coaxial with the linkage joints. The timing belt drive may extend in sequence back to a motor with its axis of rotation mounted coincident to the lower left pivot, or near the lower left pivot.

FIG. 10 illustrates a positioning system 84 which may be used for the core end engagement assembly that allows for compound motion, which is a 2 degree-of-freedom device capable of arc motion, linear motion, or any combination thereof. This is accomplished by having a motor controlled crank arm at the lower pivot and a motor controlled crank arm at the upper pivot. Together the motors control the position of the core chuck and can move it through the winding nest according to any motion path. The crank arms at both pivots are controlled by motors with position feedback to execute the motion profile of the core chuck position. The motors used to control the core chuck position may be mounted with their axes of rotation coincident to the lower pivot and upper pivot.

The rotational drive for the core chuck may comprise timing belts operating on pulleys which are mounted adjacent to and coaxial with the linkage joints. The timing belt drive may extend in sequence back to a motor with its axis of rotation mounted coincident to the lower pivot or the upper pivot, or near one of these pivots. However, it is desirable that the rotational drive train for the core end engagement assembly 80 have a relatively low level of inertia. It can be appreciated that the core chucks must rotate at very high speed at the beginning of the winding cycle and when they engage the core. Speeds of 5,000-8,000 rev/min and greater may be contemplated. For example, the rotational speed of a log with 38 mm diameter and 800 m/min surface speed is approximately 6,700 rev/min. If the diameter of the log is smaller and/or its surface speed is greater, then its rotational speed is proportionately greater. The core chuck may be operated at greater rotational speed than the log before it engages the core in the log so that it may have matched velocity and matched rate of change in velocity (acceleration), and conceivably also matched rate of change in acceleration, so as to cause minimal disruption to the log and core when it is engaged to the core. The rotational speed of a log with 130 mm diameter and 800 m/min surface speed is approximately 1,960 rev/min. The rotational speed of a log with 200 mm diameter and 800 m/min surface speed is approximately 1,270 rpm. It can be appreciated that the inertia of the system should preferably be kept low so the torque required to execute such speed increases in the brief time after the chucks disengage from the core of a finished log and before they engage the core of a subsequent log is not excessive. In the alternative to a series of drive belts and pulleys for driving the core chucks, the core chucks may have a drive train comprising the flexible drive shaft 92, as shown in FIGS. 8 and 9. Such a flexible drive shaft may be commercially available from Suhner Manufacturing Inc., of Rome, GA, United States.

FIGS. 8 and 9 illustrate in cross-section an exemplary core end engagement assembly 80 which may be used in a winding nest configuration as described previously in this specification. In FIG. 8, the chuck 82 is shown in its radially contracted state, and outside a tubular winding core 62. The unit may be supported by a frame arm of the positioning system 84, which is located, as described previously, by the core chuck positon motors. The flexible shaft 96 may drive the chuck to rotate, as described previously, by a motor (not shown) at the far end of the flexible shaft. The control rod 90 may pass from the flexible shaft connection at the rear of the assembly, through the inside of the assembly, through the support shaft 90 to the chuck 82. The linear actuator 86 may be used to shift the assembly translationally along its axis, inwardly toward the core of the log and outwardly away from the core of the log. The second linear actuator 88 may be disposed near the rear of the assembly, and its rod end may be connected to the drive housing 94 with a first arm 146. A second arm 148 may connect the body of the second linear actuator 88 to the control rod 90 through a thrust bearing 150 which allows relative rotation between the control rod 94 and the second arm 148, but causes the control rod 90 and the second arm 148 to move axially together. In the arrangement shown in FIGS. 8 and 9, when the second linear actuator 88 extends, the second linear actuator 88 moves the control rod 90 (leftward in the drawings) axially within the drive housing 94 and support shaft 92. The body of the chuck 82 comprises elastomer rings, which may be disposed on the distal end of the control rod 90. When the elastomer rings are compressed axially they expand radially and may engage the inside surface of a core with surface pressure. A single elastomer ring may be used on the chuck body. Preferably two or more elastomer rings are used on the chuck body to ensure good engagement between the core and chuck so that the engagement can transmit a moment load which resists vibrational flexing of the core in a beam mode. The amount of radial expansion may be set by controlling the travel of the second linear actuator 88. The amount of pressure of the chuck against the inside surface of the core may be set by controlling the level of force imposed by the second linear actuator 88, which may be accomplished by controlling the level of pneumatic pressure, if the actuator is a pneumatic cylinder. Retraction of the second linear actuator 88 will relieve the axial compression on the elastomer rings and allow them to contract radially, tending to return to their original undeformed size. The annular elastomer pieces may be adhered or joined at their ends to the chuck body and shaft support 92 so that when the control rod 90 retracts (shifts rightward in the drawings), the elastomer rings not only contract radially due to their tendency of elastic return, but are drawn down in diameter due to the application of axial tension to the annular elastomer pieces. By this action, if the control rod 90 is retracted rapidly (e.g., moved rightward rapidly), the elastomer rings may be made to contract rapidly. Rapid contraction is favorable for executing a precise timing sequence that is necessary for operation at high speeds and/or high cycle rates. It is favorable for ensuring the chuck has disengaged the core end before attempting to withdraw the chuck from the core.

During operation, the frame arm of the core chuck positioning system 84 may be moved to align the chuck body with the end of the core 62. The first linear actuator 86 may retract to slide the drive housing 94 axially to insert the chuck body into the core end. When the chuck is inside the core the second linear actuator 88 may extend to axially move control rod 90 to engage the core (leftward in the drawings). The support shaft 92 is axially restrained so the annular elastic pieces are compressed axially and expand radially to engage the inside surface of the core. FIG. 9 illustrates in cross-section the core chuck of FIG. 8 inside a core and radially expanded to engage the core. During winding of a log, the first linear actuator 86 may be commanded to extend, which will cause a tension force in the core, as described previously. Or a third linear actuator (not shown) may be used, positioned in series with the first linear actuator 86, to produce the tension force in the core. The actuation motion to induce a tension force in the core may be executed at just one end of the core. This means that after both core chucks have engaged the core, one of them may be held axially fixed and the other may be moved axially to cause the tension force in the core so that the core does not drift axially in the machine or in the log during winding. Near the end of the log winding cycle the tension force that was induced in the core may be relieved by causing the linear actuator 86 to cease pulling on the core, the core chucks may be disengaged from the core ends by causing the linear actuator 88 to retract the control rod 90 (move rightward in the drawings) to contract the annular elastic pieces, and the linear actuator 86 may shift the assembly leftward to withdraw the core chuck from the core. After the core chucks have disengaged a core the rotational speed of the chucks may be adjusted to match the speed required for engagement with the core in the next log as the core chuck positioning motors move the assembly to the center of the next log.

The flexible shaft 96 may undergo changes in its curvature to accommodate the axial and spatial movements of the assembly as the core chucks are inserted into cores, as the core chucks track with the centers of winding logs, as the core chucks are withdrawn from the cores, and as the core chucks travel to align with the center of a subsequent log. Changes to the curvature of the flexible shaft may accommodate the axial movement of the control rod 90 when the assembly is shifted axially to insert or remove the chuck from a core. The flexible shaft may also accommodate the axial movement of the control rod 90 when second linear actuator 88 shifts axially to expand or contract the chuck, and movement of the control rod 90 through space by the core chuck positioning motors. Thus the flexible drive shaft may accommodate three translational degrees of freedom in addition to the rotational degree of freedom utilized to drive the chuck 82.

FIGS. 8 and 9 show the linear actuators 86,88 as pneumatic cylinders. However, different actuators may be used for this function. An advantageous example is a linear induction motor. A particularly advantageous example is a linear induction motor with position and force feedback which may be operated under position control, or force control, or both. The core chuck may be inserted very quickly and smoothly with a programmed motion profile. The actuator may very quickly switch to applying a controlled tension force to the core during the winding. The actuator may relieve this tension force extremely quickly when it is time to disengage the core, and then withdraw the core chuck very quickly and smoothly with a programmed motion profile. Alternatively, a servo pneumatic system, which uses position and air pressure feedback to control the linear actuator may be employed.

FIGS. 8 and 9 show core chucks 82 which engage the core ends by expanding elastomer rings radially due to axial compression. However, different chuck types may be used for this function. The chucks may comprise annular bladders which expand radially when inflated by air pressure to engage the inside surface of the core, as is known in the art. The chucks may comprise mechanical elements which expand radially under the urging of push rods, cams, wedges, or the like, to engage the inside surface of the core.

FIG. 38 shows a sprayer 160 disposed upstream of the winding nest in proximity to the web. The sprayer 160 may be a spray nozzle, or more preferably a plurality of spray nozzles. Spray nozzles or spray guns may be provided upstream of the winding nest to spray a liquid, or fluid, or mist, atomized dispersion, or the like of an agent on the web before it is wound into the log. In the embodiment of rewinder shown in FIG. 38, the nozzles of the sprayer are preferably on the side of the web opposite the stationary pinch plate 56 and the winding drum 50, and preferably downstream of the lower draw rolls 112. Applying the agent to a web surface which will not pass over any rollers before being wound into the log may be favorable to keep the agent from depositing on the rollers and being wasted or fouling the rollers. Applying the agent to a web surface which is opposite the stationary pinch plate 56 may afford support to the web span by the pinch plate to minimize disturbance from the air flow or flow of the agent to the web. Such an agent as adhesive, or starch, or binder, or the like may be applied to the web and used to bond the initial layers of wrapped web in the log to each other. The bonding may be very light or strong by varying the chemistry and amount of the agent applied. The bonding may be temporary, so that the layers can be dispensed by unwinding from the roll and preferably used. Bonding the initial layers of wrapped web to each other can be advantageous for strengthening or stiffening or making more durable the hole of a coreless product, which may be produced in the rewinder embodiments illustrated in the figures of this specification with a removable mandrel. The agent may also be used to keep the central opening in the final roll product from collapsing. In some cases, the agent may be water with minimal or no adhesive. Application of water, even without adhesive, may be used to attach layers of wrapped tissue, towel, and paper webs to each other in the log, through the formation and/or reformation of hydrogen bonds, or by activating bonding agents that are present in the web material.

The embodiments were chosen and described in order to best explain the principles of the disclosure and their practical application to thereby enable others skilled in the art to best utilize said principles in various embodiments and with various modifications as are suited to the particular use contemplated. As various other modifications could be made in the constructions and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. A rewinding machine for winding web material into a log about a core, the machine comprising:

a winding drum rotatable about a center axis and about which the web material to be wound is directed;

a continuous loop spaced from the winding drum and with the winding drum defining a nip through which the core is inserted and through which the web material is directed when winding the web material about the core, the continuous loop being configured to move in a direction generally opposite a direction of the winding drum at the nip for winding the web material about the core; and a rider roll defining a winding space with the winding drum and the continuous loop, the rider roll being movable relative to the continuous loop and the winding drum to allow an increase in a diameter of the log in the winding space during winding of the web material about the core.

2. The rewinding machine of claim 1 wherein the continuous loop is movable relative to the winding drum to change a spacing of the nip.

3. The rewinding machine of claim 1 wherein the rider roll is positioned relative to the continuous loop and the winding drum with a positioning mechanism providing at least one of compound motion, arcuate motion, and linear reciprocating motion.

4. The rewinding machine of claim 1 further comprising a further rider roll being movable relative to the continuous loop, the rider roll, and the winding drum to allow an increase in a diameter of the log in the winding space during winding of the web material about the core.

5. The rewinding machine of claim 4 wherein the rider roll has a first positioning mechanism providing arcuate motion for the rider roll and the further rider roll has a second positioning mechanism providing the further rider roll with compound motion.

6. The rewinding machine of claim 1 wherein the continuous loop has a span facing the winding drum defining a surface on which the log travels in the winding space.

7. The rewinding machine of claim 6 wherein the continuous loop is adapted and configured to operate in a manner such that the span of the continuous loop facing the winding drum moves in a direction substantially opposite to the direction of advancement of the log along the continuous loop.

8. The rewinding machine of claim 1 further comprising a rolling surface adapted and configured to deliver a core onto the continuous loop at the nip between the continuous loop and the winding drum.

9. The rewinding machine of claim 8 wherein the rolling surface is developed around the winding drum and extends toward the nip between the continuous loop and the winding drum.

10. The rewinding machine of claim 1 further comprising at least one core end engagement assembly adapted and configured to engage an end of the core and transmit rotational movement to the core during winding of the web material about the core.

11. The rewinding machine of claim 10 wherein the at least one core end engagement assembly is adapted and configured to engage the core after the core has been brought into rotation and into contact with the web material.

12. The rewinding machine of claim 10 wherein the at least one core end engagement assembly is adapted and configured to engage the core after the core has been brought into rotation and the log has been brought into contact with the continuous loop.

13. The rewinding machine of claim 10 wherein the at least one core end engagement assembly is adapted and configured to disengage from the core before winding of the log on the core has been completed.

14. The rewinding machine of claim 10 wherein the at least one core end engagement assembly comprises a chuck configured to engage an inside surface of the core.

15. The rewinding machine of claim 10 further comprising a second core end engagement assembly laterally spaced from the at least one core end engagement assembly, the core end engagement assemblies being adapted and configured to apply axial tension to the core during winding of the web material about the core.

16. The rewinding machine of claim 1 wherein the continuous loop is adapted and configured to change speed relative to a speed of the winding drum during winding of the web material about the core.

17. The rewinding machine of claim 16 wherein the continuous loop is adapted and configured to reduce speed relative to the speed of the winding drum to advance the core through the nip between the winding drum and the continuous loop.

18. The rewinding machine of claim 16 wherein the continuous loop is adapted and configured to reduce speed relative to the speed of the winding drum to advance the log from the winding nest.

19. The rewinding machine of claim 1 wherein the continuous loop is adapted and configured to advance the core through the nip defined by the winding drum and the continuous loop.

* * * * *